US010952570B2

(12) United States Patent
Robertson et al.

(10) Patent No.: US 10,952,570 B2
(45) Date of Patent: Mar. 23, 2021

(54) SPINDLES AND DISPENSERS FOR SHEET PRODUCT

(71) Applicant: GPCP IP Holdings LLC, Atlanta, GA (US)

(72) Inventors: Timothy Andrew Robertson, Appleton, WI (US); Steven B. Mattheeussen, Fremont, WI (US)

(73) Assignee: GPCP IP HOLDINGS LLC, Atlanta, GA (US)

( * ) Notice: Subject to any disclaimer, the term of this patent is extended or adjusted under 35 U.S.C. 154(b) by 108 days.

(21) Appl. No.: 16/145,890

(22) Filed: Sep. 28, 2018

(65) Prior Publication Data

US 2020/0102180 A1 Apr. 2, 2020

(51) Int. Cl.
*A47K 10/36* (2006.01)
*A47K 10/40* (2006.01)
(Continued)

(52) U.S. Cl.
CPC ..... *A47K 10/3687* (2013.01); *A47K 10/40* (2013.01); *B65H 16/005* (2013.01);
(Continued)

(58) Field of Classification Search
CPC ..... A47K 10/3687; A47K 10/3845; A47K 10/40; A47K 2010/3206; A47K 2010/3246; A47K 2010/3253; B65H 16/005; B65H 2402/441; B65H 2402/45; B65H 2405/45; B65H 2301/41398; B65H 2701/18422
See application file for complete search history.

(56) References Cited

U.S. PATENT DOCUMENTS 676,335 A 6/1901 Moffatt
805,011 A 11/1905 Gomber
(Continued)

FOREIGN PATENT DOCUMENTS

CA 1072504 2/1980
CA 2130524 2/1996
(Continued)

OTHER PUBLICATIONS

U.S. Appl. No. 16/145,876, filed Sep. 28, 2018, entitled "Spindle Assembly for Sheet Product Dispensers".
(Continued)

*Primary Examiner* — William E Dondero
(74) *Attorney, Agent, or Firm* — Nelson Mullins Riley & Scarborough LLP

(57) ABSTRACT

A sheet product dispenser for dispensing sheet product from a roll of sheet product is provided. An example sheet product dispenser includes a housing defining an interior space for receiving a first roll of sheet product therein, a mandrel positioned within the interior space, and a spindle positioned over at least a portion of the mandrel and configured to support the first roll of sheet product for rotation about the mandrel. The spindle comprises a base portion and a nose portion configured to translate relative to one another along a longitudinal axis of the mandrel. At least a portion of the spindle is configured to translate relative to the mandrel from a first configuration to a second configuration to cause a remainder of the first roll of sheet product to deform and enable movement of a dispensing door to enable access to a second roll of sheet product.

17 Claims, 29 Drawing Sheets

(51) Int. Cl.

| | |
|---|---|
| ***B65H 75/12*** | (2006.01) |
| ***B65H 75/24*** | (2006.01) |
| ***B65H 16/00*** | (2006.01) |
| ***A47K 10/32*** | (2006.01) |

(52) U.S. Cl.

CPC ..... *B65H 75/12* (2013.01); *B65H 75/241* (2013.01); *A47K 2010/3206* (2013.01); *A47K 2010/3253* (2013.01); *B65H 2301/41398* (2013.01); *B65H 2402/441* (2013.01); *B65H 2402/45* (2013.01); *B65H 2402/64* (2013.01); *B65H 2405/45* (2013.01); *B65H 2701/18422* (2013.01)

(56) References Cited

U.S. PATENT DOCUMENTS

| | | | |
|---|---|---|---|
| 1,281,861 | A | 10/1918 | Sibley |
| 1,928,979 | A | 10/1933 | Levison |
| 2,248,716 | A | 7/1941 | Markle, Jr. |
| 2,443,243 | A | 6/1948 | Hayssen |
| 2,952,418 | A | 9/1960 | Rice |
| 3,211,504 | A | 10/1965 | Bump |
| 3,285,528 | A | 11/1966 | Beindorf |
| 3,375,995 | A | 4/1968 | Roman |
| 3,788,573 | A | 1/1974 | Thomson et al. |
| 3,917,185 | A | 11/1975 | Canada et al. |
| 4,067,511 | A | 1/1978 | Hermanns |
| 4,149,682 | A | 4/1979 | Gustafson et al. |
| 4,300,727 | A | 11/1981 | Koch et al. |
| 4,354,644 | A | 10/1982 | Grant |
| 4,436,249 | A | 3/1984 | Santa Lucia et al. |
| 4,447,015 | A | 5/1984 | Peterson |
| 5,366,175 | A | 11/1994 | Schutz |
| 5,370,336 | A | 12/1994 | Whittington |
| 5,370,339 | A | 12/1994 | Mooody et al. |
| 5,374,008 | A | 12/1994 | Halvorson et al. |
| 5,445,345 | A | 8/1995 | Neveu et al. |
| 5,451,013 | A | 9/1995 | Schutz |
| 5,467,935 | A | 11/1995 | Moody |
| 5,495,997 | A | 3/1996 | Moody |
| 5,509,593 | A | 4/1996 | Bloch et al. |
| 5,524,835 | A | 6/1996 | Collins |
| 5,645,244 | A | 7/1997 | Moody |
| 5,803,399 | A | 9/1998 | Hashikawa |
| 5,813,624 | A | 9/1998 | Grasso et al. |
| 5,868,342 | A | 2/1999 | Moody et al. |
| 5,904,316 | A | 5/1999 | Dunning et al. |
| 6,036,134 | A | 3/2000 | Moody |
| 6,056,235 | A | 5/2000 | Brozinsky |
| 6,155,517 | A | 12/2000 | Lippold et al. |
| 6,202,956 | B1 | 3/2001 | Grasso et al. |
| 6,241,180 | B1 | 6/2001 | Potter |
| 6,902,133 | B1 | 6/2005 | Black |
| 7,083,138 | B2 | 8/2006 | Elliott et al. |
| 7,395,986 | B1 | 7/2008 | Haering |
| 7,422,174 | B2 | 9/2008 | Elliott et al. |
| 7,841,558 | B2 | 11/2010 | Elliott et al. |
| 7,861,964 | B2 | 1/2011 | Cittadino et al. |
| D703,461 | S | 4/2014 | Myron |
| 9,648,995 | B2 | 5/2017 | Elliott et al. |
| 9,918,598 | B2 | 3/2018 | Osborne |
| 2003/0106957 | A1 | 6/2003 | Seybold et al. |
| 2005/0067424 | A1 | 3/2005 | Duff |
| 2005/0139721 | A1 | 6/2005 | Andersson |
| 2008/0035696 | A1 | 2/2008 | Nichols et al. |
| 2009/0057169 | A1 | 3/2009 | Kruchoski et al. |
| 2009/0236464 | A1 | 9/2009 | Cittadino et al. |
| 2010/0213303 | A1 | 8/2010 | Sanders |
| 2010/0236956 | A1 | 9/2010 | Kling et al. |
| 2012/0097790 | A1 | 4/2012 | Wilkins et al. |
| 2012/0104142 | A1 | 5/2012 | Phelps |
| 2012/0104143 | A1 | 5/2012 | Phelps |
| 2012/0111987 | A1 | 5/2012 | Phelps |
| 2014/0367507 | A1 | 12/2014 | Trampolski |
| 2015/0307315 | A1 | 10/2015 | Techlin et al. |
| 2016/0037979 | A1 | 2/2016 | Mattheeussen et al. |
| 2017/0071421 | A1 | 3/2017 | Hagleitner |
| 2018/0146829 | A1 | 5/2018 | Osborne |
| 2018/0325333 | A1 | 11/2018 | Murphy et al. |

FOREIGN PATENT DOCUMENTS

| | | | |
|---|---|---|---|
| CA | 2 414 887 | A1 | 6/2003 |
| CA | 2 615 407 | A1 | 6/2008 |
| CA | 2 879 799 | A1 | 2/2014 |
| EP | 0 479 544 | A2 | 4/1992 |
| EP | 0 595 008 | A1 | 5/1994 |
| EP | 0 698 367 | A1 | 2/1996 |
| EP | 0 758 539 | A1 | 2/1997 |
| EP | 1 146 003 | A2 | 10/2001 |
| EP | 1559357 | A2 | 8/2005 |
| FR | 2652735 | A1 | 4/1991 |
| FR | 2669013 | A1 | 5/1992 |
| FR | 2750969 | A1 | 1/1998 |
| GB | 1 385 725 | | 2/1975 |
| NL | 78196 | C | 1/1955 |
| SE | 520326 | C2 | 6/2003 |
| WO | WO 93/10700 | A1 | 6/1993 |
| WO | WO 97/04699 | A1 | 2/1997 |
| WO | WO 97/37918 | A1 | 10/1997 |
| WO | WO 98/17924 | A1 | 4/1998 |
| WO | WO 2007/111561 | A1 | 10/2007 |
| WO | WO 2008/004919 | A1 | 1/2008 |
| WO | WO 2008/004920 | A1 | 1/2008 |
| WO | WO 2010/011165 | A1 | 1/2010 |
| WO | WO 2011/002360 | A1 | 1/2011 |
| WO | WO 2014/007690 | A1 | 1/2014 |
| WO | WO 2017/084689 | A1 | 5/2017 |

OTHER PUBLICATIONS

GP Compact Black Side-by-Side Double Roll Toilet Paper Dispenser (3 pgs.) Website visited Feb. 25, 2019 https://catalog.gppro.com/CATALOG/6281/29381?FILTER=full.

Feb. 4, 2020 Search Report and Written Opinion issued in International Patent Application No. PCT/US2019/053195.

SPINDLES AND DISPENSERS FOR SHEET PRODUCT

FIELD OF THE DISCLOSURE

MUM The present disclosure relates generally to sheet products and sheet product dispensers and more particularly to spindles for supporting a roll of sheet product with respect to a sheet product dispenser.

BACKGROUND

Various types of sheet product dispensers are known in the art, including mechanical and automated dispensers configured to dispense sheet product from a roll of sheet product that is rotatably supported by the dispenser. Bath tissue, facial tissue, paper towels, napkins, wipes, and other types of sheet product may be provided in roll form for dispensing from a sheet product dispenser. A roll of sheet product generally may include a web of sheet product that is wrapped around a longitudinal axis such that numerous layers of the sheet product are wound around one another. In this manner, sheet product may be dispensed by manually or automatically rotating the roll to unwind a portion of the sheet product from the roll and then separating the portion from a remainder of the roll for use. The roll of sheet product may include a central opening extending therethrough along the longitudinal axis of the roll. Certain rolls of sheet product may be coreless, such that the central opening of the roll is defined by an inner layer of the sheet product. Other rolls of sheet product may be cored, such that the central opening of the roll is defined by a core of paperboard or other material around which the layers of the sheet product are wound.

SUMMARY

According to various sheet product dispenser configurations, the central opening of a roll of sheet product may be used to rotatably support the roll with respect to the sheet product dispenser. For example, certain sheet product dispensers may include a spindle or other type of support that is positioned at least partially within the central opening and allows the roll of sheet product to rotate with respect to the sheet product dispenser. Certain sheet product dispensers may be configured for use with coreless rolls of sheet product, while other sheet product dispensers may be configured for use with cored rolls of sheet product. In this manner, a spindle of a sheet product dispenser may be specifically designed to engage and cooperate with either an inner layer of the sheet product (for coreless rolls of sheet product) or a paperboard core (for cored rolls of sheet product). In some instances, it may be possible to load a cored roll of sheet product onto a spindle designed for use with coreless rolls or to load a coreless roll of sheet product onto a spindle designed for use with cored rolls. However, such unintended uses may result in certain problems affecting the quality of dispensing. For example, interaction between the roll of sheet product and the spindle or other portions of the dispenser may cause an undesirable amount of friction (greater or less than desired) to be generated therebetween during rotation of the roll, which may cause the roll to rotate at an undesirable rate (faster or slower than desired) or at an uneven rate during dispensing. Such issues may result in poor user experience and negative user perception of the dispenser.

Certain sheet product dispensers may be configured to support multiple rolls of sheet product at a time and thus may include multiple spindles each supporting a different roll of sheet product. For example, multi-roll dispensers may include multiple spindles arranged in a side-by-side configuration, a stacked configuration, or a carousel configuration. Certain multi-roll dispensers may be configured such that only one of the rolls of sheet product may be accessed at a time by a user for dispensing sheet product therefrom, while any remaining rolls are covered by a housing of the dispenser. According to certain multi-roll dispensers, upon depletion of a dispensed roll of sheet product, the housing may be moved or otherwise manipulated from one configuration to another to make a new roll of sheet product accessible for dispensing. According to other multi-roll dispensers, upon depletion of a dispensed roll of sheet product, one or more of the spindles of the dispenser may be moved relative to the housing to make a new roll of sheet product accessible for dispensing. Certain multi-roll dispensers may allow a user to access a new roll of sheet product by moving the housing or the spindles of the dispenser regardless of a degree of depletion of a currently accessible roll. In this manner, a user may make a new roll of sheet product accessible for dispensing even when a partially-depleted roll is accessible via the dispenser. Ultimately, this practice may result in significant waste of sheet product because maintenance personnel may replace any partially-depleted rolls of sheet product with new rolls on a regular basis for efficiency purposes and to ensure continued availability of sheet product via the dispenser.

There is thus a desire for improved multi-roll sheet product dispensers and spindles for supporting rolls of sheet product with respect to a dispenser. In certain embodiments, such dispensers and spindles should be configured for use with coreless rolls of sheet product and should inhibit use of cored rolls of sheet product therewith, thereby ensuring reliable dispensing of sheet product and positive user experience. Additionally, in certain embodiments, such dispensers and spindles should inhibit users from making a new roll of sheet product accessible for dispensing until a currently accessible roll is completely or nearly completely depleted, thereby minimizing waste of sheet product.

Some embodiments of the present invention seek to provide a sheet product dispenser and corresponding components to provide a reliable user experience, while limiting the ability to install improper rolls of sheet product and/or prematurely enable dispensing of reserve rolls of sheet product.

In some embodiments, the multi-roll sheet product dispensers and spindles described herein may be configured for use with coreless rolls of sheet product and advantageously may inhibit use of cored rolls of sheet product therewith while also inhibiting users from making a new roll accessible for dispensing until a currently accessible roll is completely or nearly completely depleted. As described above, existing sheet product dispensers for use with coreless rolls of sheet product may allow cored rolls to be mounted thereto for dispensing. However, such unintended use of cored rolls may negatively impact the quality of dispensing due to undesirable interaction between the roll of sheet product and the spindle or other portions of the dispenser. As described herein, the spindles provided herein may cooperate with a door lock of the sheet product dispenser to allow use of coreless rolls of sheet product but inhibit use of cored rolls of sheet product with the dispenser. Upon complete or nearly complete depletion of a coreless roll of sheet product positioned thereon, the spindle may be moved from a first configuration to a second configuration to release the door lock and allow a door of the dispenser to be moved to make another roll accessible for dispensing. However, upon complete depletion of a cored roll of sheet product positioned on the spindle, the remaining core of the roll may inhibit the spindle from moving from the first configuration to the second configuration, thereby inhibiting movement of the door and access to the other roll. Existing multi-roll sheet product dispensers also may allow a user to access a new roll of sheet product by moving the housing or the spindles of the dispenser regardless of a degree of depletion of a currently accessible roll, which may result in significant waste of sheet product. In some embodiments, the spindles provided herein may cooperate with the door lock of the sheet product dispenser to ensure that all or nearly all of a currently accessible roll is dispensed before allowing a user to access another roll of sheet product. In particular, when a full or partially-depleted coreless roll of sheet product is positioned on the spindle, the remaining sheet product of the roll may inhibit the spindle from moving from the first configuration to the second configuration, thereby inhibiting movement of the door and access to another roll. In this manner, in some embodiments, the sheet product dispensers and spindles described herein may address one or more of the above-described problems associated with existing dispensers.

In an example embodiment, a sheet product dispenser is provided. The sheet product dispenser comprises a housing defining an interior space configured to receive a roll of sheet product therein. The sheet product dispenser comprises a mandrel positioned within the interior space and a spindle positioned over at least a portion of the mandrel and configured to support the roll of sheet product for rotation about the mandrel. The spindle comprises a base portion and a nose portion configured to translate relative to one another along a longitudinal axis of the mandrel. At least a portion of the spindle is configured to translate relative to the mandrel from a first configuration to a second configuration to cause a remainder of the roll of sheet product to deform.

In some embodiments, the base portion and the nose portion are spaced apart from one another by a first distance in the direction of the longitudinal axis when the spindle is in the first configuration. The base portion and the nose portion are spaced apart from one another by a second distance in the direction of the longitudinal axis when the spindle is in the second configuration, and wherein the second distance is less than the first distance.

In some embodiments, the base portion is configured to translate on the mandrel from a first position to a second position.

In some embodiments, the base portion comprises a body positioned over at least a portion of the mandrel and a flange extending radially outward from the body. In some embodiments, the nose portion comprises a body positioned over at least a portion of the mandrel and one or more fins extending radially outward from the body and configured to engage a central opening of the roll of sheet product.

In some embodiments, the mandrel comprises a shaft extending along a longitudinal axis of the mandrel and a sleeve positioned over at least a portion of the shaft. The spindle is configured to rotate and to translate relative to the sleeve.

In some embodiments, the sheet product dispenser further comprises a second mandrel positioned within the interior space and a second spindle positioned over at least a portion of the second mandrel and configured to support a second roll of sheet product for rotation about the second mandrel. At least a portion of the second spindle is configured to translate relative to the second mandrel from a first configuration to a second configuration to cause a remainder of the second roll of sheet product to deform. In some embodiments, the roll of sheet product comprises a first roll of sheet product. The spindle comprises a first spindle. The sheet product dispenser further comprises a dispensing opening defined in the housing and configured to allow sheet product to be dispensed therethrough. The sheet product dispenser further includes a door configured to move relative to the dispensing opening between a first position for dispensing sheet product from the first roll of sheet product and a second position for dispensing sheet product from the second roll of sheet product. The sheet product dispenser further includes a door lock positioned within the interior space and configured to engage the first spindle and the second spindle. In some embodiments, the door lock and the first spindle are configured to inhibit the door from moving from the first position to the second position when the first roll of sheet product is full or partially depleted. The door lock and the first spindle are configured to allow the door to move from the first position to the second position when the first roll of sheet product is completely or nearly completely depleted.

In some embodiments, the door lock is configured to translate the at least a portion of the first spindle from the first configuration to the second configuration when the door is moved from the first position to the second position.

In some embodiments, the door lock and the second spindle are configured to inhibit the door from moving from the second position to the first position when the second roll of sheet product is full or partially depleted. The door lock and the second spindle are configured to allow the door to move from the second position to the first position when the second roll of sheet product is completely or nearly completely depleted. In some embodiments, the door lock is configured to translate the at least a portion of the second spindle from the first configuration to the second configuration when the door is moved from the second position to the first position.

In another example embodiment, a spindle assembly for supporting a roll of sheet product with respect to a sheet product dispenser is provided. The spindle assembly comprises a base portion configured to be positioned over a mandrel of the sheet product dispenser and to support a first portion of the roll of sheet product. The base portion comprises a base body extending along a longitudinal axis of the mandrel and configured to be positioned at least partially within a central opening of the roll of sheet product. The base portion further includes a flange extending radially outward from the base body and configured to be positioned outside of the central opening of the roll of sheet product. The spindle assembly comprises a nose portion configured to be positioned over the mandrel and to support a second portion of the roll of sheet product. The nose portion comprises a nose body extending along the longitudinal axis and configured to be positioned at least partially within the central opening. The base portion and the nose portion are configured to translate relative to one another along the longitudinal axis of the mandrel from a first configuration to a second configuration to cause a remainder of the roll of sheet product to deform.

In some embodiments, the nose portion further comprises a fin extending radially outward from the nose body and configured to engage the central opening.

In yet another example embodiment, a sheet product dispenser is provided. The sheet product dispenser comprises a housing defining an interior space configured to receive a roll of sheet product therein. The sheet product dispenser comprises a mandrel positioned within the interior space. The sheet product dispenser comprises a spindle positioned over at least a portion of the mandrel and configured to support the roll of sheet product for rotation about the mandrel. The sheet product dispenser comprises a base member positioned over at least a portion of the mandrel and configured to support at least a portion of the roll of sheet product. The base member is configured to translate on the mandrel from a first configuration to a second configuration to cause a remainder of the roll of sheet product to deform. The base member is positioned in a spaced apart manner from the spindle when in the first configuration such as to define a first distance. The base member is positioned a second distance from the spindle when in the second configuration, and wherein the first distance is greater than the second distance.

In some embodiments, the spindle comprises a fin extending radially outward from a body and configured to engage a central opening of the roll of sheet product.

In yet another example embodiment, a method for supporting sheet product with respect to a sheet product dispenser is provided. The method comprises supporting a roll of sheet product with a spindle for rotation about a mandrel positioned within an interior space of a housing of the sheet product dispenser. The spindle comprises a base portion and a nose portion configured to translate relative to one another along a longitudinal axis of the mandrel. At least a portion of the spindle is configured to translate relative to the first mandrel between a first configuration and a second configuration. The method comprises inhibiting the spindle from moving from the first configuration to the second configuration when the roll of sheet product is full or partially depleted. The method comprises allowing sheet product to be dispensed from the roll of sheet product. The method further comprises allowing the at least a portion of the spindle to translate from the first configuration to the second configuration when the roll of sheet product is completely or nearly completely depleted.

In some embodiments, allowing the at least a portion of the spindle to translate from the first configuration to the second configuration comprises allowing the base portion to translate along the longitudinal axis of the mandrel from a first position to a second position.

In some embodiments, the method further comprises inhibiting a door of the dispenser from moving from a first position to a second position when the roll of sheet product is full or partially depleted. The method further includes allowing the door to move from the first position to the second position when the roll of sheet product is completely or nearly completely depleted.

In some embodiments, the method further comprises supporting a second roll of sheet product with a second spindle for rotation about a second mandrel positioned within the interior space. The door covers the second roll of sheet product when the door is in the first position.

These and other aspects and improvements of the present disclosure will become apparent to one of ordinary skill in the art upon review of the following detailed description when taken in conjunction with the several drawings and the appended claims.

BRIEF DESCRIPTION OF THE DRAWINGS

The detailed description is set forth with reference to the accompanying drawings illustrating examples of the disclosure, in which use of the same reference numerals indicates similar or identical items. Certain embodiments of the present disclosure may include elements, components, and/or configurations other than those illustrated in the drawings, and some of the elements, components, and/or configurations illustrated in the drawings may not be present in certain embodiments.

FIG. 1O is a perspective view of the sheet product dispenser of FIG. 1N, showing the housing in the closed configuration and the door in a second position.

DETAILED DESCRIPTION

Figure 1A:
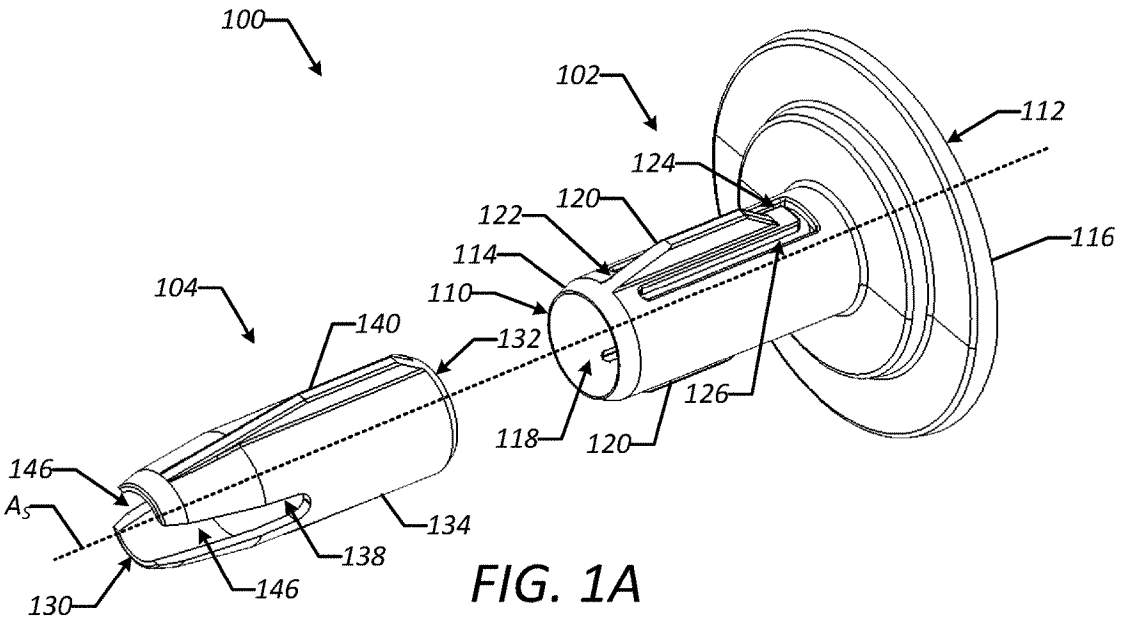
FIG. 1A is a perspective view of a spindle for a roll of sheet product in accordance with one or more embodiments of the disclosure.
Figure 1C:
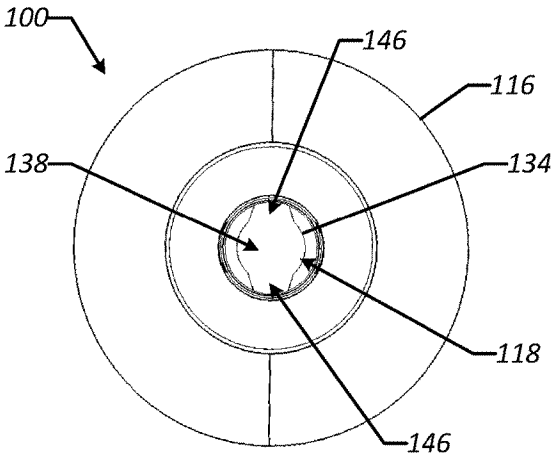
FIG. 1C is an opposite end view of the spindle of FIG. 1A.
Figure 1B:
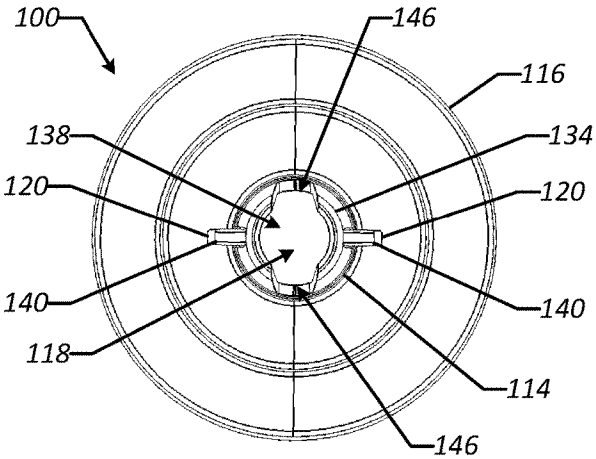
FIG. 1B is an end view of the spindle of FIG. 1A.
Figure 1D:
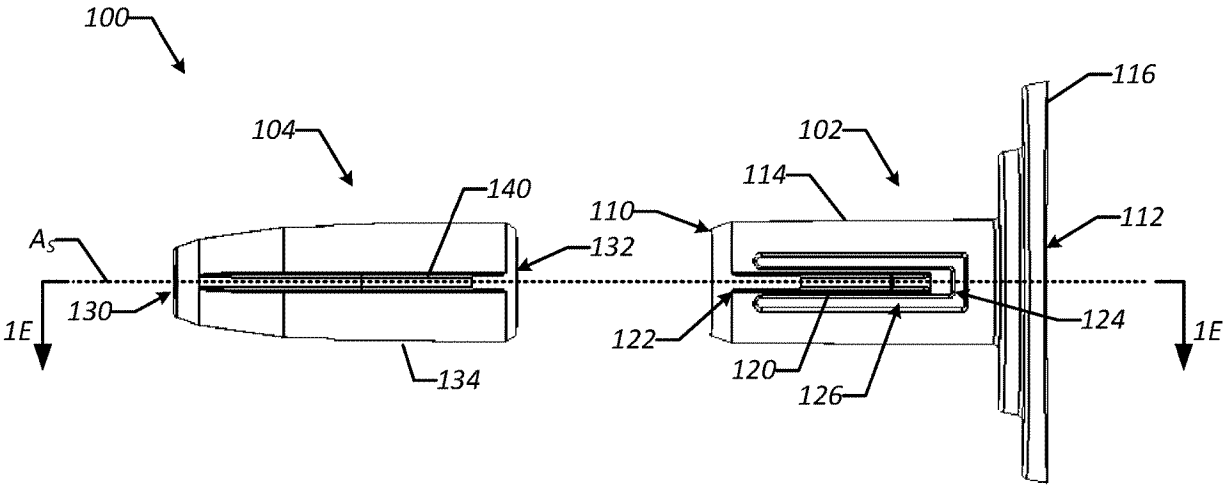
FIG. 1D is a front view of the spindle of FIG. 1A.
Figure 1E:
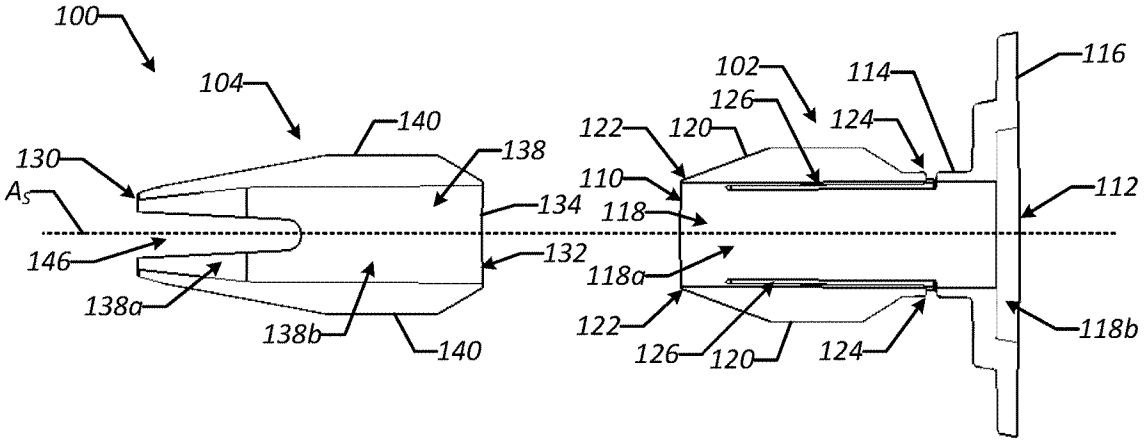
FIG. 1E is a cross-sectional top view of the spindle of FIG. 1A, taken along line 1E-1E of FIG. 1D.
Figure 1F:
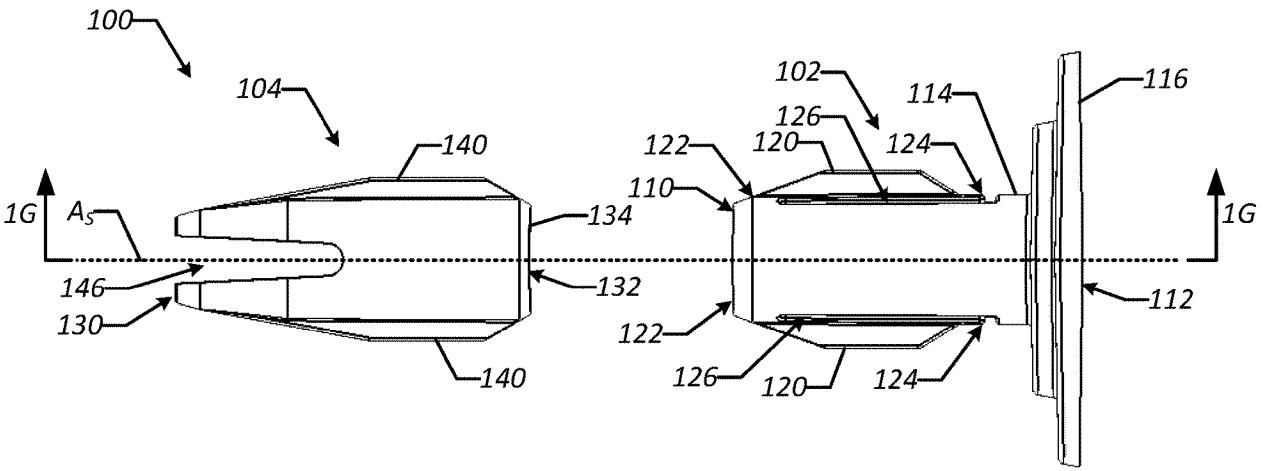
FIG. 1F is a top view of the spindle of FIG. 1A.
Figure 1G:
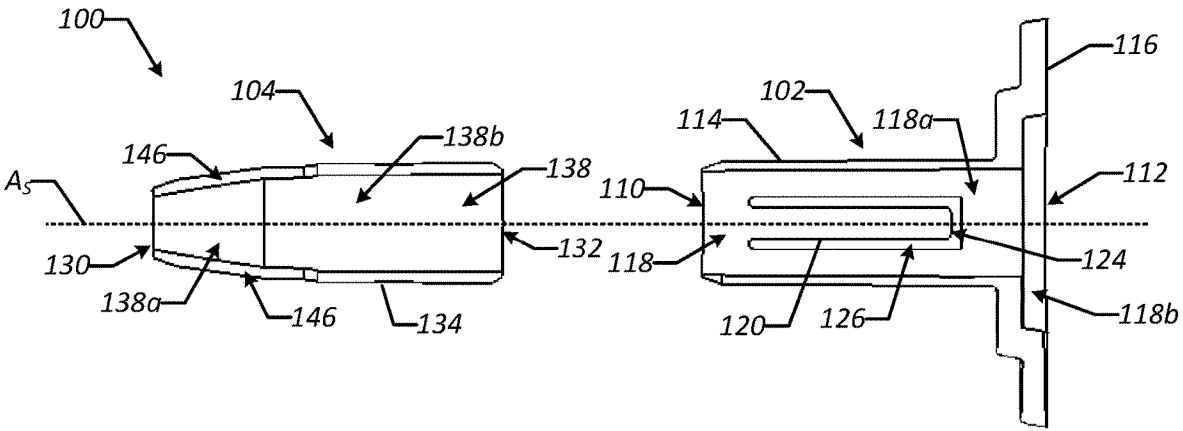
FIG. 1G is a cross-sectional front view of the spindle of FIG. 1A, taken along line 1G-1G of FIG. 1F.

The present disclosure includes non-limiting embodiments of sheet product dispensers and spindles for supporting a roll of sheet product with respect to a dispenser. The embodiments are described in detail herein to enable one of ordinary skill in the art to practice the dispensers, spindles, and related methods of their use, although it is to be understood that other embodiments may be utilized and that logical changes may be made without departing from the scope of the disclosure. Reference is made herein to the accompanying drawings illustrating some embodiments of the disclosure, in which use of the same reference numerals indicates similar or identical items. Throughout the disclosure, depending on the context, singular and plural terminology may be used interchangeably.

As used herein, the term "sheet product" refers to a product that is relatively thin in comparison to its length and width and exhibits a relatively flat, planar configuration, yet is flexible or bendable to permit folding, rolling, stacking, or the like. Example sheet products include towel, bath tissue, facial tissue, napkin, wipe, or other sheet-like products. Sheet products may be made from paper, cloth, non-woven, metallic, polymer or other materials, and in some cases may include multiple layers or plies. In some embodiments, the sheet product may be a continuous sheet that is severable or separable into individual sheets using, for example, a tear bar or cutting blade, while in other cases the sheet product may include predefined areas of weakness, such as lines of perforations, that extend along the width of the sheet product to define individual sheets and facilitate separation or tearing.

As used herein, the term "roll of sheet product" refers to a sheet product formed in a roll by winding layers of the sheet product around one another. Rolls of sheet product may have a generally circular cross-sectional shape, a generally oval cross-sectional shape, or other cross-sectional shapes according to various winding configurations of the layers of sheet product. Rolls of sheet product may be cored or coreless.

As used herein, the term "cored roll of sheet product" refers to a roll of sheet product that includes a core, such as a support tube, positioned therein. In this manner, the layers of the sheet product are wound around a core formed of paperboard or other material. A cored roll of sheet product includes a central opening extending therethrough along a longitudinal axis of the roll and defined by the core.

As used herein, the term "coreless roll of sheet product" refers to a roll of sheet product that does not include a core positioned therein. In this manner, the layers of the sheet product are not wound around a core formed of paperboard or other material. Instead, a coreless roll of sheet product includes a central opening extending therethrough along a longitudinal axis of the roll and defined by an inner layer of the sheet product itself.

The meanings of other terms used herein will be apparent to one of ordinary skill in the art or will become apparent to one of ordinary skill in the art upon review of the detailed description when taken in conjunction with the several drawings and the appended claims.

FIGS. 1A-1G and 1J-1M illustrate a spindle 100 (which also may be referred to as a "sheet product roll spindle") according to one or more embodiments of the disclosure. The spindle 100 is configured to support a roll of sheet product with respect to a sheet product dispenser, as described below. In particular, the spindle 100 may be configured to be partially inserted into a central opening of the roll of sheet product and to engage one or more mating support features of the sheet product dispenser such that the roll is able to rotate with respect to the dispenser for dispensing sheet product therefrom. The spindle 100 may be used as a part of the sheet product dispenser 180 described below or another type of sheet product dispenser having a different configuration. The spindle 100 may be configured for use with coreless rolls of sheet product. As described below, the spindle 100 may be configured to cooperate with other portions of the sheet product dispenser to inhibit use of cored rolls of sheet product therewith and also inhibit users from making a new roll accessible for dispensing from the dispenser until a currently accessible roll is completely or nearly completely depleted.

As shown in FIGS. 1A-1G, the spindle 100 may include a base portion 102 (which also may be referred to as a "base" or a "first portion") and a nose portion 104 (which also may be referred to as a "nose" or a "second portion") that are separate components from one another. Although described herein as a spindle or spindle assembly made up of two separate portion (e.g., a base portion 102 and a nose portion 104), in some embodiments, the nose portion 104 may form the "spindle" and the base portion may be considered a separate element (e.g., not a portion of the spindle or spindle assembly).

During use of the spindle 100, the base portion 102 may be positioned partially within the central opening of the coreless roll of sheet product and partially outside of the central opening, and the nose portion 104 may be positioned entirely or at least partially within the central opening of the coreless roll. As described below, during use of the spindle 100, the base portion 102 and the nose portion 104 may be movable relative to one another between a first configuration, as shown in FIGS. 1J-1L, and a second configuration, as shown in FIG. 1M. In particular, the base portion 102 and the nose portion 104 may be configured to translate relative to one another between the first configuration, in which the portions 102, 104 are positioned further away from one another, and the second configuration, in which the portions 102, 104 are positioned closer to one another.

The base portion 102 may be formed as an elongated member having a first end 110 (which also may be referred to as a "leading end") and a second end 112 (which also may be referred to as a "trailing end") positioned opposite one another in the direction of a longitudinal axis $A_s$ of the spindle 100. As shown, the base portion 102 may include a body 114 (which also may be referred to as a "base body") and a flange 116 (which also may be referred to as a "base flange") fixedly attached to the body 114. In certain embodiments, as shown, the body 114 and the flange 116 may be integrally formed with one another. The flange 116 may be positioned at or near the second end 112 of the base portion 102, and the body 114 may extend from the first end 110 of the base portion 102 to the flange 116. In certain embodiments, the body 114 may have a tubular shape extending axially along the longitudinal axis $A_S$ of the spindle 100 and a circular cross-sectional shape taken in the direction perpendicular to the longitudinal axis $A_S$, although other shapes may be used. In certain embodiments, the flange 116 may have a ring shape extending radially outward with respect to the longitudinal axis $A_S$ of the spindle 100 and a circular cross-sectional shape taken in the direction perpendicular to the longitudinal axis $A_S$, although other shapes may be used. The flange 116 may extend circumferentially along the entire outer circumference of the body 114, as shown, or may extend along only a portion of the outer circumference of the body 114. During use of the spindle 100, the body 114 may be positioned entirely or at least partially within the central opening of the coreless roll of sheet product, and the flange 116 may be positioned outside of the central opening of the roll. In this manner, the body 114 may support a respective end portion of the roll, and the flange 116 may abut or be positioned near the respective end of the roll and also may engage mating portions of the sheet product dispenser, as described below. In certain embodiments, the first end 110 of the base portion 102 may be tapered to facilitate insertion of the body 114 into the central opening of the roll. As shown, the base portion 102 may define an aperture 118 extending axially through the body 114 and the flange 116 from the first end 110 to the second end 112 thereof. In this manner, the base portion 102 may be mounted on a mandrel of the sheet product dispenser, with the mandrel extending through the aperture 118. In certain embodiments, the aperture 118 may include a first region 118*a* having a first diameter, and a second region 118*b* having a second diameter that is larger than the first diameter. In certain embodiments, the diameter of the aperture 118 may be constant along the first region 118*a* in the direction of the longitudinal axis $A_S$. In other embodiments, the diameter of the aperture 118 may vary along the first region 118*a* in the direction of the longitudinal axis $A_S$. For example, the aperture 118 may be tapered along the first region 118*a* in the direction of the longitudinal axis $A_S$, such that the diameter increases from the first end 110 toward the second end 112.

As shown, the base portion 102 may include one or more fins 120 attached to the body 114 and extending radially outward therefrom. In certain embodiments, the base portion 102 may include a pair of the fins 120 circumferentially spaced apart from one another, for example, by 180 degrees, although any number of the fins 120 and alternative spacings of the fins 120 may be used. Each fin 120 may be formed as an elongated member extending in the direction of the longitudinal axis $A_S$. In certain embodiments, as shown, each fin 120 may have a trapezoidal cross-sectional shape taken in the direction parallel to the direction of the longitudinal axis $A_S$, although other shapes may be used. Each fin 120 may have a fixed end 122 that is fixedly attached to the body 114 and an opposite free end 124 that is able to move with respect to the body 114. In particular, each fin 120 may be elastically deflected or deformed inward toward the longitudinal axis $A_S$, such that the free end 124 of the fin 120 is positioned at least partially within the aperture 118. In this manner, the fins 120 may frictionally engage the mandrel of the sheet product dispenser. As shown, each fin 120 may be positioned at least partially within a mating slot 126 defined in the body 114 and in communication with the aperture 118. During use of the spindle 100, the fins 120 may be positioned entirely or at least partially within the central opening of the coreless roll of sheet product. In this manner, respective radially outer surfaces of the fins 120 may frictionally engage the inner layer of sheet product of the roll, such that the base portion 102 and the roll rotate with one another about the mandrel of the dispenser. In certain embodiments, the central opening of the coreless roll may be sized such that, upon insertion of the body 114 therein, portions of the fins 120 are deflected inward toward the longitudinal axis $A_S$ and into the aperture 118. In this manner, respective radially inner surfaces of the fins 120 may frictionally engage the mandrel of the dispenser. Such frictional engagement may provide a degree of resistance opposing rotation of the base portion 102 and the roll relative to the mandrel. In this manner, the interaction between the base portion 102 and the mandrel may control rotation of the roll during dispensing. Although described and shown in the depicted embodiment as frictionally engaging the central opening of the corresponding roll of sheet product, in some embodiments, the base portion 102 may not be designed to frictionally engage the roll of sheet product (although it may actually engage the central opening). Along these lines, the base portion 102, in some embodiments, may not include fins or other features designed to frictionally engage the central opening of the roll of sheet product (see e.g., the base portion 402 with respect to FIGS. 3A-3K).

The nose portion 104 may be formed as an elongated member having a first end 130 (which also may be referred to as a "leading end") and a second end 132 (which also may be referred to as a "trailing end") positioned opposite one another in the direction of the longitudinal axis $A_S$ of the spindle 100. As shown, the nose portion 104 may include a body 134 (which also may be referred to as a "nose body") extending from the first end 130 to the second end 132 thereof. In certain embodiments, the body 134 may have a tubular shape extending axially along the longitudinal axis $A_S$ of the spindle 100 and a circular cross-sectional shape taken in the direction perpendicular to the longitudinal axis $A_S$, although other shapes may be used. During use of the spindle 100, the body 134 may be positioned entirely or at least partially within the central opening of the coreless roll of sheet product, such that the body 134 supports a respective portion of the roll. In certain embodiments, the first end 130 of the nose portion 104 may be tapered to facilitate insertion of the body 134 into the central opening of the roll. As shown, the nose portion 104 may define an aperture 138 extending axially through the body 134 from the first end 130 to the second end 132 thereof. In this manner, the nose portion 104 may be mounted on the mandrel of the dispenser, with the mandrel extending through the aperture 138. In certain embodiments, the aperture 138 may include a first region 138*a* having a first diameter, and a second region 138*b* having a second diameter that is larger than the first diameter. In certain embodiments, the diameter of the aperture 138 may be constant along the first region 138*a* and/or the second region 138*b* in the direction of the longitudinal axis $A_S$. In other embodiments, as shown, the diameter of the aperture 138 may vary along the first region 138*a* and/or the second region 138*b* in the direction of the longitudinal axis $A_S$. For example, the first region 138*a* and the second region 138*b* each may be tapered in the direction of the longitudinal axis $A_S$, such that the diameter increases along each region 138*a*, 138*b* in the direction from the first end 130 toward the second end 132.

As shown, the nose portion 104 may include one or more fins 140 attached to the body 134 and extending radially outward therefrom. In certain embodiments, the nose portion 104 may include a pair of the fins 140 circumferentially spaced apart from one another, for example, by 180 degrees, although any number of the fins 140 and alternative spacings of the fins 140 may be used. Each fin 140 may be formed as an elongated member extending in the direction of the longitudinal axis $A_S$. In certain embodiments, as shown, each fin 140 may have a trapezoidal cross-sectional shape taken in the direction parallel to the direction of the longitudinal axis $A_S$, although other shapes may be used. In certain embodiments, each fin 140 may extend from the first end 130 to the second end 132 of the nose portion 104, although other positions may be used. As shown, one or more slots 146 may be defined in the body 134. In certain embodiments, a pair of the slots 146 may be circumferentially spaced apart from one another, for example, by 180 degrees, although any number of the slots 146 and alternative spacings of the slots 146 may be used. As shown, one of the slots 146 may be positioned circumferentially between the fins 140 along one side of the body 134, and the other slot 146 may be positioned circumferentially between the fins 140 along an opposite side of the body 134. Each slot 146 may extend from the first end 130 toward the second end 132 of the nose portion 104 and may terminate at a location spaced apart from the second end 132. In certain embodiments, each slot 146 may terminate at a location approximately halfway between the first end 130 and the second end 132, although other lengths of the slots 146 may be used. As shown, the slots 146 may be configured to allow respective portions of the body 134 and the fins 140 near the first end 130 to be elastically deflected or deformed inward toward the longitudinal axis $A_S$. In this manner, the body 134 may frictionally engage the mandrel of the sheet product dispenser. During use of the spindle 100, the fins 140 may be positioned entirely or at least partially within the central opening of the coreless roll of sheet product. In this manner, respective radially outer surfaces of the fins 140 may frictionally engage the inner layer of sheet product of the roll, such that the nose portion 104 and the roll rotate with one another about the mandrel of the dispenser. In certain embodiments, the central opening of the coreless roll may be sized such that, upon insertion of the body 134 therein, portions of the body 134 and the fins 140 are deflected inward toward the longitudinal axis $A_S$. In this manner, respective radially inner surfaces of the body 134 may frictionally engage the mandrel of the dispenser. Such frictional engagement may provide a degree of resistance opposing rotation of the nose portion 104 and the roll relative to the mandrel. In this manner, the interaction between the nose portion 104 and the mandrel may control rotation of the roll during dispensing.

In certain embodiments, the spindle 100 may be formed of a plastic material, although other materials, such as composites or metals may be used in other embodiments. In certain embodiments, the base portion 102 and the nose portion 104 may be formed of the same material. In other embodiments, the base portion 102 and the nose portion 104 may be formed of different materials.

Figure 1H:
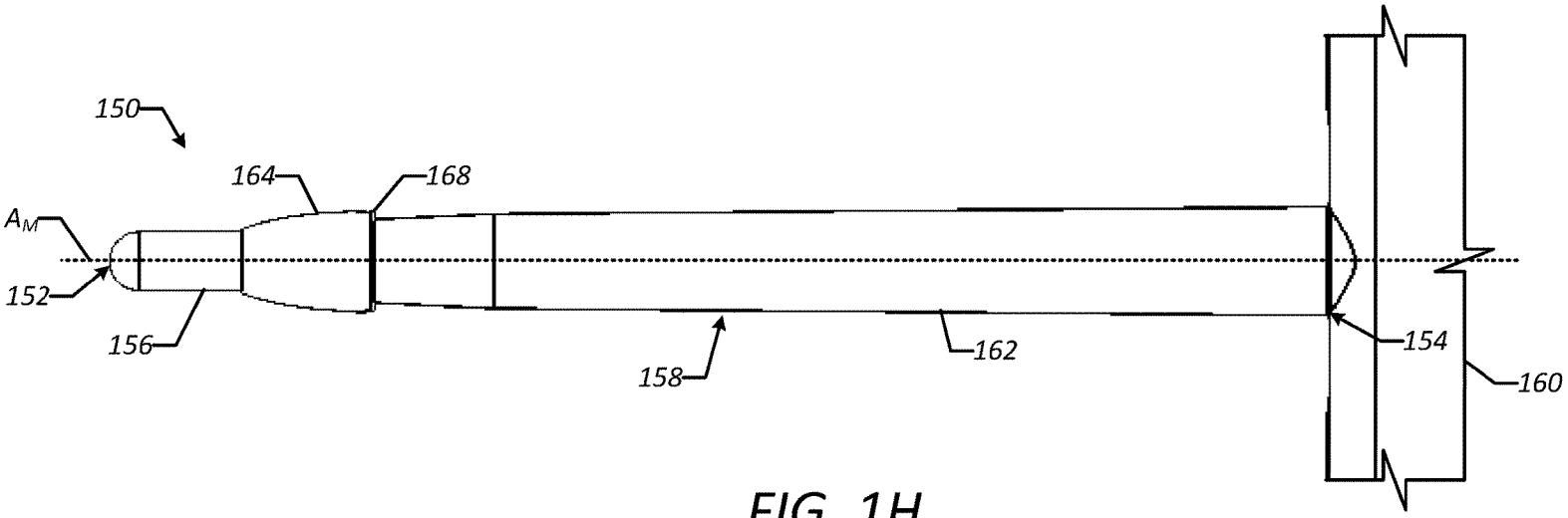
FIG. 1H is a front view of a mandrel of a sheet product dispenser in accordance with one or more embodiments of the disclosure.
Figure 1I:
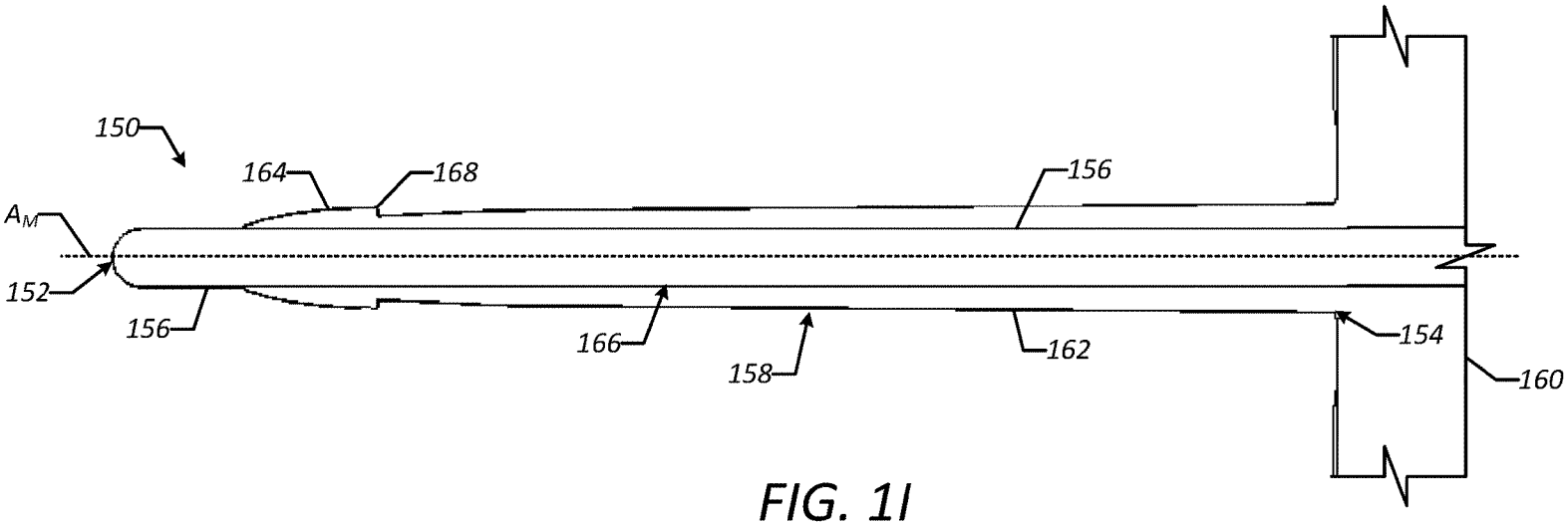
FIG. 1I is a cross-sectional front view of the mandrel of FIG. 1H.
Figure 1J:
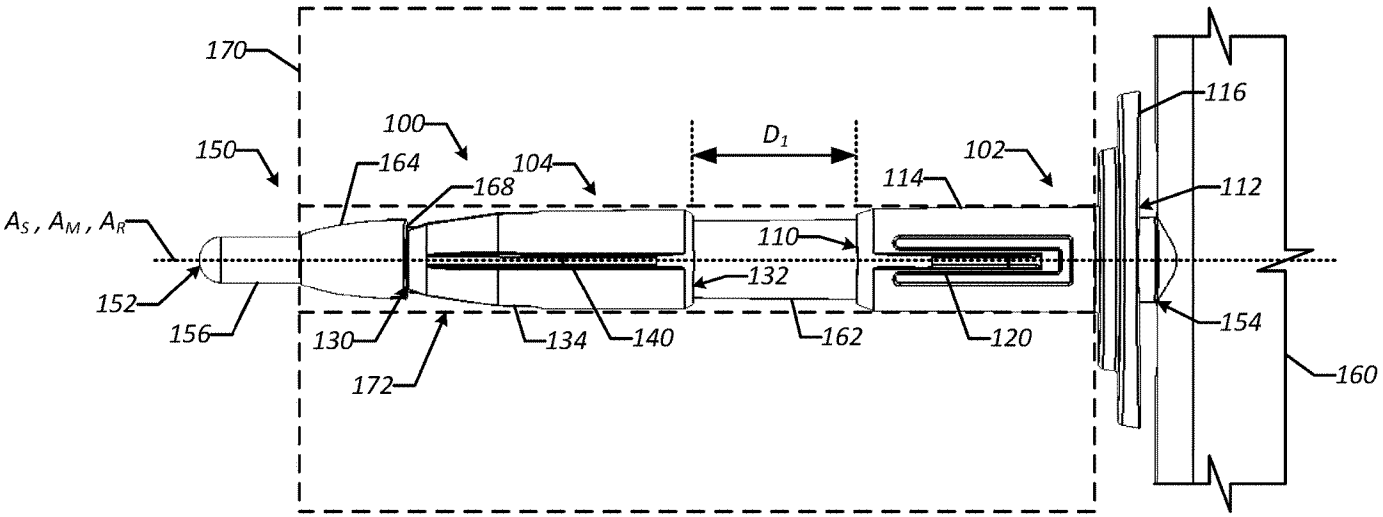
FIG. 1J is a front view of the spindle of FIG. 1A mounted to the mandrel of FIG. 1H, showing the spindle in a first configuration and a roll of sheet product positioned thereon.
Figure 1K:
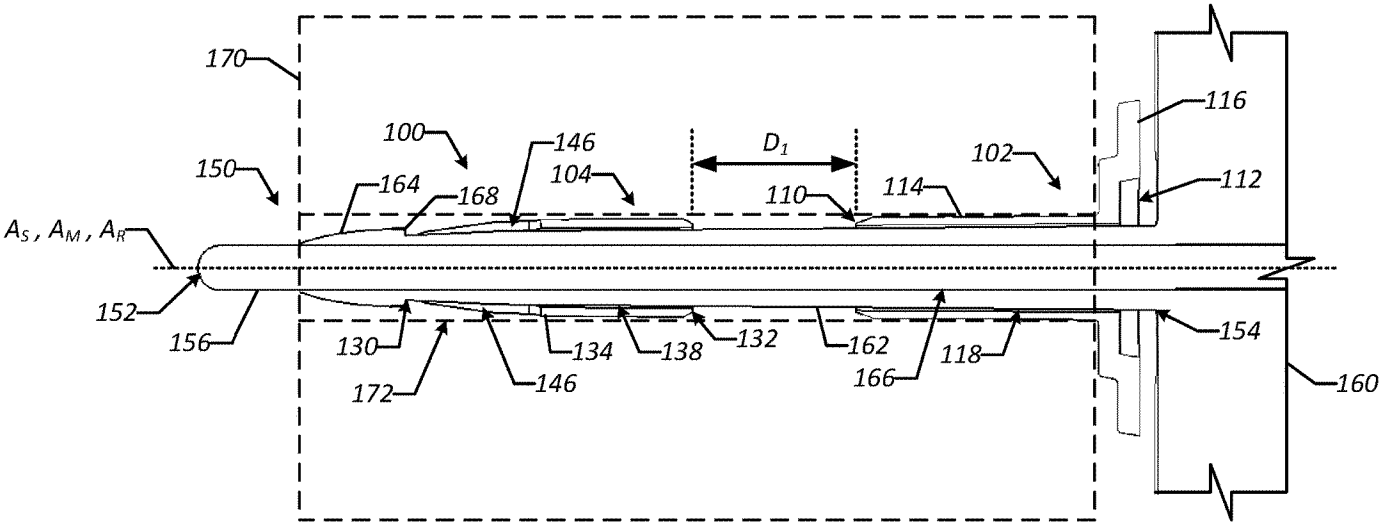
FIG. 1K is a cross-sectional front view of the spindle of FIG. 1A mounted to the mandrel of FIG. 1H, showing the spindle in the first configuration and the roll of sheet product positioned thereon.
Figure 1L:
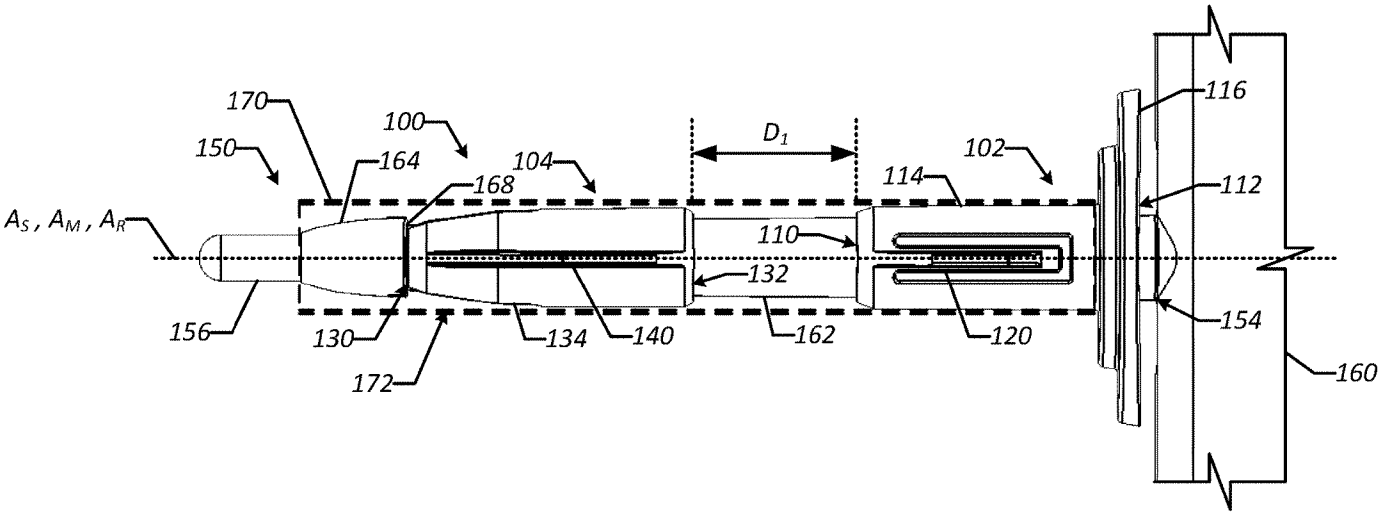
FIG. 1L is a front view of the spindle of FIG. 1A mounted to the mandrel of FIG. 1H, showing the spindle in the first configuration and a remainder of the roll of sheet product positioned thereon following dispensing of the sheet product.
Figure 1M:
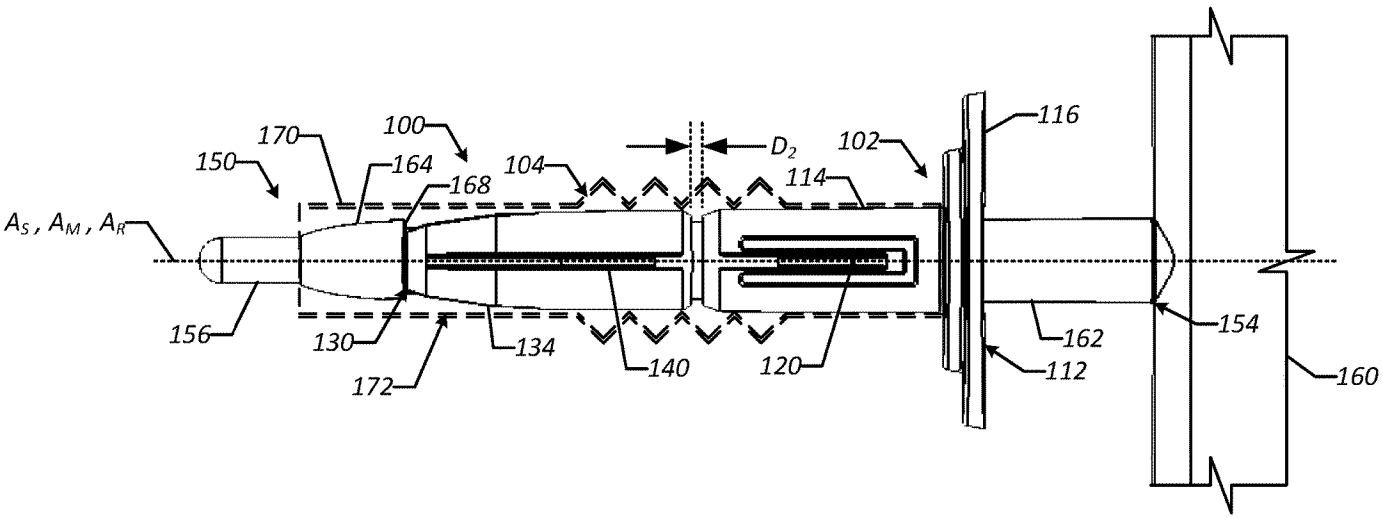
FIG. 1M is a front view of the spindle of FIG. 1A mounted to the mandrel of FIG. 1H, showing the spindle in a second configuration and the remainder of the roll of sheet product in a crushed state.

FIGS. 1H and 1I illustrate a mandrel 150 of a sheet product dispenser. As described below, the spindle 100 may be mounted to the mandrel 150 for supporting a roll of sheet product thereon. The mandrel 150 may have a first end 152 (which also may be referred to as a "free end") and a second end 154 (which also may be referred to as a "fixed end") positioned opposite one another in the direction of a longitudinal axis $A_M$ of the mandrel 150. In certain embodiments, as shown, the mandrel 150 may include a shaft 156 (which also may be referred to as a "mandrel shaft") and a sleeve 158 (which also may be referred to as a "mandrel sleeve") positioned over at least a portion of the shaft 156. In other embodiments, the mandrel 150 may be formed as a single component having a solid or tubular construction.

The sleeve 158 may be formed as an elongated, tubular member extending from the second end 154 toward the first end 152 of the mandrel 150, with the second end 154 being attached to a support 160 of the sheet product dispenser. In certain embodiments, as shown, the sleeve 158 may be integrally formed with the support 160. As shown, the sleeve 158 may include a body 162 (which also may be referred to as a "sleeve body") extending from the second end 154 toward the first end 152, a nose 164 (which also may be referred to as a "sleeve nose") positioned at the free end of the sleeve 158, and an aperture 166 extending through the body 162 and the nose 164 in the direction of the longitudinal axis $A_M$ of the mandrel 150. In certain embodiments, the body 162 may have a circular cross-sectional shape taken in the direction perpendicular to the longitudinal axis $A_M$, and the nose 164 also may have a circular cross-sectional shape taken in the direction perpendicular to the longitudinal axis $A_M$, although other shapes may be used. In certain embodiments, the outer diameter of the body 162 may be tapered, with the outer diameter increasing in the direction from the first end 152 toward the second end 154, and the outer diameter of the nose 164 may be tapered, with the outer diameter increasing in the direction from the first end 152 toward the second end 154. In certain embodiments, the sleeve 158 may include a lip 168 positioned at the interface of the body 162 and the nose 164 and defined by the nose 164 having a larger diameter than the body 162 at the interface thereof. The aperture 166 may have a diameter that is constant along the length of the sleeve 158 in the direction of the longitudinal axis $A_M$.

The shaft 156 may be formed as an elongated, solid member extending from the second end 154 to the first end 152 of the mandrel 150. In certain embodiments, as shown, the shaft 156 may extend through the support 160 of the sheet product dispenser. As shown, the shaft 156 may be positioned at least partially within and extend through the aperture 166 of the sleeve 158, such that the shaft 156 provides structural support for the sleeve 158. In certain embodiments, as shown, the shaft 156 may have a cylindrical shape extending in the direction of the longitudinal axis $A_M$ and a circular cross-sectional shape taken in the direction perpendicular to the longitudinal axis $A_M$. The shaft 156 may have an outer diameter that is constant along the length thereof in the direction of the longitudinal axis $A_M$, although the free end of the shaft 156 may be rounded, as shown.

FIGS. 1J-1M illustrate the spindle 100 mounted to the mandrel 150, with a roll 170 of sheet product (shown via dashed lines) positioned on the spindle 100 for dispensing of the sheet product. The roll 170 of sheet product may be a coreless roll including a central opening 172 defined by an inner layer of the sheet product. In certain embodiments, as shown, the roll 170 may have a generally cylindrical shape extending along a longitudinal axis $A_R$ of the roll 170 and a generally circular cross-sectional shape taken in the direction perpendicular to the longitudinal axis $A_R$. The central opening 172 also may have a generally cylindrical shape extending along the longitudinal axis $A_R$ and a generally circular cross-sectional shape taken in the direction perpendicular to the longitudinal axis $A_R$. Alternatively, the central opening 172 may have a non-circular or irregular cross-sectional shape taken in the direction perpendicular to the longitudinal axis $A_R$. In certain embodiments, the central opening 172 may have a diameter within a range of between ½ inch and ¾ inches, or approximately ⅝ inches. As shown, the spindle 100 may support the roll 170 for rotation about the longitudinal axis $A_M$ of the mandrel 150. The spindle 100 may be mounted to the mandrel 150 such that the longitudinal axis $A_S$ of the spindle 100, the longitudinal axis $A_M$ of the mandrel 150, and the longitudinal axis $A_R$ of the roll 170 are coaxial with one another.

As shown in FIGS. 1J and 1K, the spindle 100 may be mounted to the mandrel 150 with the base portion 102 and the nose portion 104 positioned over the sleeve 158. In other words, the sleeve 158 may extend through the aperture 118 of the base portion and the aperture 138 of the nose portion 104. As shown, the spindle 100 may be in the first configuration, with the base portion 102 and the nose portion 104 spaced apart from one another by a first distance $D_1$ in the direction of the longitudinal axis $A_M$. In certain embodiments, as shown, the flange 116 of the base portion 102 may be positioned near but axially spaced apart from the support 160 and the second end 154 of the mandrel 150 when the spindle 100 is in the first configuration. In other embodiments, the flange 116 may abut the support 160 when the spindle 100 is in the first configuration. In certain embodiments, as shown, the body 134 of the nose portion 104 may abut the lip 168 of the sleeve 158 when the spindle 100 is in the first configuration. In other embodiments, the body 134 may be positioned near but spaced apart from the lip 168 when the spindle 100 is in the first configuration.

When the roll 170 of sheet product is positioned over the spindle 100 and the mandrel 150 and the spindle 100 is in the first configuration, the body 114 of the base portion 102 may be positioned entirely or at least partially within the central opening 172 of the roll 170, and the flange 116 may be positioned outside of the central opening 172. In certain embodiments, as shown, the flange 116 may abut the respective end of the roll 170. When the roll 170 of sheet product is positioned over the spindle 100 and the mandrel 150 and the spindle 100 is in the first configuration, the nose portion 104 may be positioned entirely within the central opening 172 and spaced apart from the opposite end of the roll 170, as shown. When the roll 170 of sheet product is positioned over the spindle 100, frictional engagement between the fins 120 of the base portion 102 and the central aperture 172 may cause the fins 120 to be elastically deflected inward toward the longitudinal axis $A_M$ and into the aperture 118. As a result, the fins 120 may frictionally engage the sleeve 158, thereby providing a resistance to rotation of the spindle 100 and the roll 170 relative to the sleeve 158 and the overall mandrel 150. In a similar manner, when the roll 170 of sheet product is positioned over the spindle 100, frictional engagement between the fins 140 of the nose portion 104 and the central aperture 172 may cause the body 134 to be elastically deflected inward toward the longitudinal axis $A_M$ about the slots 146. As a result, the body 134 may frictionally engage the sleeve 158, thereby providing a resistance to rotation of the spindle 100 and the roll 170 relative to the sleeve 158 and the overall mandrel 150. In certain embodiments, the free end of the sleeve 158 may be aligned with the opposite end of the roll 170. In other embodiments, the free end of the sleeve 158 may be positioned within or outside of the central opening 172. In certain embodiments, the free end of the shaft 156 may be positioned outside of the central opening 172.

Sheet product may be dispensed from the roll 170 by a user grasping and pulling a tail end of the roll 170, thereby causing the spindle 100 and the roll 170 to rotate relative to the mandrel 150 about the longitudinal axis $A_M$. As described above, rotation of the spindle 100 and the roll 170 may be controlled by the frictional engagement between the spindle 100 and the sleeve 158. When the roll 170 is new (i.e., prior to dispensing of sheet product therefrom) or a substantial amount of the roll 170 remains, the spindle 100 may be inhibited from moving from the first configuration toward the second configuration. In other words, when at least a substantial amount of the roll 170 remains, the base portion 102 and the nose portion 104 may be inhibited from axially translating toward one another. In particular, the base portion 102 and the nose portion 104 may be inhibited from axially translating toward one another due to one or more or all of: (i) the column strength of the remaining portion of the roll 170 in the direction of the longitudinal axis $A_R$ thereof, (ii) the frictional engagement between the base portion 102 and/or the nose portion 104 and the roll 170, and (iii) the frictional engagement between the base portion 102 and/or the nose portion 104 and the sleeve 158. In certain embodiments, the spindle 100 may be deemed to be "inhibited" from moving from the first configuration toward the second configuration when an axial force required to move the spindle 100 from the first configuration to the second configuration is at least 10 pounds-force, at least 20 pounds-force, at least 30 pounds-force, or at least 40 pounds-force. In certain embodiments, the spindle 100 may be inhibited from moving from the first configuration toward the second configuration when at least 10%, at least 5%, or at least 1% of the roll 170 remains on the spindle 100.

In certain instances, the entire roll 170 may be dispensed from the sheet product dispenser, such that no sheet product remains positioned on the spindle 100. In other instances, a limited amount of sheet product of the roll 170 may remain positioned on the spindle 100, as shown in FIG. 1L. This "tube" or "cigar" of remaining sheet product of the roll 170 may difficult for a user to access or easily dispense. When such a limited amount of sheet product remains, the spindle 100 may be able to move from the first configuration to the second configuration, as shown in FIG. 1M. In particular, the base portion 102 may be axially translated toward the nose portion 104, as shown, or the nose portion 104 may be axially translated toward the base portion 102. In certain embodiments, such movement of the spindle 100 may crush or otherwise deform the remainder of the roll 170, as shown. In this manner, the interaction between the spindle 100, the mandrel 150, and the coreless roll 170 may inhibit users from discarding the roll 170 until the roll 170 is completely or nearly completely depleted. In instances in which a cored roll is used with the spindle 100 and the roll is completely or nearly completely depleted, the paperboard core remaining on the spindle 100 may prevent the spindle 100 from moving from the first configuration to the second configuration due to at least the column strength of the paperboard core in the direction of the longitudinal axis thereof. For example, in some embodiments, the components of the sheet product dispenser that enable movement of the door when only a "tube" or "cigar" of a coreless sheet product roll remains may be designed to still prevent (or discourage) movement of the door when only the core of a cored sheet product roll remains. To explain, the tolerances of the components may be so designed that the force produced by a user to move the door is sufficient or easy to enable movement when only a "tube" or a "cigar" of a coreless sheet product roll is present, but insufficient or difficult to move the door when a core from a cored sheet product roll is present. For example, the components of the dispenser may be designed such that greater than 15 lbs. of force would be required to move the door when a core from a cored sheet product roll is present, but application of less than 15 lbs. of force by a user would still move the door when a "tube" or "cigar" of a coreless sheet product roll is present. In this regard, the maintainer will be discouraged from using improper cored sheet product.

Figure 1N:
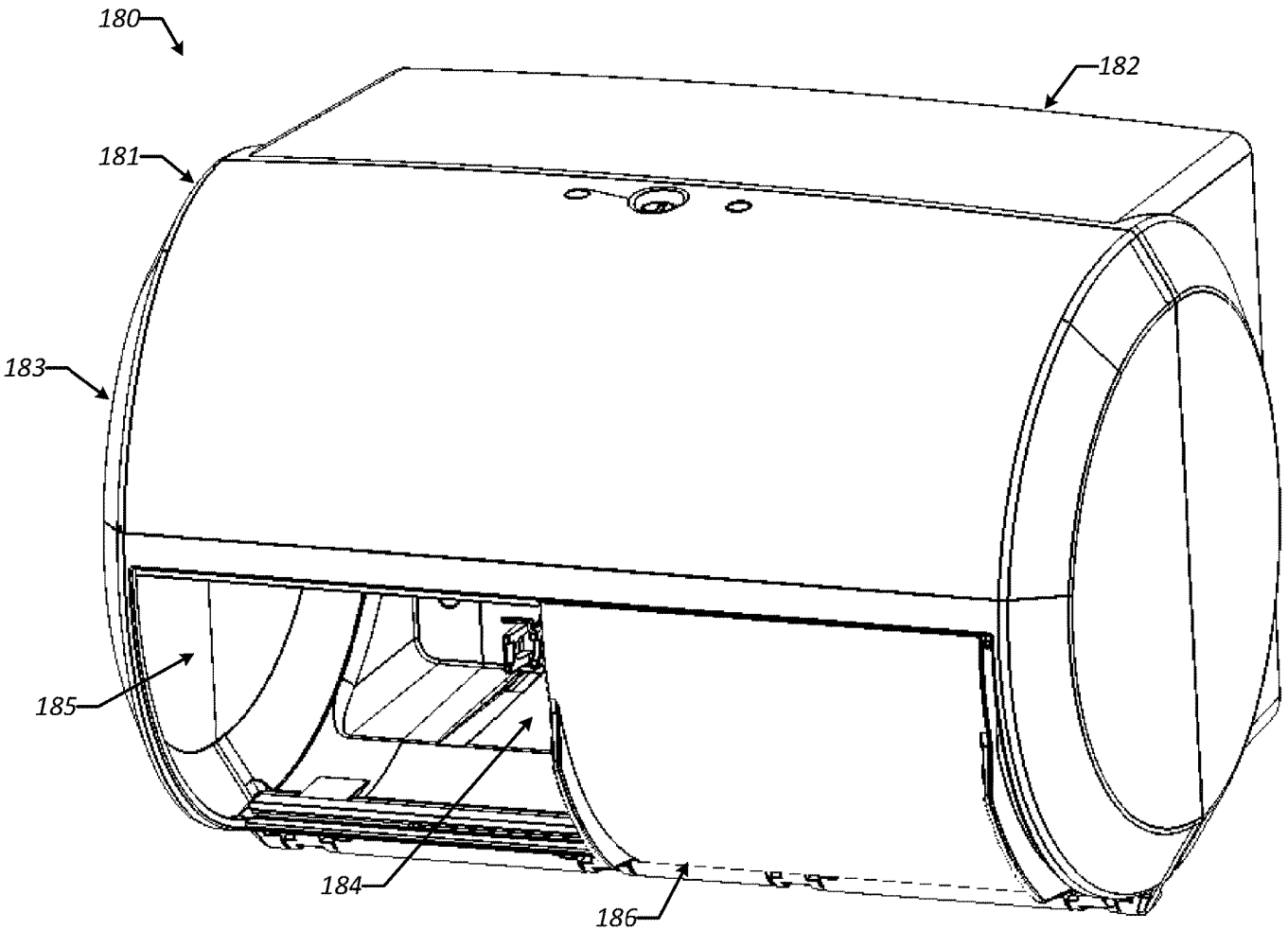
FIG. 1N is a perspective view of a sheet product dispenser that includes a pair of the spindles of FIG. 1A in accordance with one or more embodiments of the disclosure, showing a housing of the sheet product dispenser in a closed configuration and a door of the housing in a first position.
Figure 10:
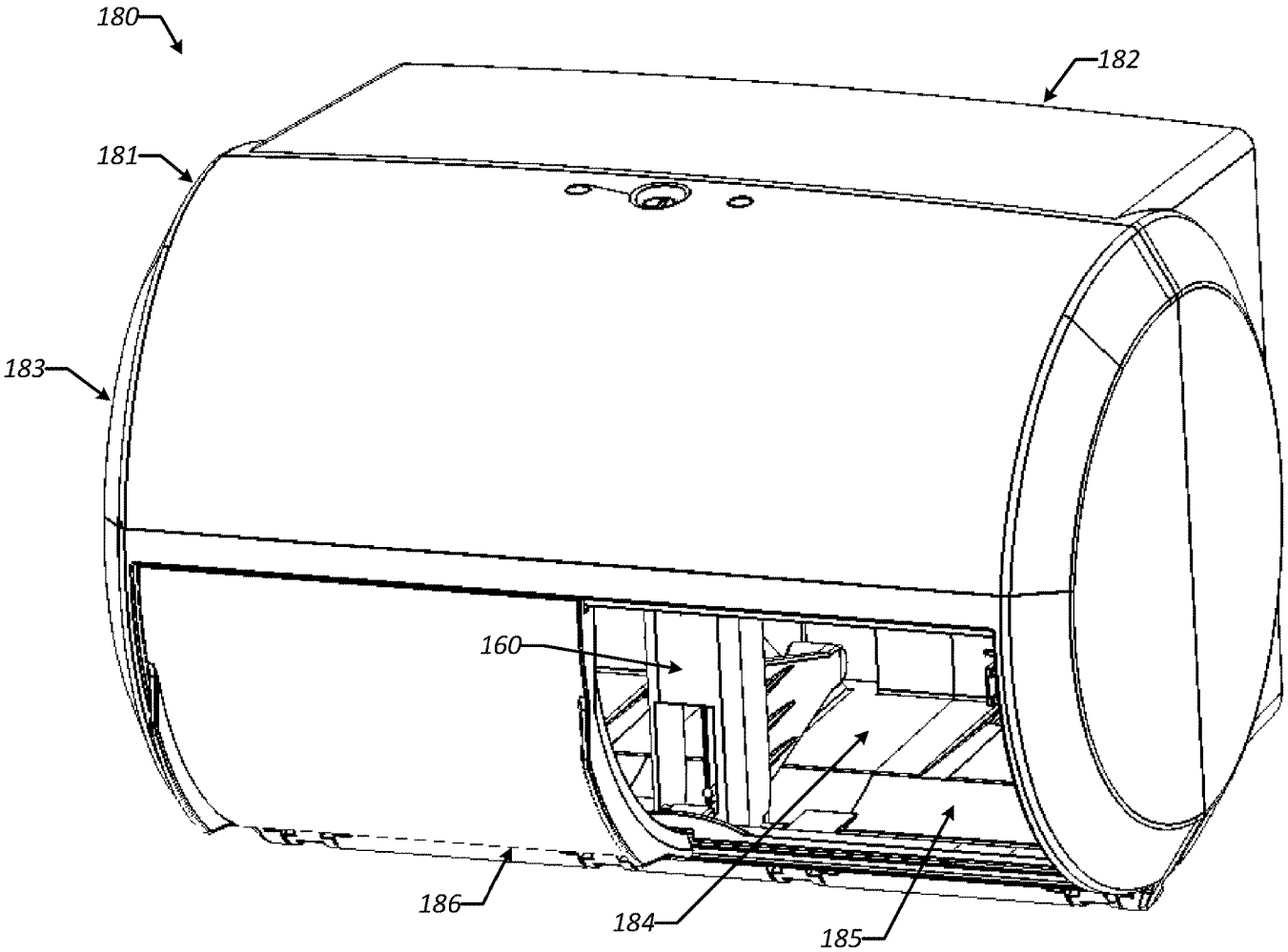
Figure 1P:
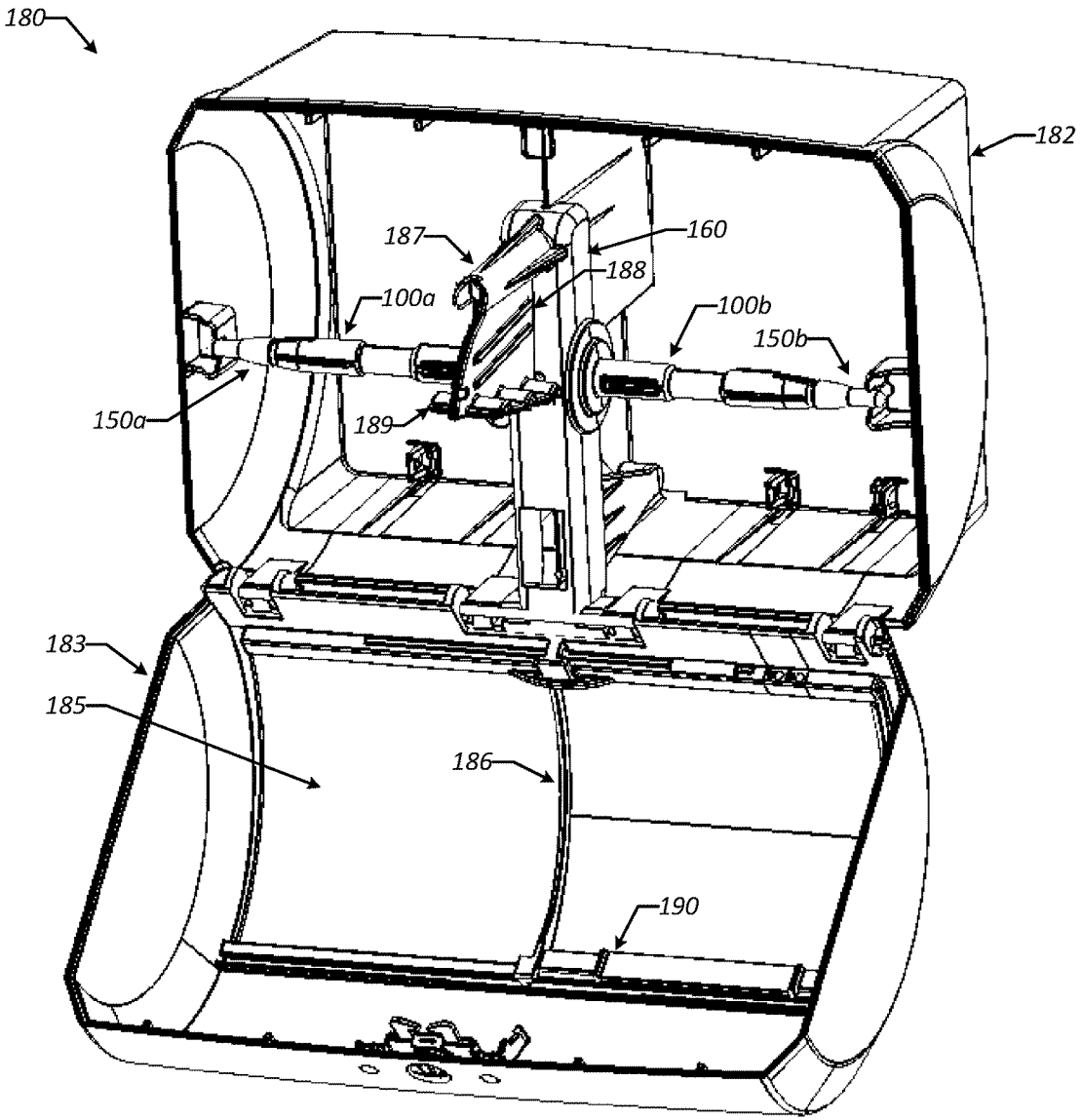
FIG. 1P is a perspective view of the sheet product dispenser of FIG. 1N, showing the housing in an open configuration and the door in the first position.

In certain embodiments, a multi-roll sheet product dispenser may include a plurality of spindles 100 for supporting a plurality of rolls 170 of sheet product relative to the dispenser. For example, FIGS. 1N-1U illustrate a sheet product dispenser 180 (which also may be referred to as a "multi-roll sheet product dispenser" or simply a "dispenser") according to one or more embodiments of the disclosure. As shown, the dispenser 180 may include a pair of spindles 100 for supporting a pair of rolls 170. Although the illustrated embodiment includes two spindles 100 arranged in a side-by-side configuration, other embodiments of the dispenser 180 may include three, four, five, or more spindles 100 arranged in a stacked configuration, a carousel configuration, or other manner. The dispenser 180 may include a housing 181 configured to receive the rolls 170 entirely or at least partially therein. As shown, the housing 181 may include a first housing portion 182 (which also may be referred to as a "back portion" or a "base portion") configured to attach to a wall or other support structure for mounting the dispenser 180 thereto. The housing 181 also may include a second housing portion 183 (which also may be referred to as a "front portion" or a "cover portion") movably attached to the first housing portion 182 and configured to move between a closed position for dispensing sheet product, as shown in FIGS. 1N and 1O, and an open position for loading one or more rolls 170, as shown in FIG. 1P. In certain embodiments, as shown, the second housing portion 183 may be configured to pivot relative to the first housing portion 182 to move the housing 181 between the closed configuration and the open configuration.

When the second housing portion 183 is in the closed configuration, the housing 181 may define an interior space 184 configured to receive the rolls 170 at least partially therein. In particular, a first roll 170*a* may be positioned on a first spindle 100*a* within a first portion of the interior space 184, and a second roll 170*b* may be positioned on a second spindle 100*b* within a second portion of the interior space 184. As shown, the first spindle 100*a* may be mounted on a first mandrel 150*a* extending from a support 160, and the second spindle 100*b* may be mounted on a second mandrel 150*b* extending from the support 160. The spindles 100*a*, 100*b*, the mandrels 150*a*, 150*b*, and the support 160 may be configured in the manner described above. In certain embodiments, the support 160 may be configured to move, such as by pivoting, relative to the first housing portion 182 between a first position for dispensing sheet product, as shown in FIGS. 1O and 1P, and a second position for loading one or more rolls 170 onto the spindles 100*a*, 100*b*. As shown, the second housing portion 183 may include a dispenser opening 185 defined therein, and a door 186 movably positioned within the dispenser opening 185. For example, the door 186 may be slidably positioned within the dispenser opening 185 and configured to slide between a first position in which the door 186 covers the second portion of the interior space 184 and the second roll 170*b* (if present) positioned therein, as shown in FIG. 1N, and a second position in which the door 186 covers the first portion of the interior space 184 and the first roll 170*a* (if present) positioned therein, as shown in FIG. 1O. In this manner, a user may access and dispense sheet product from the first roll 170*a* when the door 186 is in the first position, and the user may access and dispense sheet product from the second roll 170*b* when the door 186 is in the second position. In particular, the user may grasp and pull a tail portion of the respective roll 170*a*, 170*b* extending through the open portion of the dispensing opening 185 (i.e., the portion that is not blocked by the door 186) to dispense sheet product.

As shown, the dispenser 180 may include a door lock 187 (which also may be referred to simply as a "lock") positioned within the housing 181 and configured to control movement of the door 186 between the first position and the second position. In particular, the door lock 187 may engage and cooperate with the spindles 100*a*, 100*b* and the door 186 to allow or prevent movement of the door 186 from the first position to the second position or from the second position to the first position based at least in part on an amount of sheet product positioned on one of the spindles 100*a*, 100*b*, as described below. The door lock 187 may be movably positioned within the housing 181. In certain embodiments, as shown, the door lock 187 may be movably, such as pivotally, attached to the support 160. In certain embodiments, the door lock 187 may include an arm 188 (which also may be referred to as a "first lock portion") and a base 189 (which also may be referred to as a "second lock portion") attached to one another. In certain embodiments, as shown, the arm 188 and the base 189 may be integrally formed within one another. One end of the arm 188 may be pivotally attached to the support 160, and the base 189 may be attached to an opposite end of the arm 188. At least a portion of the door lock 187, such as at least a portion of the base 189, may be positioned between the first spindle 100*a* and the second spindle 100*b*, as shown in FIGS. 1P-1U.

Figure 1Q:
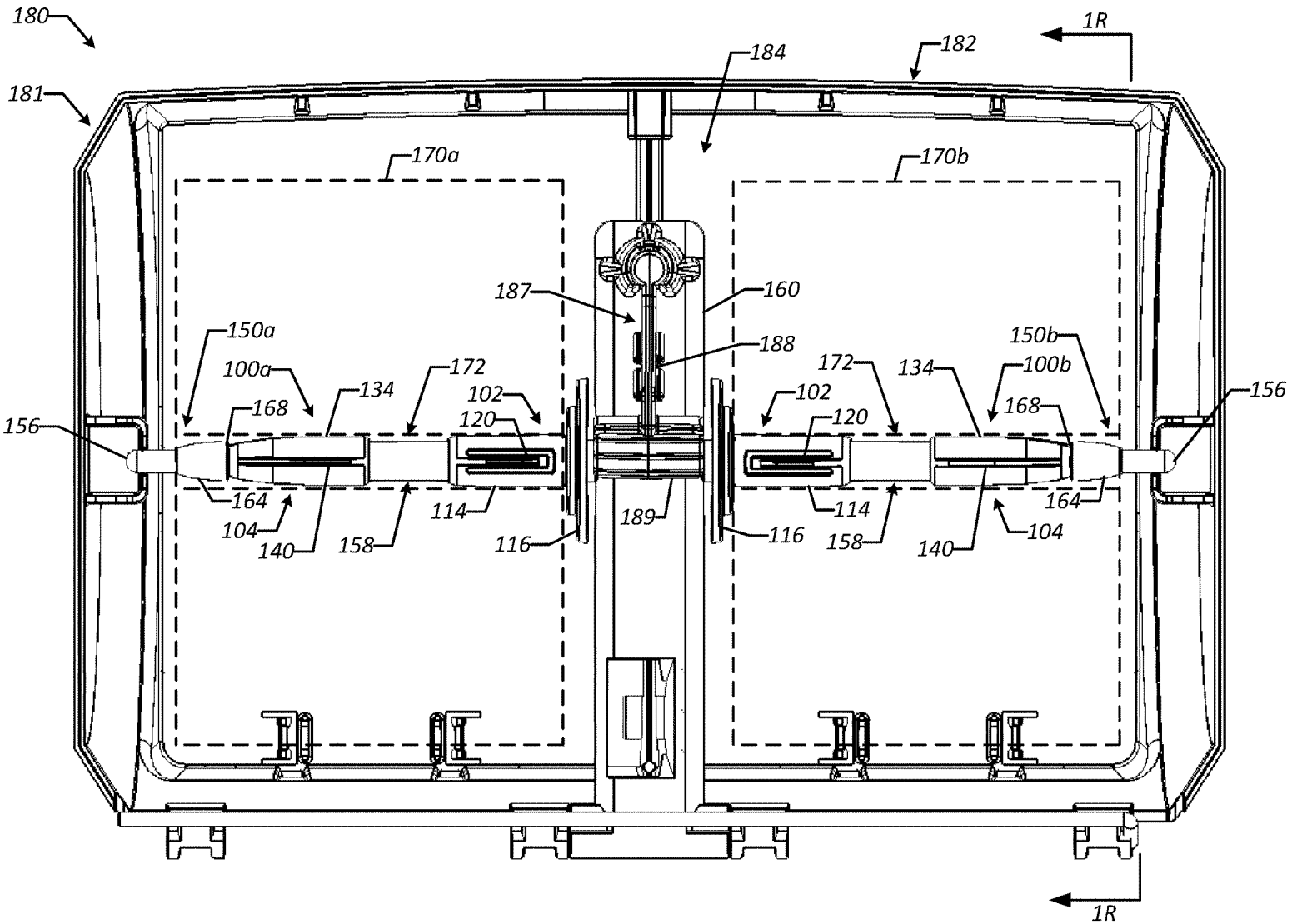
FIG. 1Q is a front view of a portion of the sheet product dispenser of FIG. 1N, showing a door lock of the sheet product dispenser in a first position, a first spindle in the first configuration and a full first roll of sheet product positioned thereon, and a second spindle in the first configuration and a full second roll of sheet product positioned thereon.
Figure 1R:
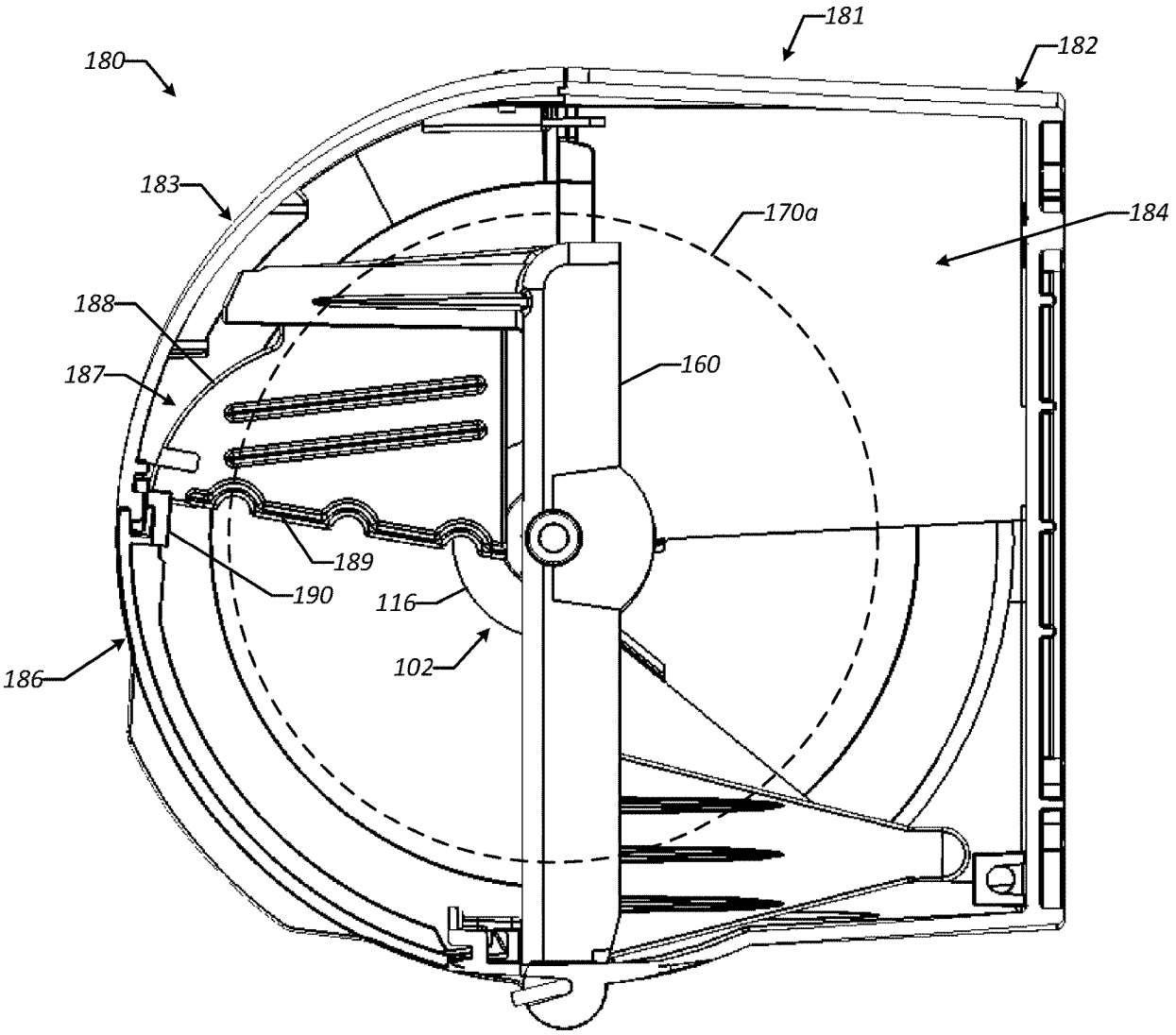
FIG. 1R is a cross-sectional side view of a portion of the sheet product dispenser of FIG. 1N, showing the door lock in the first position, the first spindle in the first configuration, and the first full roll of sheet product positioned thereon.

When the first roll 170*a* and the second roll 170*b* both are loaded in the dispenser 180, the door lock 187 may be oriented in a home position, as shown in FIGS. 1P-1S, relative to the support 160 and the housing 181. In certain embodiments, the arm 188 may extend vertically and the base 189 may extend horizontally when the door lock 187 is in the home position. As shown, at least a portion of the base 189 may be positioned between the respective base portions 102 of the spindles 100*a*, 100*b* when the door lock 187 is in the home position and the spindles 100*a*, 100*b* are in the first configuration. When the door lock 187 is in the home position, the door lock 187 and the spindles 100*a*, 100*b* may prevent or allow movement of the door 186 from the first position to the second position or from the second position to the first position, depending on an amount of sheet product positioned on one of the spindles 100*a*, 100*b*. When the door lock 187 is in the home position, a portion of the door lock 187 may be positioned within a path of movement of the door 186 from the first position to the second position or from the second position to the first position. For example, when the door 186 is in the first position and the door lock 187 is in the home position, a portion of the door lock 187 may be positioned within a path of movement of the door 186 from the first position to the second position, as shown in FIGS. 1Q and 1R. In certain embodiments, a portion of the arm 188 may be positioned within the path of movement of the door 186. In other embodiments, a portion of the base 189 may be positioned within the path of movement of the door 186. As shown, the door 186 may include a protrusion 190 positioned along the interior surface of the door 186 and configured to engage the portion of the door lock 187 positioned within the path of movement of the door 186. In certain embodiments, the protrusion 190 may be formed as an elongated rib extending along the interior surface of the door 186, although other configurations may be used. In certain embodiments, the door 186 may include multiple protrusions 190 configured to engage the door lock 187.

When the door 186 is in the first position, the first roll 170*a* is full or only partially depleted, and the first spindle 100*a* is in the first configuration, as shown in FIGS. 1Q and 1R, the door lock 187 and the first spindle 100*a* may prevent the door 186 from being moved from the first position to the second position. In certain embodiments, initial movement of the door 186 from the first position to the second position may cause the door 186 to engage the portion of the door lock 187 positioned within the path of movement of the door 186. For example, the protrusion 190 may engage the portion of the door lock 187, as shown in FIG. 1R. Such engagement between the door 186 and the door lock 187 may cause the door lock 187 to pivot away from the home position such that the base 189 engages the base portion 102 of the first spindle 100*a*, as shown in FIG. 1R. For example, the base 189 may engage the flange 116 of the base portion 102. However, as described above, when a substantial amount of the first roll 170*a* remains, the base portion 102 may be inhibited from axially translating toward the nose portion 104. Accordingly, the first spindle 100*a* may remain in the first configuration, and further pivotal movement of the door lock 187 may be inhibited by the engagement between the door lock 187 and the base portion 102 of the first spindle 100*a*. As a result, movement of the door 186 to the second position may be inhibited by the engagement between the door 186 and the door lock 187.

Figure 1S:
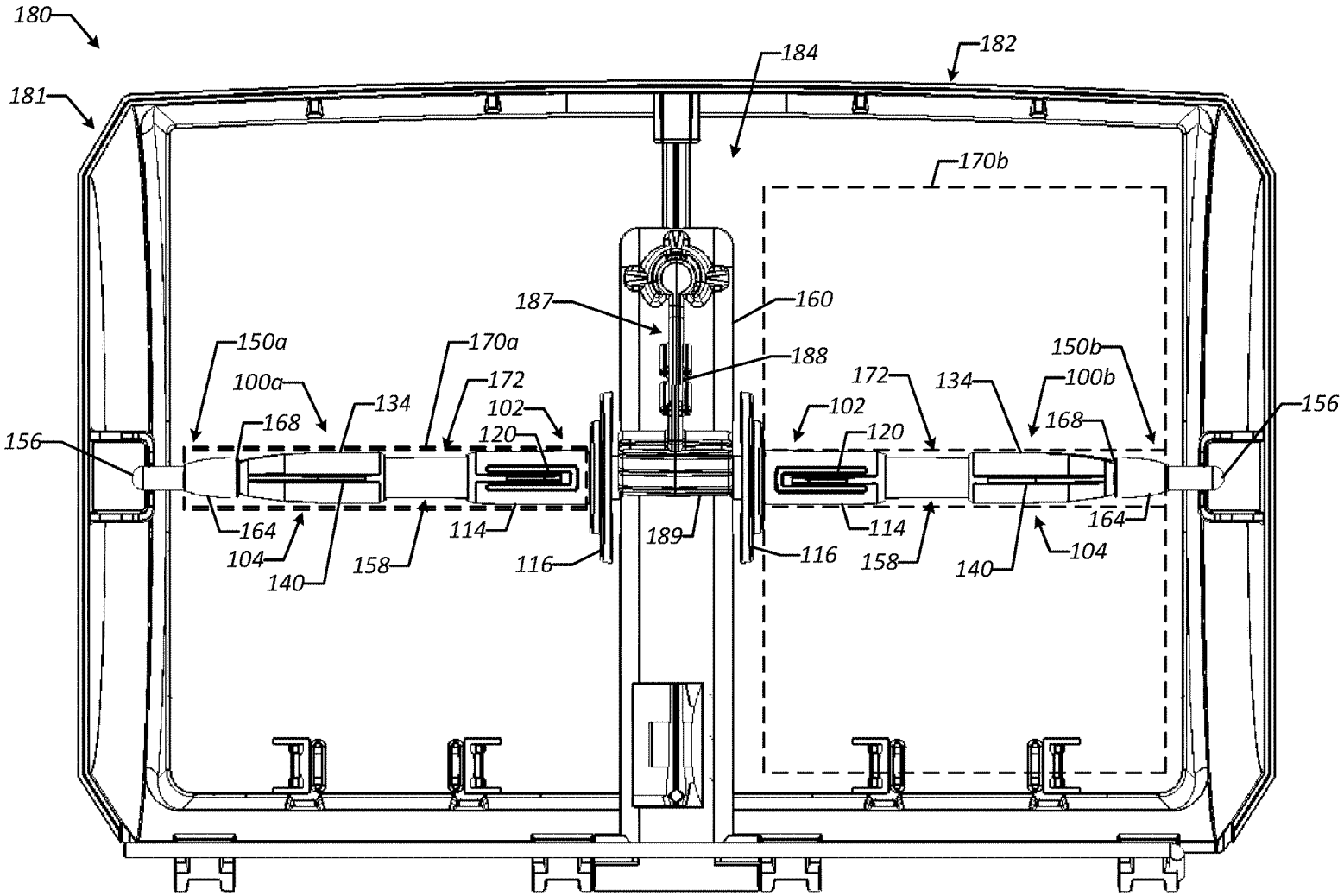
FIG. 1S is a front view of a portion of the sheet product dispenser of FIG. 1N, showing the door lock in the first position, the first spindle in the first configuration, and a remainder of the first roll of sheet product positioned thereon.
Figure 1T:
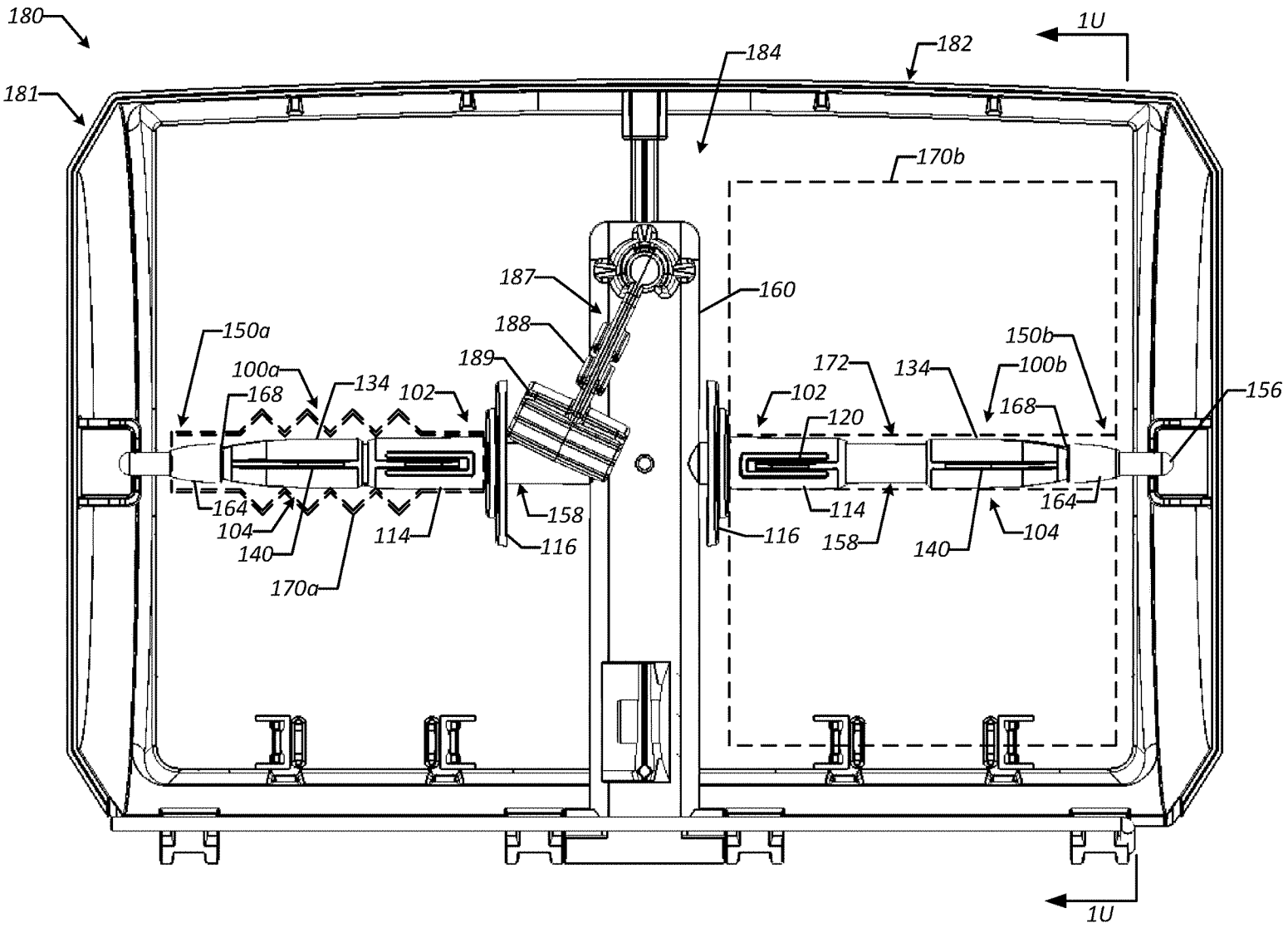
FIG. 1T is a front view of a portion of the sheet product dispenser of FIG. 1N, showing the door lock in a second position, the first spindle in the second configuration, and the remainder of the first roll of sheet product in the crushed state.
Figure 1U:
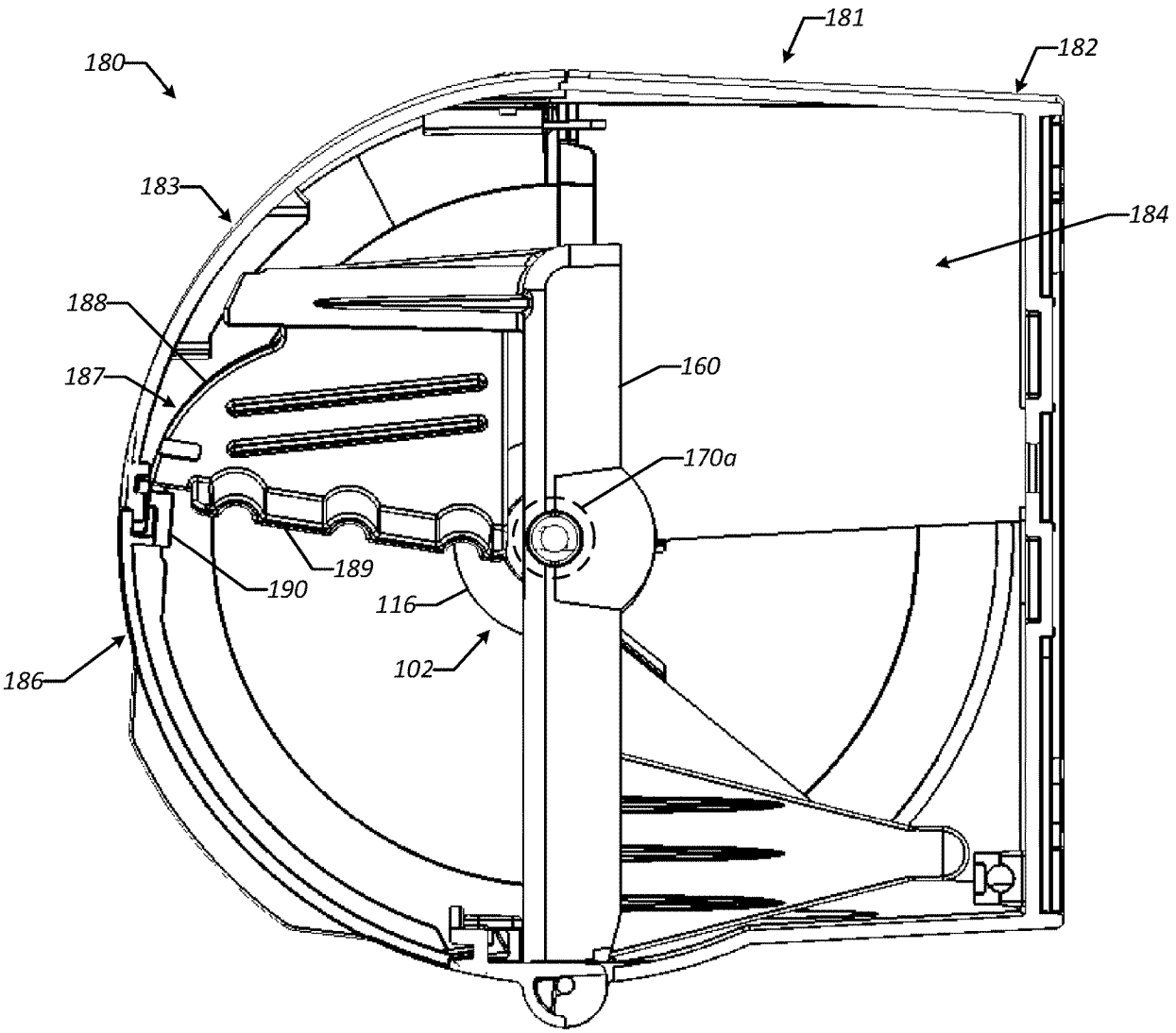
FIG. 1U is a cross-sectional side view of a portion of the sheet product dispenser of FIG. 1N, showing the door lock in the second position, the first spindle in the second configuration, and the remainder of the first roll of sheet product in the crushed state.

When the first roll 170*a* is substantially depleted, such that only a limited amount the sheet product thereof remains on the first spindle 100*a*, as shown in FIG. 1S, the door 186 may be able to move from the first position to the second position, and the first spindle 100*a* may be able to move from the first configuration to the second configuration. In particular, a user may grasp and translate (i.e., slide) the door 186 from the first position toward the second position. Such movement of the door 186 from the first position toward the second position may cause the door lock 187 to pivot further away from the home position due to the engagement between the door 186, such as the protrusion 190 thereof, and the door lock 187. The pivotal movement of the door lock 187 may cause the door lock 187 to apply a force against the base portion 102 of the first spindle 100*a* due to the engagement between the door lock 187 and the base portion 102, such as the flange 116 thereof. Because only a limited amount of the sheet product of the first roll 170*a* remains on the first spindle 100*a*, the force applied to the base portion 102 by the door lock 187 may cause the first spindle 100*a* to move from the first configuration to the second configuration, as shown in FIGS. 1T and 1U. In particular, the base portion 102 may be axially translated toward the nose portion 104, as shown, which may crush or otherwise deform the remainder of the first roll 170*a*. The pivotal movement of the door lock 187 may cause the portion of the door lock 187 to move outside of the path of movement of the door 186 from the first position toward the second position, as shown in FIG. 1U. In particular, the door lock 187 may move to an unlocked position in which the protrusion 190 of the door 186 no longer engages the door lock 187. As a result, the user may continue to translate the door 186 to the second position, thereby allowing access to the second roll 170*b* through the dispenser opening 185. Ultimately, the interaction between the first spindle 100*a*, the first mandrel 150*a*, the first coreless roll 170*a*, the door 186, and the door lock 187 may inhibit users from accessing the full second roll 170*b* until the first roll 170*a* is completely or nearly completely depleted, thereby minimizing waste of sheet product. It will be appreciated that the second spindle 100*b*, the second mandrel 150*b*, the second roll 170*b*, the door 186, and the door lock 187 may interact with one another in a similar manner in instances where the door 186 is initially positioned in the second position and both of the rolls 170*a*, 170*b* are full or only partially depleted.

In instances in which a cored roll is used with the dispenser 180 and the roll is completely or nearly completely depleted, the remaining paperboard core ultimately may prevent the door 186 from moving from the first position to the second position or from the second position to the first position for accessing another roll loaded in the dispenser 180. For example, if a first cored roll is positioned on the first spindle 100*a* and is completely depleted, the paperboard core thereof may remain on the first spindle 100*a* and may prevent the first spindle 100*a* from moving from the first configuration to the second configuration. In certain embodiments, initial movement of the door 186 from the first position toward the second position may cause the door 186 to engage the door lock 187 and pivot the door lock 187 such that the base 189 engages the flange 116 of the base portion 102 of the first spindle 100*a*. However, when paperboard core of the cored roll remains on the first spindle 100*a*, the base portion 102 may be inhibited from axially translating toward the nose portion 104 due at least in part to the relatively high axial force required to crush the paperboard core. In other words, the force applied to the base portion 102 by the door lock 187 may be less than the axial force required to crush the paperboard core. Accordingly, the door lock 187 may not be able to pivot to the unlocked position, and thus a portion of the door lock 187 may remain in the path of movement of the door 186. As a result, the first spindle 100*a* may remain in the first configuration, and movement of the door 186 to the second position may be blocked by the door lock 187. In this manner, the spindles 100*a*, 100*b* and the overall dispenser 180 may inhibit use of cored rolls of sheet product therewith.

FIGS. 2A-2K illustrate a spindle 200 (which also may be referred to as a "sheet product roll spindle") according to one or more embodiments of the disclosure. The spindle 200 is configured to support a roll of sheet product with respect to a sheet product dispenser, as described below. The spindle 200 may be used as a part of the sheet product dispenser 180 described above (instead of the spindle 100) or another type of sheet product dispenser having a different configuration. The spindle 200 may be configured for use with coreless rolls of sheet product. As described below, the spindle 200 may be configured to cooperate with other portions of the sheet product dispenser to inhibit use of cored rolls of sheet product therewith and also inhibit users from making a new roll accessible for dispensing from the dispenser until a currently accessible roll is completely or nearly completely depleted. It will be appreciated that the spindle 200 generally may be configured in a manner similar to that of the spindle 100. As described below, certain differences between the spindle 200 and the spindle 100 relate to a nose portion 204 of the spindle 200 which may have a different body, aperture, and slot configuration than the nose portion 104 and may interact with the sleeve 158 of the mandrel 150 in a different manner to inhibit translation of the nose portion 204 relative to the mandrel 150.

Figure 2A:
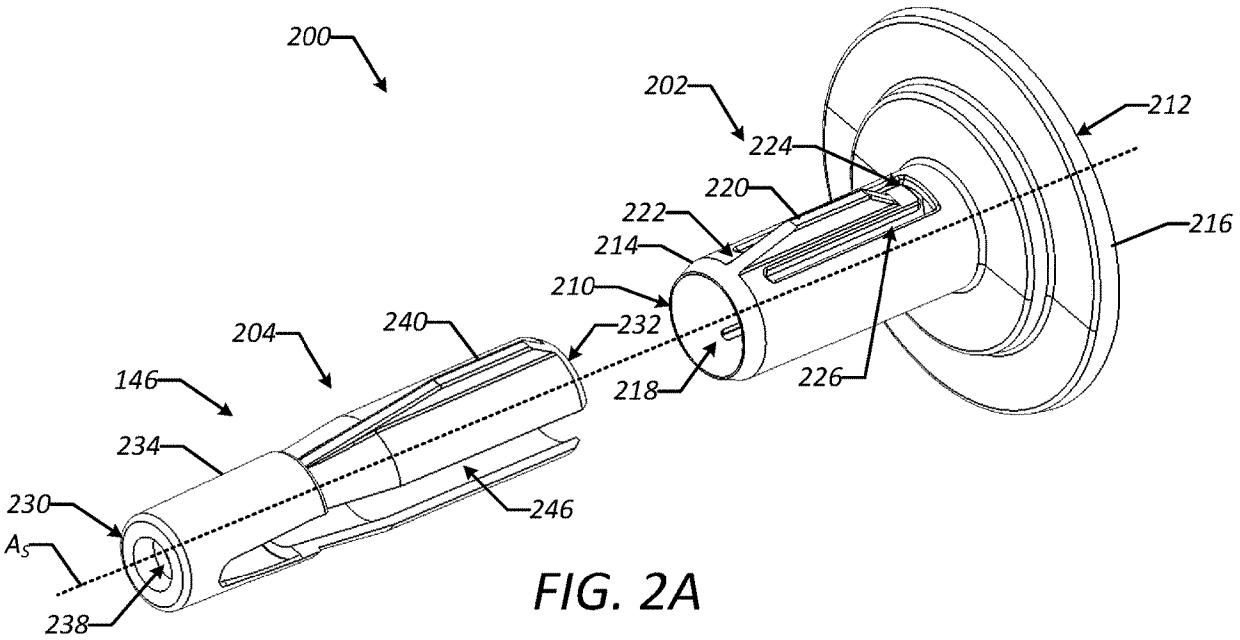
FIG. 2A is a perspective view of a spindle for a roll of sheet product in accordance with one or more embodiments of the disclosure.
Figure 2C:
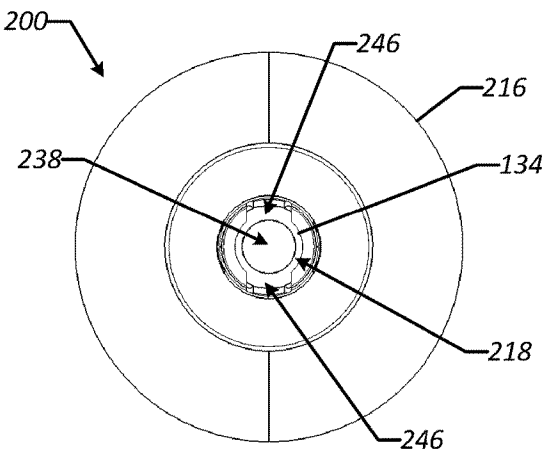
FIG. 2C is an opposite end view of the spindle of FIG. 2A.
Figure 2B:
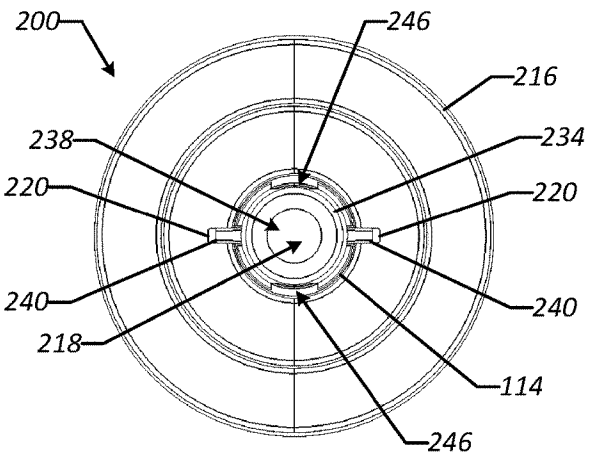
FIG. 2B is an end view of the spindle of FIG. 2A.
Figure 2D:
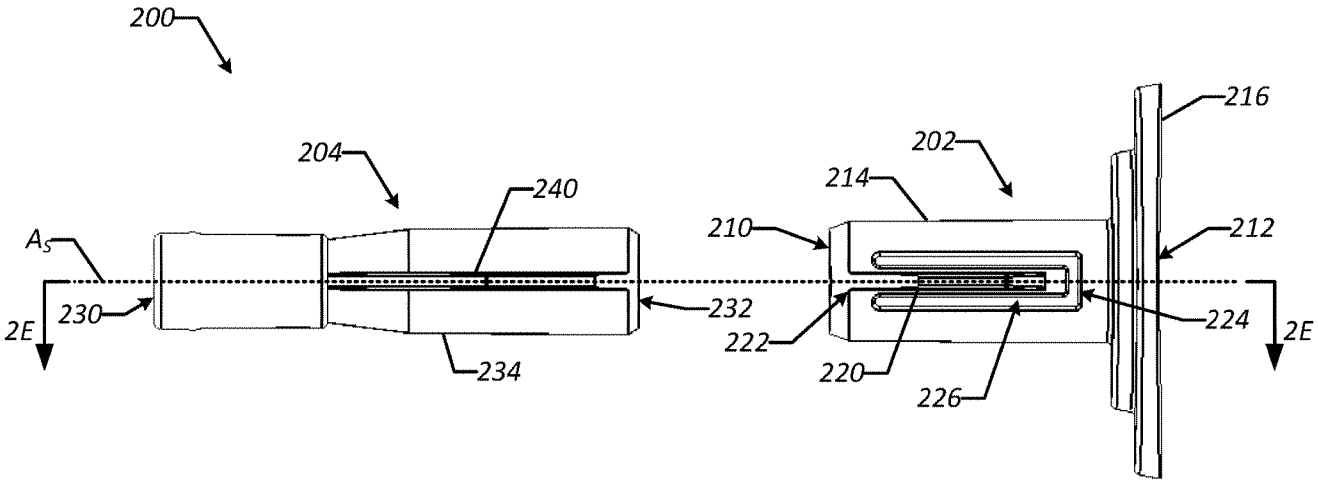
FIG. 2D is a front view of the spindle of FIG. 2A.
Figure 2E:
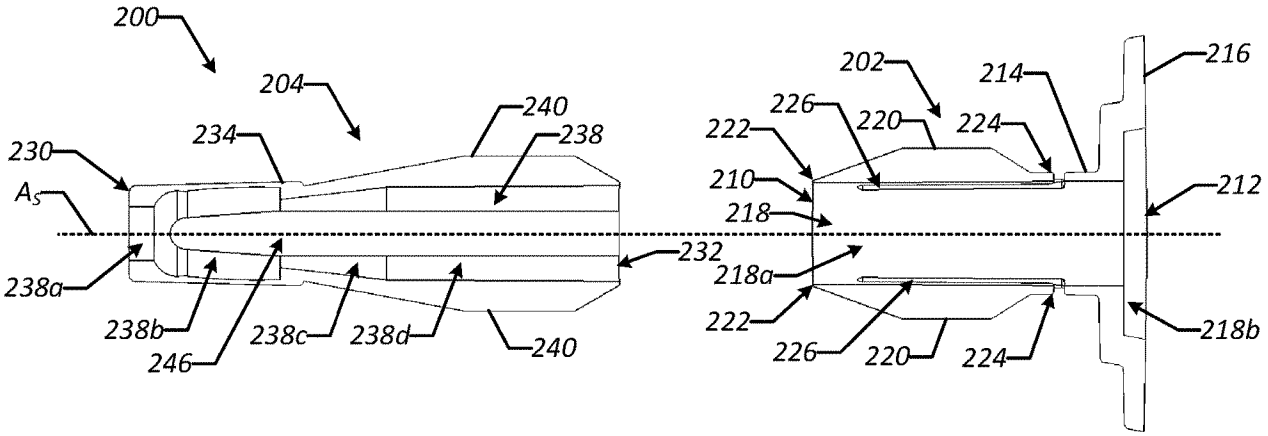
FIG. 2E is a cross-sectional top view of the spindle of FIG. 2A, taken along line 2E-2E of FIG. 2D.
Figure 2F:
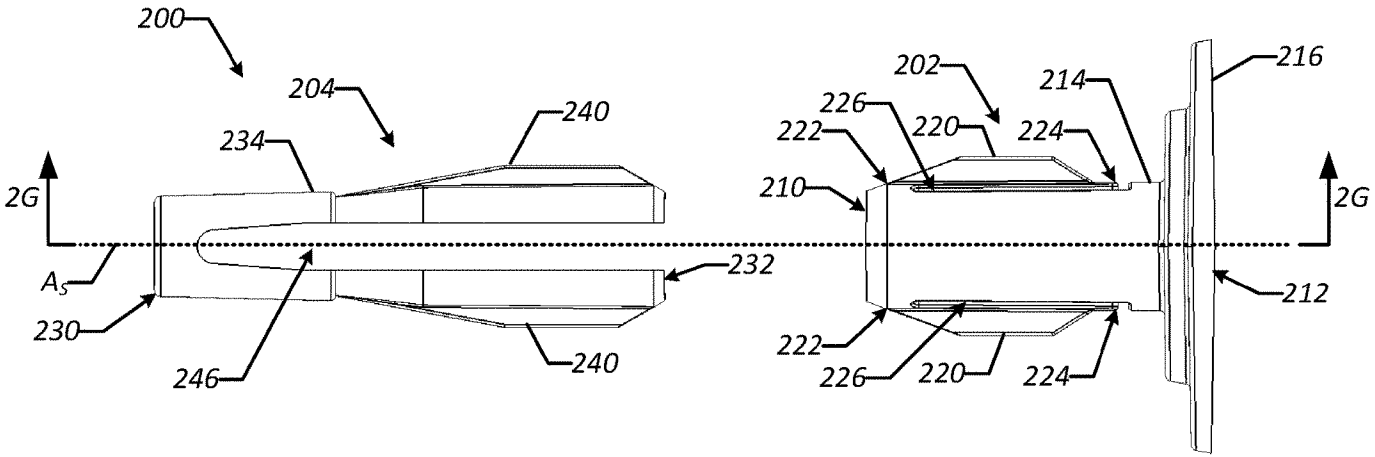
FIG. 2F is a top view of the spindle of FIG. 2A.
Figure 2G:
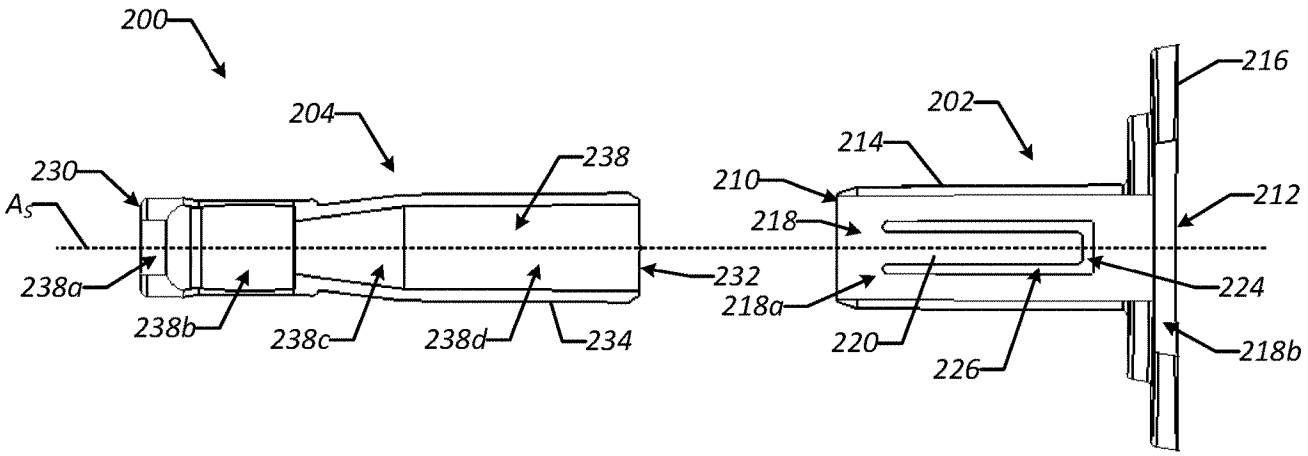
FIG. 2G is a cross-sectional front view of the spindle of FIG. 2A, taken along line 2G-2G of FIG. 2F.
Figure 2H:
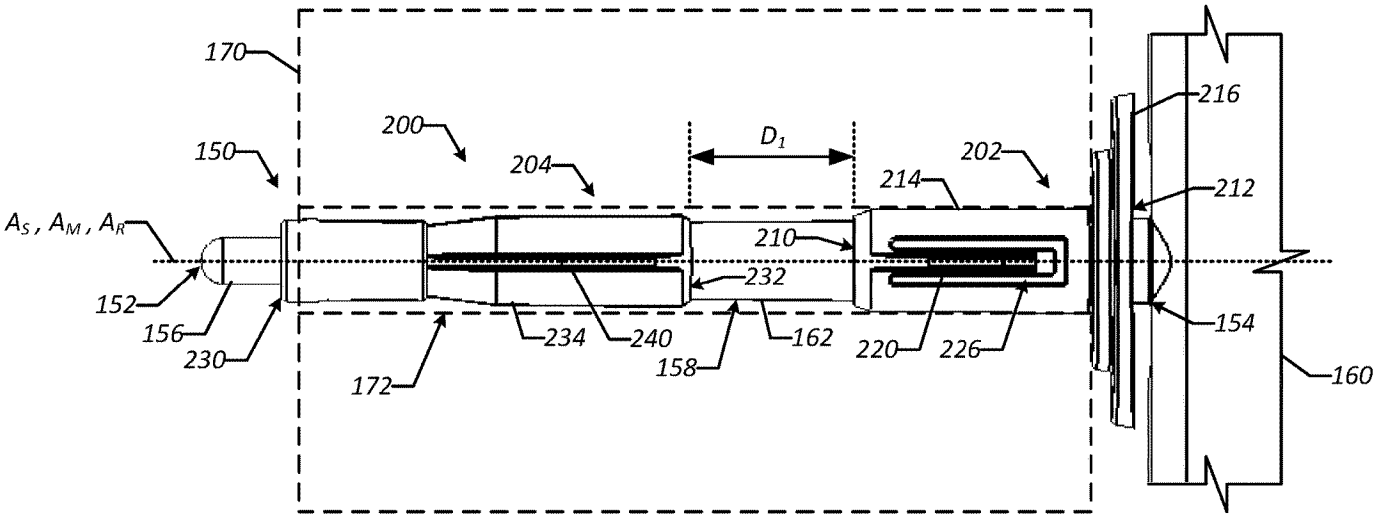
FIG. 2H is a front view of the spindle of FIG. 2A mounted to the mandrel of FIG. 1H, showing the spindle in a first configuration and a roll of sheet product positioned thereon.
Figure 2I:
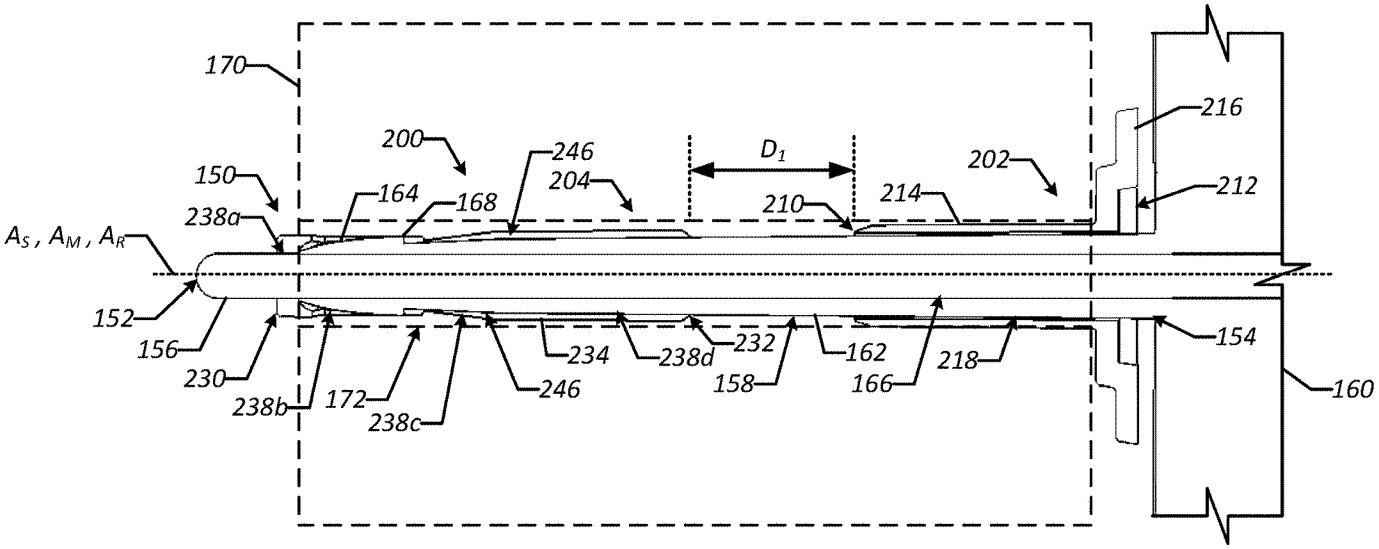
FIG. 2I is a cross-sectional front view of the spindle of FIG. 2A mounted to the mandrel of FIG. 1H, showing the spindle in the first configuration and the roll of sheet product positioned thereon.
Figure 2J:
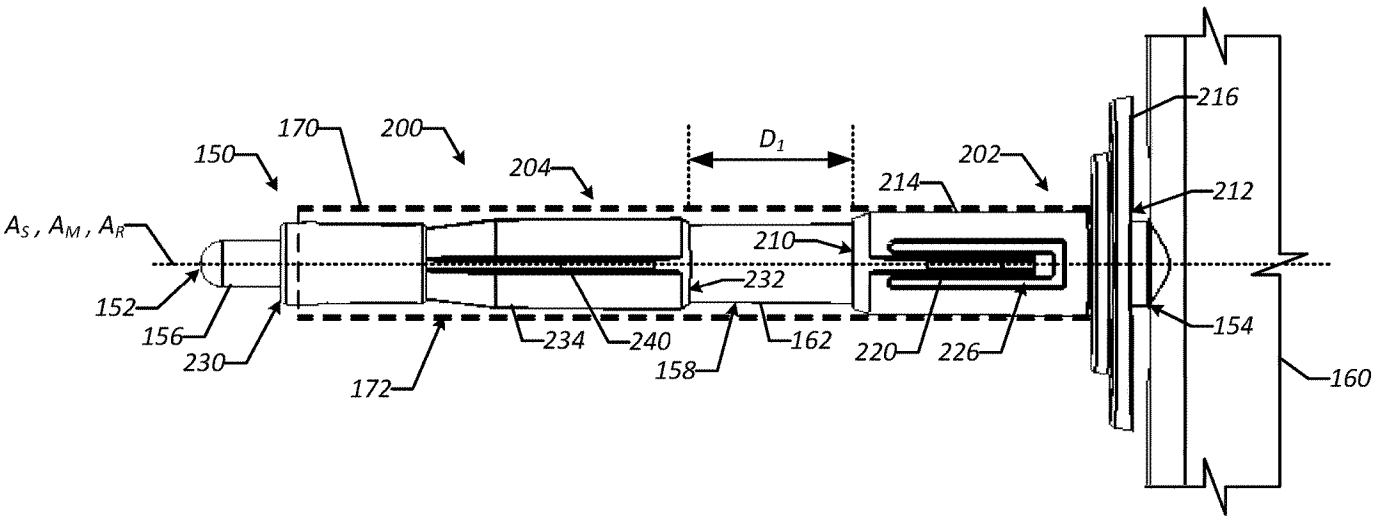
FIG. 2J is a front view of the spindle of FIG. 2A mounted to the mandrel of FIG. 1H, showing the spindle in the first configuration and a remainder of the roll of sheet product positioned thereon following dispensing of the sheet product.
Figure 2K:
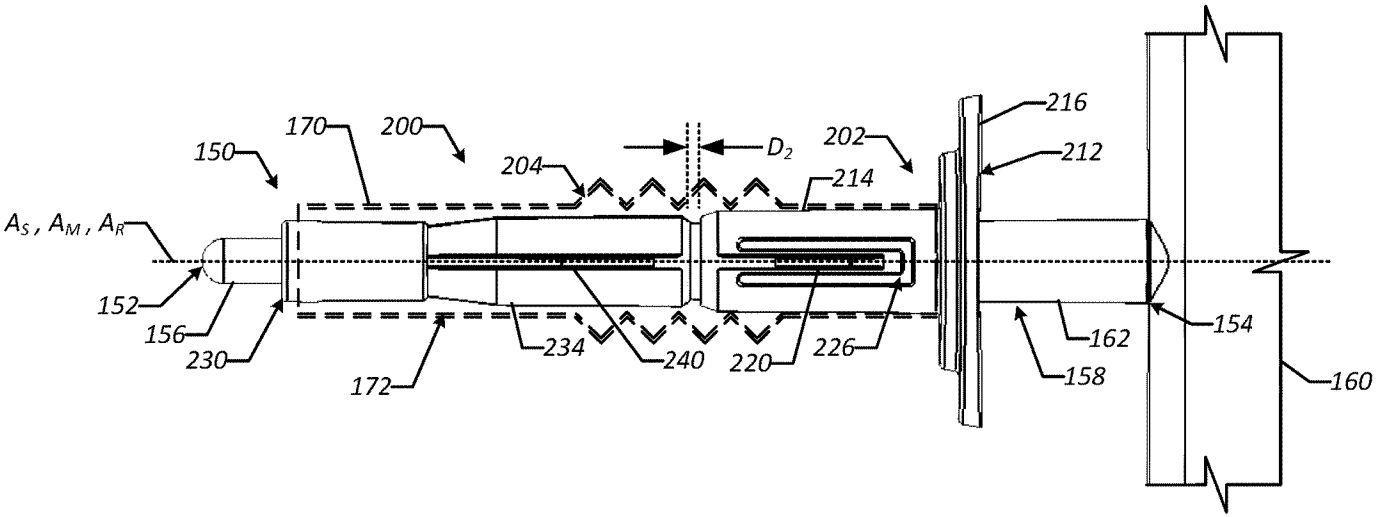
FIG. 2K is a front view of the spindle of FIG. 2A mounted to the mandrel of FIG. 1H, showing the spindle in a second configuration and the remainder of the roll of sheet product in a crushed state.

As shown in FIGS. 2A-2K, the spindle 200 may include a base portion 202 (which also may be referred to as a "base" or a "first portion") and a nose portion 204 (which also may be referred to as a "nose" or a "second portion") that are separate components from one another. During use of the spindle 200, the base portion 202 may be positioned partially within the central opening of the coreless roll of sheet product and partially outside of the central opening, and the nose portion 204 may be positioned entirely or at least partially within the central opening of the coreless roll. As described below, during use of the spindle 200, the base portion 202 and the nose portion 204 may be movable relative to one another between a first configuration, as shown in FIGS. 2H-2J, and a second configuration, as shown in FIG. 2K. In particular, the base portion 202 and the nose portion 204 may be configured to translate relative to one another between the first configuration, in which the portions 202, 204 are positioned further away from one another, and the second configuration, in which the portions 202, 204 are positioned closer to one another.

The base portion 202 may be formed as an elongated member having a first end 210 (which also may be referred to as a "leading end") and a second end 212 (which also may be referred to as a "trailing end") positioned opposite one another in the direction of a longitudinal axis $A_S$ of the spindle 200. As shown, the base portion 202 may include a body 214 (which also may be referred to as a "base body") and a flange 216 (which also may be referred to as a "base flange") fixedly attached to the body 214. In certain embodiments, as shown, the body 214 and the flange 216 may be integrally formed with one another. The flange 216 may be positioned at or near the second end 212 of the base portion 202, and the body 214 may extend from the first end 210 of the base portion 202 to the flange 216. In certain embodiments, the body 214 may have a tubular shape extending axially along the longitudinal axis $A_S$ of the spindle 200 and a circular cross-sectional shape taken in the direction perpendicular to the longitudinal axis $A_S$, although other shapes may be used. In certain embodiments, the flange 216 may have a ring shape extending radially outward with respect to the longitudinal axis $A_S$ of the spindle 200 and a circular cross-sectional shape taken in the direction perpendicular to the longitudinal axis $A_S$, although other shapes may be used. The flange 216 may extend circumferentially along the entire outer circumference of the body 214, as shown, or may extend along only a portion of the outer circumference of the body 214. During use of the spindle 200, the body 214 may be positioned entirely or at least partially within the central opening of the coreless roll of sheet product, and the flange 216 may be positioned outside of the central opening of the roll. In this manner, the body 214 may support a respective end portion of the roll, and the flange 216 may abut or be positioned near the respective end of the roll and also may engage mating portions of the sheet product dispenser, as described below. In certain embodiments, the first end 210 of the base portion 202 may be tapered to facilitate insertion of the body 214 into the central opening of the roll. As shown, the base portion 202 may define an aperture 218 extending axially through the body 214 and the flange 216 from the first end 210 to the second end 212 thereof. In this manner, the base portion 202 may be mounted on a mandrel of the sheet product dispenser, with the mandrel extending through the aperture 218. In certain embodiments, the aperture 218 may include a first region 218*a* having a first diameter, and a second region 218*b* having a second diameter that is larger than the first diameter. In certain embodiments, the diameter of the aperture 218 may be constant along the first region 218*a* in the direction of the longitudinal axis $A_S$. In other embodiments, the diameter of the aperture 218 may vary along the first region 218*a* in the direction of the longitudinal axis $A_S$. For example, the aperture 218 may be tapered along the first region 218*a* in the direction of the longitudinal axis $A_S$, such that the diameter increases from the first end 210 toward the second end 212.

As shown, the base portion 202 may include one or more fins 220 attached to the body 214 and extending radially outward therefrom. In certain embodiments, the base portion 202 may include a pair of the fins 220 circumferentially spaced apart from one another, for example, by 180 degrees, although any number of the fins 220 and alternative spacings of the fins 220 may be used. Each fin 220 may be formed as an elongated member extending in the direction of the longitudinal axis $A_S$. In certain embodiments, as shown, each fin 220 may have a trapezoidal cross-sectional shape taken in the direction parallel to the direction of the longitudinal axis $A_S$, although other shapes may be used. Each fin 220 may have a fixed end 222 that is fixedly attached to the body 214 and an opposite free end 224 that is able to move with respect to the body 214. In particular, each fin 220 may be elastically deflected or deformed inward toward the longitudinal axis $A_S$, such that the free end 224 of the fin 220 is positioned at least partially within the aperture 218. In this manner, the fins 220 may frictionally engage the mandrel of the sheet product dispenser. As shown, each fin 220 may be positioned at least partially within a mating slot 226 defined in the body 214 and in communication with the aperture 218. During use of the spindle 200, the fins 220 may be positioned entirely or at least partially within the central opening of the coreless roll of sheet product. In this manner, respective radially outer surfaces of the fins 220 may frictionally engage the inner layer of sheet product of the roll, such that the base portion 202 and the roll rotate with one another about the mandrel of the dispenser. In certain embodiments, the central opening of the coreless roll may be sized such that, upon insertion of the body 214 therein, portions of the fins 220 are deflected inward toward the longitudinal axis $A_S$ and into the aperture 218. In this manner, respective radially inner surfaces of the fins 220 may frictionally engage the mandrel of the dispenser. Such frictional engagement may provide a degree of resistance opposing rotation of the base portion 202 and the roll relative to the mandrel. In this manner, the interaction between the base portion 202 and the mandrel may control rotation of the roll during dispensing.

The nose portion 204 may be formed as an elongated member having a first end 230 (which also may be referred to as a "leading end") and a second end 232 (which also may be referred to as a "trailing end") positioned opposite one another in the direction of the longitudinal axis $A_S$ of the spindle 200. As shown, the nose portion 204 may include a body 234 (which also may be referred to as a "nose body") extending from the first end 230 to the second end 232 thereof. In certain embodiments, the body 234 may have a tubular shape extending axially along the longitudinal axis $A_S$ of the spindle 200 and a circular cross-sectional shape taken in the direction perpendicular to the longitudinal axis $A_S$, although other shapes may be used. During use of the spindle 200, the body 234 may be positioned entirely or at least partially within the central opening of the coreless roll of sheet product, such that the body 234 supports a respective portion of the roll. As shown, the nose portion 204 may define an aperture 238 extending axially through the body 234 from the first end 230 to the second end 232 thereof. In this manner, the nose portion 204 may be mounted on the mandrel of the dispenser, with the mandrel extending through the aperture 238. In certain embodiments, the aperture 238 may include a first region 238*a* having a first diameter, a second region 238*b* having a second diameter that is larger than the first diameter, a third region 238*c* having a third diameter that is larger than the first diameter and smaller than the second diameter, and a fourth region 238*d* having a fourth diameter that is larger than each of the first diameter and the third diameter and smaller than the second diameter. In certain embodiments, the diameter of the aperture 238 may be constant along the first region 238*a* and along the fourth region 238*d* in the direction of the longitudinal axis $A_S$. In certain embodiments, as shown, the diameter of the aperture 238 may vary along each of the second region 238*b* and the third region 238*c* in the direction of the longitudinal axis $A_S$. For example, the second region 238*b* and the third region 238*c* each may be tapered in the direction of the longitudinal axis $A_S$, such that the diameter increases along each region 238*b*, 238*c* in the direction from the first end 230 toward the second end 232.

As shown, the nose portion 204 may include one or more fins 240 attached to the body 234 and extending radially outward therefrom. In certain embodiments, the nose portion 204 may include a pair of the fins 240 circumferentially spaced apart from one another, for example, by 180 degrees, although any number of the fins 240 and alternative spacings of the fins 240 may be used. Each fin 240 may be formed as an elongated member extending in the direction of the longitudinal axis $A_S$. In certain embodiments, as shown, each fin 240 may have a trapezoidal cross-sectional shape taken in the direction parallel to the direction of the longitudinal axis $A_S$, although other shapes may be used. In certain embodiments, each fin 240 may extend from the second end 232 toward the first end 230 and may terminate at a location spaced apart from the first end 230, although other positions may be used. As shown, one or more slots 246 may be defined in the body 234. In certain embodiments, a pair of the slots 246 may be circumferentially spaced apart from one another, for example, by 180 degrees, although any number of the slots 246 and alternative spacings of the slots 246 may be used. As shown, one of the slots 246 may be positioned circumferentially between the fins 240 along one side of the body 234, and the other slot 246 may be positioned circumferentially between the fins 240 along an opposite side of the body 234. Each slot 246 may extend from the second end 232 toward the first end 230 of the nose portion 204 and may terminate at a location spaced apart from the first end 230. As shown, the slots 246 may be configured to allow respective portions of the body 234 and the fins 240 near the second end 232 to be elastically deflected or deformed inward toward the longitudinal axis $A_S$. In this manner, the body 234 may frictionally engage the mandrel of the sheet product dispenser. During use of the spindle 200, the fins 240 may be positioned entirely or at least partially within the central opening of the coreless roll of sheet product. In this manner, respective radially outer surfaces of the fins 240 may frictionally engage the inner layer of sheet product of the roll, such that the nose portion 204 and the roll rotate with one another about the mandrel of the dispenser. In certain embodiments, the central opening of the coreless roll may be sized such that, upon insertion of the body 234 therein, portions of the body 234 and the fins 240 are deflected inward toward the longitudinal axis $A_S$. In this manner, respective radially inner surfaces of the body 234 may frictionally engage the mandrel of the dispenser. Such frictional engagement may provide a degree of resistance opposing rotation of the nose portion 204 and the roll relative to the mandrel. In this manner, the interaction between the nose portion 204 and the mandrel may control rotation of the roll during dispensing.

In certain embodiments, the spindle 200 may be formed of a plastic material, although other materials, such as composites or metals may be used in other embodiments. In certain embodiments, the base portion 202 and the nose portion 204 may be formed of the same material. In other embodiments, the base portion 202 and the nose portion 204 may be formed of different materials.

FIGS. 2H-2K illustrate the spindle 200 mounted to a mandrel 150 of a sheet product dispenser, with a roll 170 of sheet product (shown via dashed lines) positioned on the spindle 200 for dispensing of the sheet product. The roll 170 of sheet product and the mandrel 150 may be configured in the manner described above. As shown, the spindle 200 may support the roll 170 for rotation about the longitudinal axis $A_M$ of the mandrel 150. The spindle 200 may be mounted to the mandrel 150 such that the longitudinal axis $A_S$ of the spindle 200, the longitudinal axis $A_M$ of the mandrel 150, and the longitudinal axis $A_R$ of the roll 170 are coaxial with one another. The mandrel 150 may have a first end 152 and a second end 154 positioned opposite one another, and the mandrel 150 may include a shaft 156 and a sleeve 158 positioned over at least a portion of the shaft 156 and attached to a support 160. As shown, the sleeve 158 may include a body 162, a nose 164 positioned at the free end of the sleeve 158, an aperture 166 extending through the body 162 and the nose 164, and a lip 168 positioned at the interface of the body 162 and the nose 164.

As shown in FIGS. 2H and 2I, the spindle 200 may be mounted to the mandrel 150 with the base portion 202 and the nose portion 204 positioned over the sleeve 158. In other words, the sleeve 158 may extend through the aperture 218 of the base portion 202 and the aperture 238 of the nose portion 204. As shown, the spindle 200 may be in the first configuration, with the base portion 202 and the nose portion 204 spaced apart from one another by a first distance $D_1$ in the direction of the longitudinal axis $A_M$. In certain embodiments, as shown, the flange 216 of the base portion 202 may be positioned near but axially spaced apart from the support 160 and the second end 154 of the mandrel 150 when the spindle 200 is in the first configuration. In other embodiments, the flange 216 may abut the support 160 when the spindle 200 is in the first configuration. In certain embodiments, as shown, the body 234 of the nose portion 204 may be positioned over the nose 164 of the sleeve 158, such that the nose 164 is positioned within the second region 238*b* of the aperture 238.

When the roll 170 of sheet product is positioned over the spindle 200 and the mandrel 150 and the spindle 200 is in the first configuration, the body 214 of the base portion 202 may be positioned entirely or at least partially within the central opening 172 of the roll 170, and the flange 216 may be positioned outside of the central opening 172. In certain embodiments, as shown, the flange 216 may abut the respective end of the roll 170. When the roll 170 of sheet product is positioned over the spindle 200 and the mandrel 150 and the spindle 200 is in the first configuration, the nose portion 204 may be positioned at least partially within the central opening 172 and at least partially outside of the central opening 172, as shown. When the roll 170 of sheet product is positioned over the spindle 200, frictional engagement between the fins 220 of the base portion 202 and the central aperture 172 may cause the fins 220 to be elastically deflected inward toward the longitudinal axis $A_M$ and into the aperture 218. As a result, the fins 220 may frictionally engage the sleeve 158, thereby providing a resistance to rotation of the spindle 200 and the roll 170 relative to the sleeve 158 and the overall mandrel 150. In a similar manner, when the roll 170 of sheet product is positioned over the spindle 200, frictional engagement between the fins 240 of the nose portion 204 and the central aperture 172 may cause the body 234 to be elastically deflected inward toward the longitudinal axis $A_M$ about the slots 246. As a result, the body 234 may frictionally engage the sleeve 158, thereby providing a resistance to rotation of the spindle 200 and the roll 170 relative to the sleeve 158 and the overall mandrel 150. In certain embodiments, the free end of the sleeve 158 may be aligned with the opposite end of the roll 170. In other embodiments, the free end of the sleeve 158 may be positioned within or outside of the central opening 172. In certain embodiments, the free end of the shaft 156 may be positioned outside of the central opening 172.

Sheet product may be dispensed from the roll 170 by a user grasping and pulling a tail end of the roll 170, thereby causing the spindle 200 and the roll 170 to rotate relative to the mandrel 150 about the longitudinal axis $A_M$. As described above, rotation of the spindle 200 and the roll 170 may be controlled by the frictional engagement between the spindle 200 and the sleeve 158. When the roll 170 is new (i.e., prior to dispensing of sheet product therefrom) or a substantial amount of the roll 170 remains, the spindle 200 may be inhibited from moving from the first configuration toward the second configuration. In other words, when at least a substantial amount of the roll 170 remains, the base portion 202 and the nose portion 204 may be inhibited from axially translating toward one another. In particular, the base portion 202 and the nose portion 204 may be inhibited from axially translating toward one another due to one or more or all of: (i) the column strength of the remaining portion of the roll 170 in the direction of the longitudinal axis $A_R$ thereof, (ii) the frictional engagement between the base portion 202 and/or the nose portion 204 and the roll 170, and (iii) the frictional engagement between the base portion 202 and/or the nose portion 204 and the sleeve 158. In certain embodiments, the spindle 200 may be deemed to be "inhibited" from moving from the first configuration toward the second configuration when an axial force required to move the spindle 200 from the first configuration to the second configuration is at least 10 pounds-force, at least 20 pounds-force, at least 30 pounds-force, or at least 40 pounds-force. In certain embodiments, the spindle 200 may be inhibited from moving from the first configuration toward the second configuration when at least 10%, at least 5%, or at least 1% of the roll 170 remains on the spindle 200.

In certain instances, the entire roll 170 may be dispensed from the sheet product dispenser, such that no sheet product remains positioned on the spindle 200. In other instances, a limited amount of sheet product of the roll 170 may remain positioned on the spindle 200, as shown in FIG. 2J. This "tube" or "cigar" of remaining sheet product of the roll 170 may difficult for a user to access or easily dispense. When such a limited amount of sheet product remains, the spindle 200 may be able to move from the first configuration to the second configuration, as shown in FIG. 2K. In particular, the base portion 202 may be axially translated toward the nose portion 204, as shown, or the nose portion 204 may be axially translated toward the base portion 202. In certain embodiments, such movement of the spindle 200 may crush or otherwise deform the remainder of the roll 170, as shown. In this manner, the interaction between the spindle 200, the mandrel 150, and the coreless roll 170 may inhibit users from discarding the roll 170 until the roll 170 is completely or nearly completely depleted. In instances in which a cored roll is used with the spindle 200 and the roll is completely or nearly completely depleted, the paperboard core remaining on the spindle 200 may prevent the spindle 200 from moving from the first configuration to the second configuration due to at least the column strength of the paperboard core in the direction of the longitudinal axis thereof.

In certain embodiments, a multi-roll sheet product dispenser may include a plurality of the spindles 200 for supporting a plurality of the rolls 170 of sheet product relative to the dispenser. For example, a pair of the spindles 200 may be used as a part of the sheet product dispenser 180 described above (instead of the spindles 100), with one of the spindles 200 mounted on the first mandrel 150*a* and supporting the first roll 170*a*, and the other spindle 200 mounted on the second mandrel 150*b* and supporting the second roll 170*b*. It will be appreciated that the spindles 200 may interact with the mandrels 150*a*, 150*b*, the rolls 170*a*, 170*b*, the door 186, and the door lock 187 in a manner similar to that described above to inhibit users from accessing the full second roll 170*b* until the first roll 170*a* is completely or nearly completely depleted, thereby minimizing waste of sheet product. Further, the spindles 200 may interact with the mandrels 150*a*, 150*b*, the rolls 170*a*, 170*b*, the door 186, and the door lock 187 in a manner similar to that described above to inhibit use of cored rolls of sheet product therewith.

FIGS. 3A-3K illustrate a spindle 400 (which also may be referred to as a "sheet product roll spindle") according to one or more embodiments of the disclosure. The spindle 400 is configured to support a roll of sheet product with respect to a sheet product dispenser, as described below. The spindle 400 may be used as a part of the sheet product dispenser 180 described above (instead of the spindle 100) or another type of sheet product dispenser having a different configuration. The spindle 400 may be configured for use with coreless rolls of sheet product. As described below, the spindle 400 may be configured to cooperate with other portions of the sheet product dispenser to inhibit use of cored rolls of sheet product therewith and also inhibit users from making a new roll accessible for dispensing from the dispenser until a currently accessible roll is completely or nearly completely depleted. It will be appreciated that the spindle 400 generally may be configured in a manner similar to that of the spindle 100. As described below, certain differences between the spindle 400 and the spindle 100 relate to both a nose portion 404 of the spindle 400 which may have a different body and/or other features than the nose portion 104 and a base portion 402 of the spindle 400 which may not have fins or other frictional engagement features than the base portion 102.

Figure 3A:
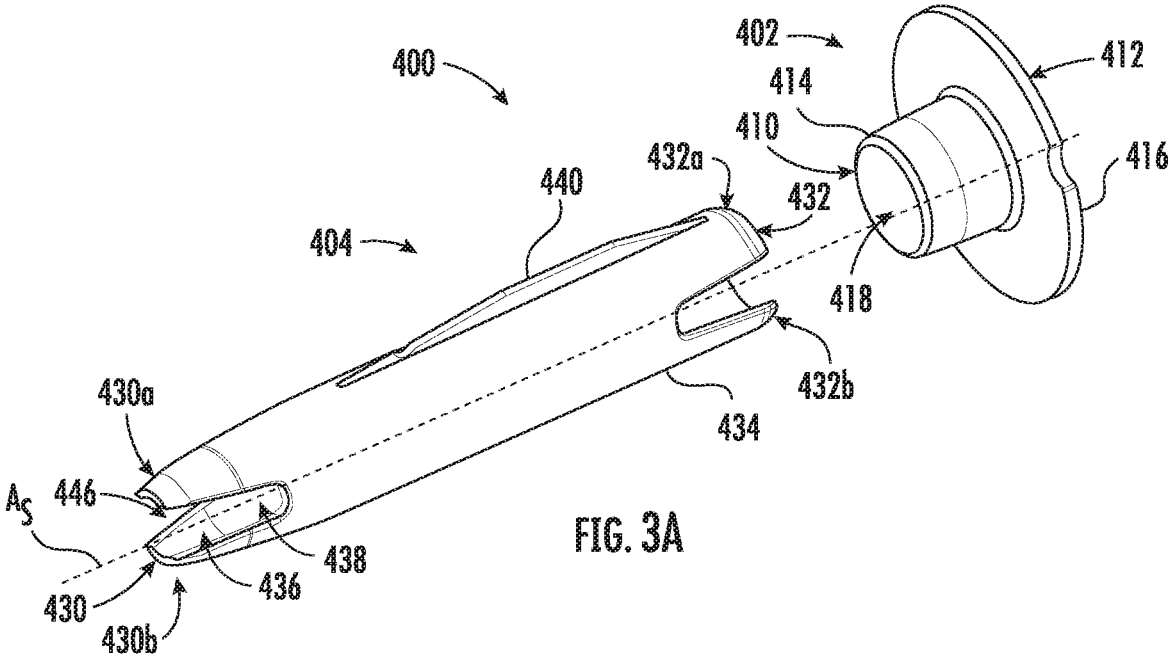
FIG. 3A is a perspective view of a spindle for a roll of sheet product in accordance with one or more embodiments of the disclosure.
Figure 3B:
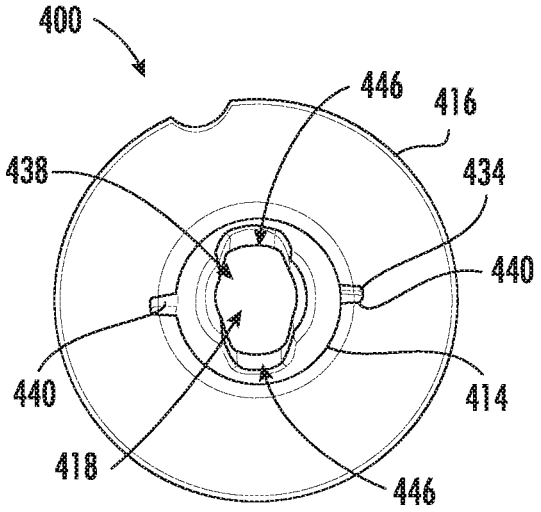
FIG. 3B is an end view of the spindle of FIG. 3A.
Figure 3C:
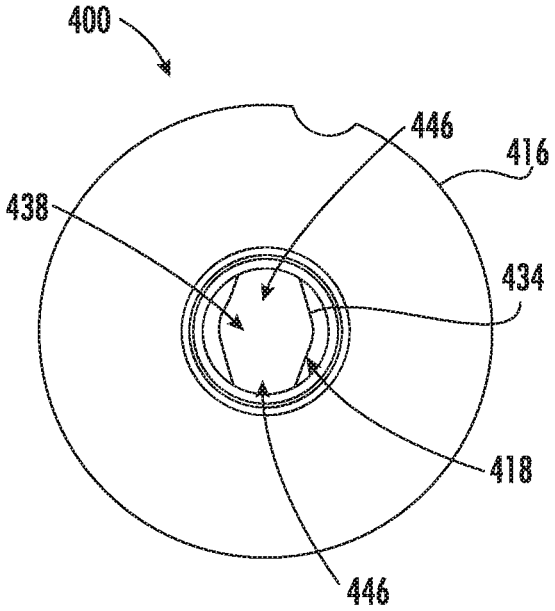
FIG. 3C is an opposite end view of the spindle of FIG. 3A.
Figure 3D:
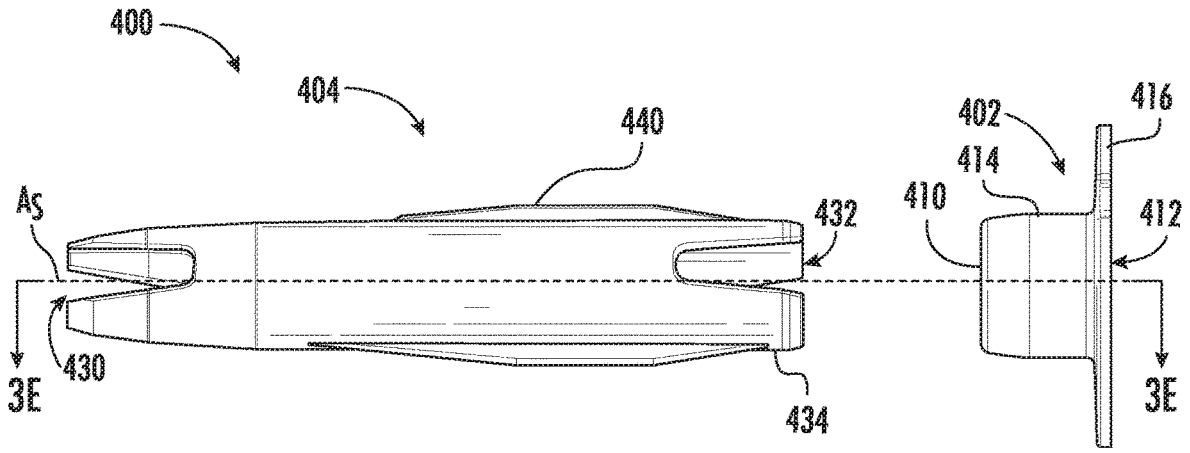
FIG. 3D is a front view of the spindle of FIG. 3A.
Figure 3E:
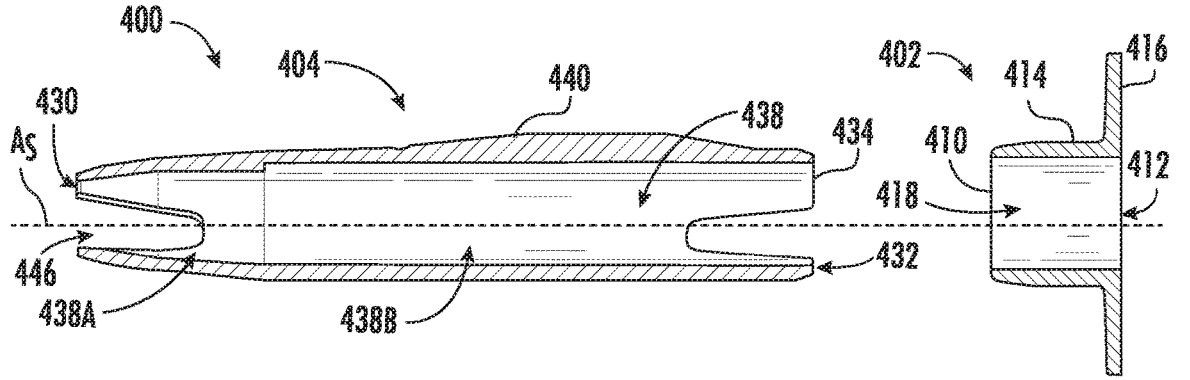
FIG. 3E is a cross-sectional top view of the spindle of FIG. 3A, taken along line 3E-3E of FIG. 3D.
Figure 3F:
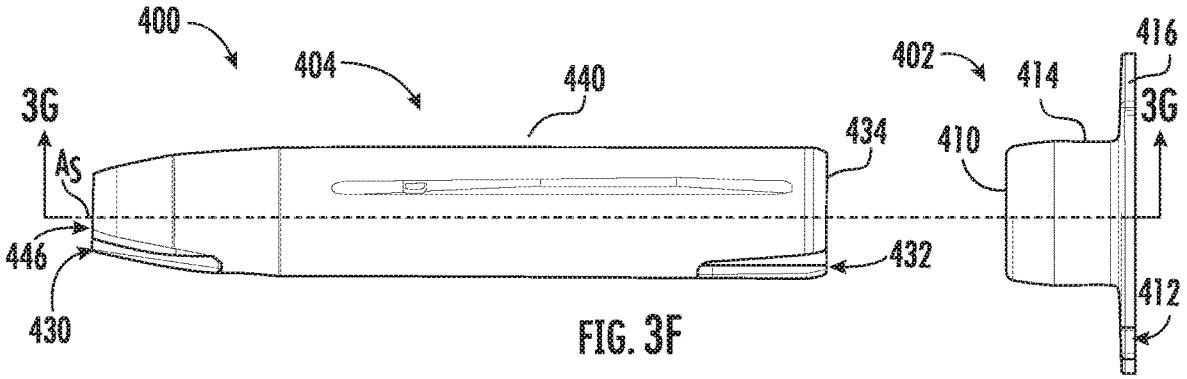
FIG. 3F is a top view of the spindle of FIG. 3A.
Figure 3G:
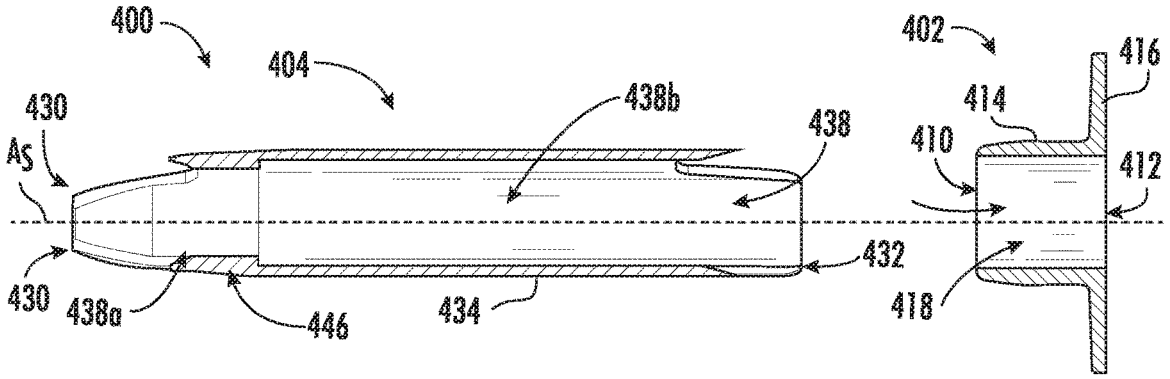
FIG. 3G is a cross-sectional front view of the spindle of FIG. 3A, taken along line 3G-3G of FIG. 3F.
Figure 3H:
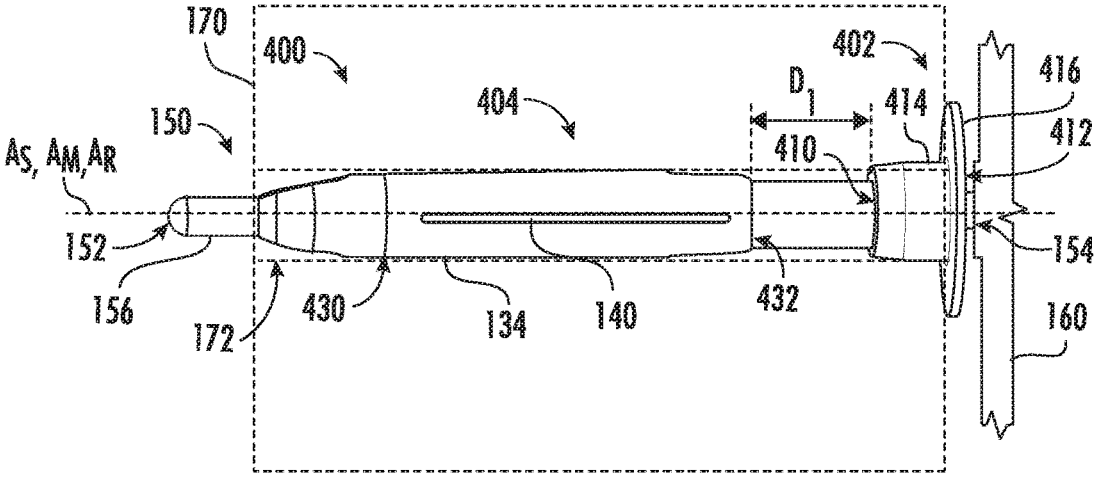
FIG. 3H is a front view of the spindle of FIG. 3A mounted to the mandrel of FIG. 1H, showing the spindle in a first configuration and a roll of sheet product positioned thereon.
Figure 3I:
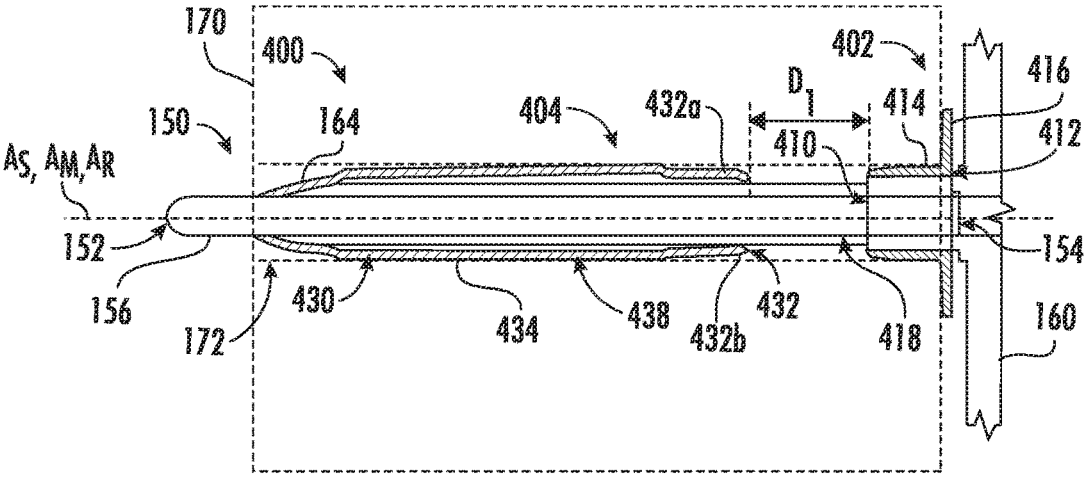
FIG. 3I is a cross-sectional front view of the spindle of FIG. 3A mounted to the mandrel of FIG. 1H, showing the spindle in the first configuration and the roll of sheet product positioned thereon.
Figure 3J:
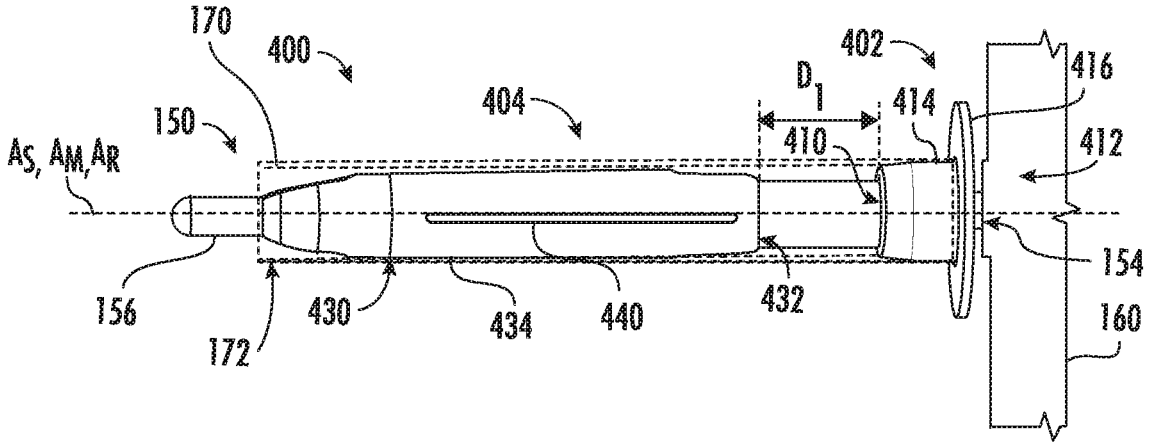
FIG. 3J is a front view of the spindle of FIG. 3A mounted to the mandrel of FIG. 1H, showing the spindle in the first configuration and a remainder of the roll of sheet product positioned thereon following dispensing of the sheet product.
Figure 3K:
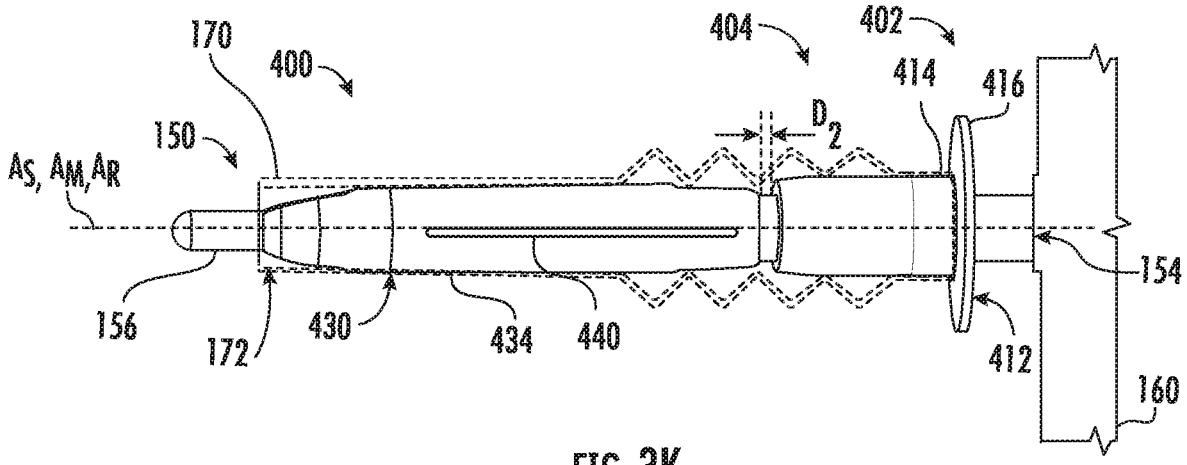
FIG. 3K is a front view of the spindle of FIG. 3A mounted to the mandrel of FIG. 1H, showing the spindle in a second configuration and the remainder of the roll of sheet product in a crushed state.

As shown in FIGS. 3A-3K, the spindle 400 may include a base portion 402 (which also may be referred to as a "base" or a "first portion") and a nose portion 404 (which also may be referred to as a "nose" or a "second portion") that are separate components from one another. During use of the spindle 400, the base portion 402 may be positioned partially within the central opening of the coreless roll of sheet product and partially outside of the central opening, and the nose portion 404 may be positioned entirely or at least partially within the central opening of the coreless roll. As described below, during use of the spindle 400, the base portion 402 and the nose portion 404 may be movable relative to one another between a first configuration, as shown in FIGS. 3H-3J, and a second configuration, as shown in FIG. 3K. In particular, the base portion 402 and the nose portion 404 may be configured to translate relative to one another between the first configuration, in which the portions 402, 404 are positioned further away from one another, and the second configuration, in which the portions 402, 404 are positioned closer to one another.

The base portion 402 may be formed as an elongated member having a first end 410 (which also may be referred to as a "leading end") and a second end 412 (which also may be referred to as a "trailing end") positioned opposite one another in the direction of a longitudinal axis $A_s$ of the spindle 400. As shown, the base portion 402 may include a body 414 (which also may be referred to as a "base body") and a flange 416 (which also may be referred to as a "base flange") fixedly attached to the body 414. In certain embodiments, as shown, the body 414 and the flange 416 may be integrally formed with one another. The flange 416 may be positioned at or near the second end 412 of the base portion 402, and the body 414 may extend from the first end 410 of the base portion 402 to the flange 416. In certain embodiments, the body 414 may have a tubular shape extending axially along the longitudinal axis $A_S$ of the spindle 400 and a circular cross-sectional shape taken in the direction perpendicular to the longitudinal axis $A_S$, although other shapes may be used. In certain embodiments, the flange 416 may have a ring shape extending radially outward with respect to the longitudinal axis $A_S$ of the spindle 400 and a circular cross-sectional shape taken in the direction perpendicular to the longitudinal axis $A_S$, although other shapes may be used. The flange 416 may extend circumferentially along the entire outer circumference of the body 414, as shown, or may extend along only a portion of the outer circumference of the body 414. During use of the spindle 400, the body 414 may be positioned entirely or at least partially within the central opening of the coreless roll of sheet product, and the flange 416 may be positioned outside of the central opening of the roll. In this manner, the body 414 may support a respective end portion of the roll, and the flange 416 may abut or be positioned near the respective end of the roll and also may engage mating portions of the sheet product dispenser, as described below. In certain embodiments, the first end 410 of the base portion 402 may be tapered to facilitate insertion of the body 414 into the central opening of the roll. As shown, the base portion 402 may define an aperture 418 extending axially through the body 414 and the flange 416 from the first end 410 to the second end 412 thereof. In this manner, the base portion 402 may be mounted on a mandrel of the sheet product dispenser, with the mandrel extending through the aperture 418. In certain embodiments, the aperture 418 may include a first region having a first diameter, and a second region having a second diameter that is larger than the first diameter. In certain embodiments, the diameter of the aperture 418 may be constant along the first region in the direction of the longitudinal axis $A_S$. In other embodiments, the diameter of the aperture 418 may vary along the first region in the direction of the longitudinal axis $A_S$. For example, the aperture 418 may be tapered along the first region in the direction of the longitudinal axis $A_S$, such that the diameter increases from the first end 410 toward the second end 412.

The nose portion 404 may be formed as an elongated member having a first end 430 (which also may be referred to as a "leading end") and a second end 432 (which also may be referred to as a "trailing end") positioned opposite one another in the direction of the longitudinal axis $A_S$ of the spindle 400. As shown, the nose portion 404 may include a body 434 (which also may be referred to as a "nose body") extending from the first end 430 to the second end 432 thereof. In certain embodiments, the body 434 may have a tubular shape extending axially along the longitudinal axis $A_S$ of the spindle 400 and a circular cross-sectional shape taken in the direction perpendicular to the longitudinal axis $A_S$, although other shapes may be used. During use of the spindle 400, the body 434 may be positioned entirely or at least partially within the central opening of the coreless roll of sheet product, such that the body 434 supports a respective portion of the roll. As shown, the nose portion 404 may define an aperture 438 extending axially through the body 434 from the first end 430 to the second end 432 thereof. In this manner, the nose portion 404 may be mounted on the mandrel of the dispenser, with the mandrel extending through the aperture 438. In certain embodiments, the aperture 438 may include a first region 438*a* having a first diameter and a second region 438*b* having a second diameter that is larger than the first diameter. In some embodiments, the first end 430 may define a diameter sized to provide frictional engagement with the mandrel 150. In some such embodiments, the first end 430 may define one or more tabs 430*a*, 430*b* that extend longitudinally and radially inward from the body 434 to form the frictional engagement with the mandrel. Similarly, the second end 432 may define a diameter sized to provide frictional engagement with the mandrel 150 and include one or more tabs 432*a*, 432*b* that extend longitudinally and radially inward from the body 434 to form the frictional engagement with the mandrel.

As shown, the nose portion 404 may include one or more fins 440 attached to the body 434 and extending radially outward therefrom. Each fin 440 may be formed as an elongated member extending in the direction of the longitudinal axis $A_S$. In certain embodiments, as shown, each fin 440 may have a trapezoidal cross-sectional shape taken in the direction parallel to the direction of the longitudinal axis $A_S$, although other shapes may be used. In certain embodiments, each fin 440 may extend from the second end 432 toward the first end 430 and may terminate at a location spaced apart from the first end 430, although other positions may be used. During use of the spindle 400, the fins 440 may be positioned entirely or at least partially within the central opening of the coreless roll of sheet product. In this manner, respective radially outer surfaces of the fins 440 may frictionally engage the inner layer of sheet product of the roll, such that the nose portion 404 and the roll rotate with one another about the mandrel of the dispenser. In this manner, the interaction between the nose portion 404 and the mandrel may control rotation of the roll during dispensing.

As described herein, the nose portion 404 may form a body with one or more features similar to those of various example spindles described in U.S. Non-Provisional application Ser. No. 16/145,876, entitled "Spindle Assembly for Sheet Product Dispensers", which was filed on the same day as the present application, is assigned to the Assignee of the present application, and is incorporated by reference in its entirety.

In certain embodiments, the spindle 400 may be formed of a plastic material, although other materials, such as composites or metals may be used in other embodiments. In certain embodiments, the base portion 402 and the nose portion 404 may be formed of the same material. In other embodiments, the base portion 402 and the nose portion 404 may be formed of different materials.

FIGS. 3H-3K illustrate the spindle 400 mounted to a mandrel 150 of a sheet product dispenser, with a roll 170 of sheet product (shown via dashed lines) positioned on the spindle 400 for dispensing of the sheet product. The roll 170 of sheet product and the mandrel 150 may be configured in the manner described above. As shown, the spindle 400 may support the roll 170 for rotation about the longitudinal axis $A_M$ of the mandrel 150. The spindle 400 may be mounted to the mandrel 150 such that the longitudinal axis $A_S$ of the spindle 400, the longitudinal axis $A_M$ of the mandrel 150, and the longitudinal axis $A_R$ of the roll 170 are coaxial with one another. The mandrel 150 may have a first end 152 and a second end 154 positioned opposite one another, and the mandrel 150 may include a shaft 156 attached to a support 160.

As shown in FIGS. 3H and 3I, the spindle 400 may be mounted to the mandrel 150 with the base portion 402 and the nose portion 404 positioned over the mandrel. As shown, the spindle 400 may be in the first configuration, with the base portion 402 and the nose portion 404 spaced apart from one another by a first distance $D_1$ in the direction of the longitudinal axis $A_M$. In certain embodiments, as shown, the flange 416 of the base portion 402 may be positioned near but axially spaced apart from the support 160 and the second end 154 of the mandrel 150 when the spindle 400 is in the first configuration. In other embodiments, the flange 416 may abut the support 160 when the spindle 400 is in the first configuration.

When the roll 170 of sheet product is positioned over the spindle 400 and the mandrel 150 and the spindle 400 is in the first configuration, the body 414 of the base portion 402 may be positioned entirely or at least partially within the central opening 172 of the roll 170, and the flange 416 may be positioned outside of the central opening 172. In certain embodiments, as shown, the flange 416 may abut the respective end of the roll 170. When the roll 170 of sheet product is positioned over the spindle 400 and the mandrel 150 and the spindle 400 is in the first configuration, the nose portion 404 may be positioned at least partially within the central opening 172 and at least partially outside of the central opening 172, as shown.

Sheet product may be dispensed from the roll 170 by a user grasping and pulling a tail end of the roll 170, thereby causing the spindle 400 and the roll 170 to rotate relative to the mandrel 150 about the longitudinal axis $A_M$. As described above, rotation of the spindle 400 and the roll 170 may be controlled by the frictional engagement between the spindle 400 and the mandrel. When the roll 170 is new (i.e., prior to dispensing of sheet product therefrom) or a substantial amount of the roll 170 remains, the spindle 400 may be inhibited from moving from the first configuration toward the second configuration. In other words, when at least a substantial amount of the roll 170 remains, the base portion 402 and the nose portion 404 may be inhibited from axially translating toward one another. In particular, the base portion 402 and the nose portion 404 may be inhibited from axially translating toward one another due to one or more or all of: (i) the column strength of the remaining portion of the roll 170 in the direction of the longitudinal axis $A_R$ thereof, and (ii) the frictional engagement between the base portion 402 and/or the nose portion 404 and the roll 170. In certain embodiments, the spindle 400 may be deemed to be "inhibited" from moving from the first configuration toward the second configuration when an axial force required to move the spindle 400 from the first configuration to the second configuration is at least 10 pounds-force, at least 20 pounds-force, at least 30 pounds-force, or at least 40 pounds-force. In certain embodiments, the spindle 400 may be inhibited from moving from the first configuration toward the second configuration when at least 10%, at least 5%, or at least 1% of the roll 170 remains on the spindle 400.

In certain instances, the entire roll 170 may be dispensed from the sheet product dispenser, such that no sheet product remains positioned on the spindle 400. In other instances, a limited amount of sheet product of the roll 170 may remain positioned on the spindle 400, as shown in FIG. 3J. This "tube" or "cigar" of remaining sheet product of the roll 170 may be difficult for a user to access or easily dispense. When such a limited amount of sheet product remains, the spindle 400 may be able to move from the first configuration to the second configuration, as shown in FIG. 3K. In particular, the base portion 402 may be axially translated toward the nose portion 404, as shown, or the nose portion 404 may be axially translated toward the base portion 402. In certain embodiments, such movement of the spindle 400 may crush or otherwise deform the remainder of the roll 170, as shown. In this manner, the interaction between the spindle 400, the mandrel 150, and the coreless roll 170 may inhibit users from discarding the roll 170 until the roll 170 is completely or nearly completely depleted. In instances in which a cored roll is used with the spindle 400 and the roll is completely or nearly completely depleted, the paperboard core remaining on the spindle 400 may prevent the spindle 400 from moving from the first configuration to the second configuration due to at least the column strength of the paperboard core in the direction of the longitudinal axis thereof.

In certain embodiments, a multi-roll sheet product dispenser may include a plurality of the spindles 400 for supporting a plurality of the rolls 170 of sheet product relative to the dispenser. For example, a pair of the spindles 400 may be used as a part of the sheet product dispenser 180 described above (instead of the spindles 100), with one of the spindles 400 mounted on the first mandrel 150*a* and supporting the first roll 170*a*, and the other spindle 400 mounted on the second mandrel 150*b* and supporting the second roll 170*b*. It will be appreciated that the spindles 400 may interact with the mandrels 150*a*, 150*b*, the rolls 170*a*, 170*b*, the door 186, and the door lock 187 in a manner similar to that described above to inhibit users from accessing the full second roll 170*b* until the first roll 170*a* is completely or nearly completely depleted, thereby minimizing waste of sheet product. Further, the spindles 400 may interact with the mandrels 150*a*, 150*b*, the rolls 170*a*, 170*b*, the door 186, and the door lock 187 in a manner similar to that described above to inhibit use of cored rolls of sheet product therewith.

FIGS. 4A-4K illustrate a spindle 300 (which also may be referred to as a "sheet product roll spindle") according to one or more embodiments of the disclosure. The spindle 300 is configured to support a roll of sheet product with respect to a sheet product dispenser, as described below. The spindle 300 may be used as a part of the sheet product dispenser 180 described above (instead of the spindle 100) or another type of sheet product dispenser having a different configuration. The spindle 300 may be configured for use with coreless rolls of sheet product. As described below, the spindle 300 may be configured to cooperate with other portions of the sheet product dispenser to inhibit use of cored rolls of sheet product therewith and also inhibit users from making a new roll accessible for dispensing from the dispenser until a currently accessible roll is completely or nearly completely depleted. It will be appreciated that the spindle 300 generally may be configured in a manner similar to that of the spindle 100. As described below, a particular difference between the spindle 300 and the spindle 100 is that a base portion 302 and a nose portion 304 of the spindle 300 are integrally formed with one another, as compared to the base portion 102 and the nose portion 104 being separate components. In this manner, the base portion 302 and the nose portion 304 may move with one another relative to the mandrel 150 between a first configuration and a second configuration.

Figure 4A:
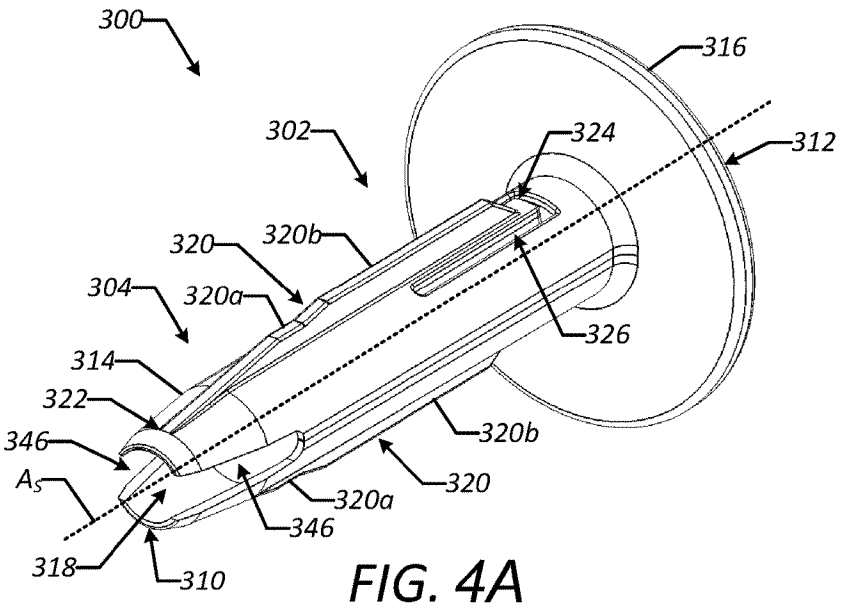
FIG. 4A is a perspective view of a spindle for a roll of sheet product in accordance with one or more embodiments of the disclosure.
Figure 4C:
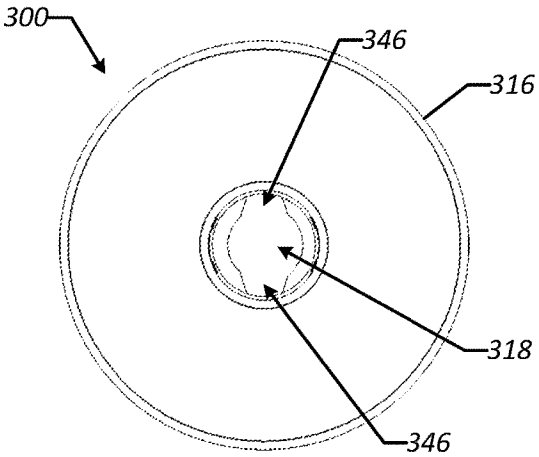
FIG. 4C is an opposite end view of the spindle of FIG. 4A.
Figure 4B:
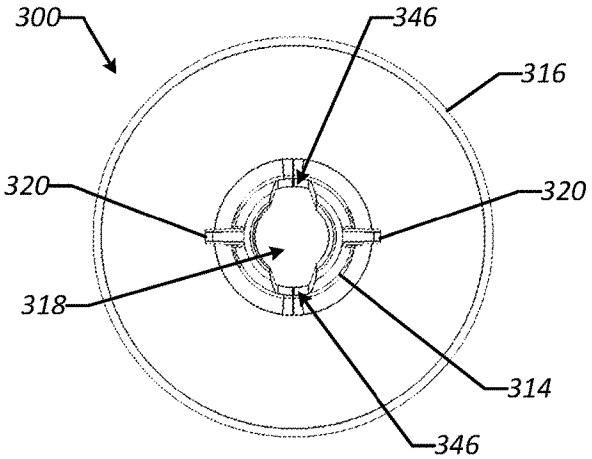
FIG. 4B is an end view of the spindle of FIG. 4A.
Figure 4D:
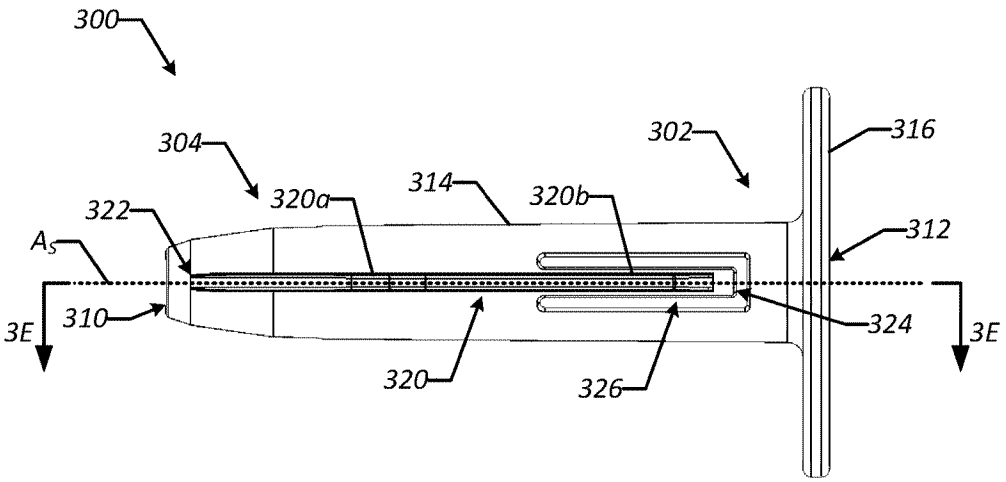
FIG. 4D is a front view of the spindle of FIG. 4A.
Figure 4E:
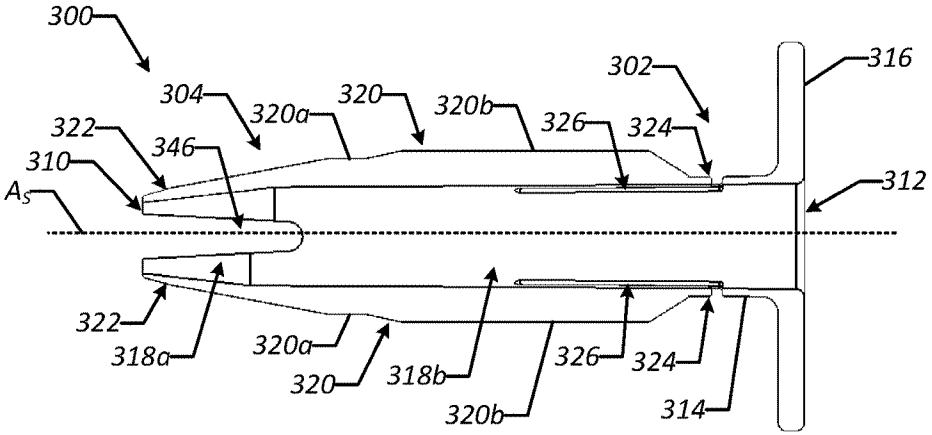
FIG. 4E is a cross-sectional top view of the spindle of FIG. 4A, taken along line 4E-4E of FIG. 4D.
Figure 4F:
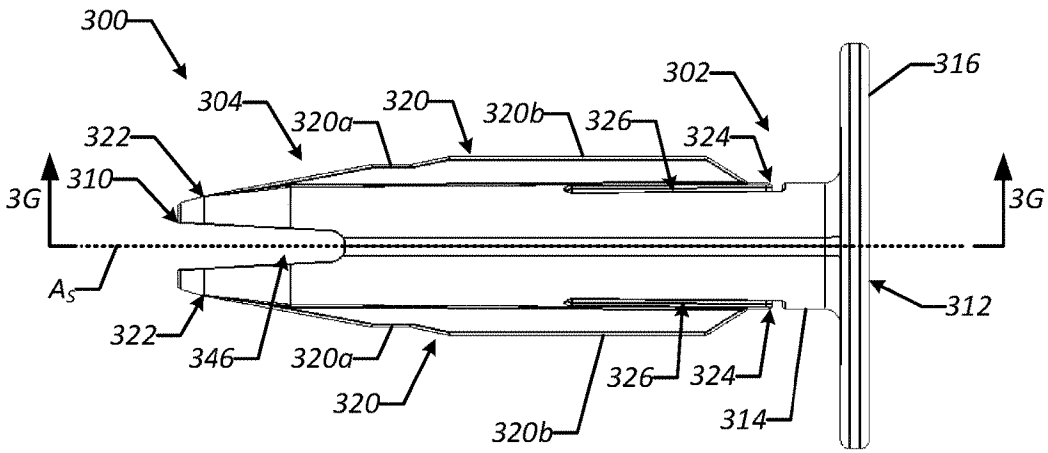
FIG. 4F is a top view of the spindle of FIG. 4A.
Figure 4G:
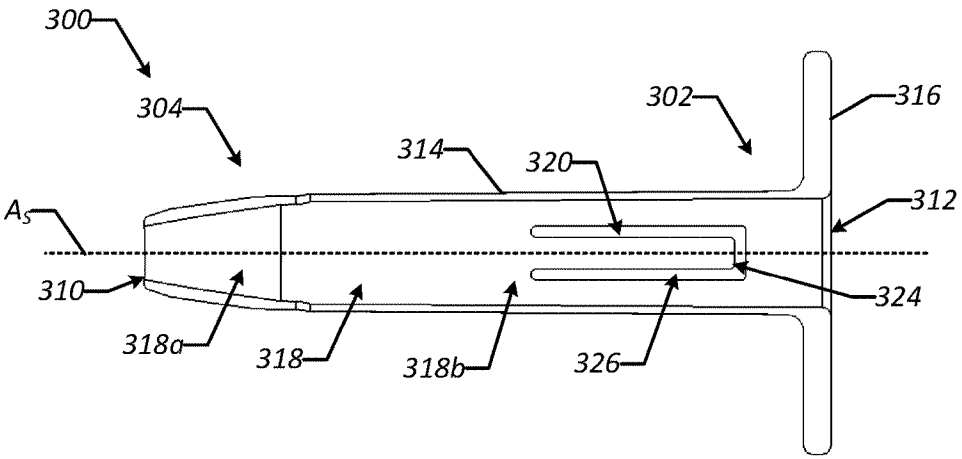
FIG. 4G is a cross-sectional front view of the spindle of FIG. 4A, taken along line 4G-4G of FIG. 4F.
Figure 4H:
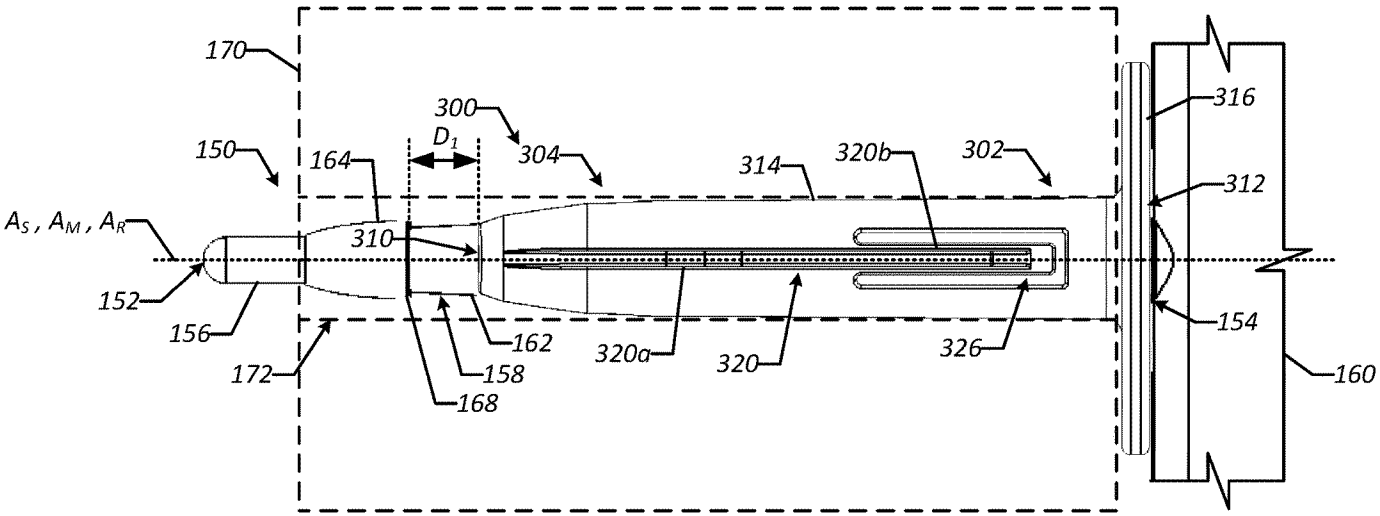
FIG. 4H is a front view of the spindle of FIG. 4A mounted to the mandrel of FIG. 1H, showing the spindle in a first configuration and a roll of sheet product positioned thereon.
Figure 4I:
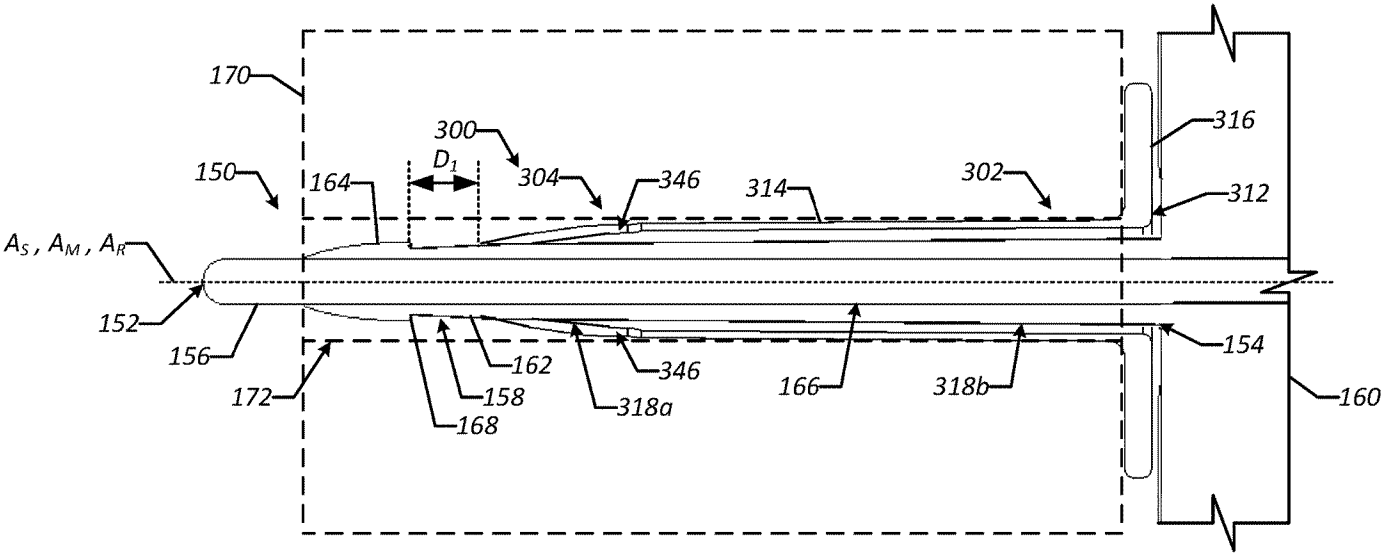
FIG. 4I is a cross-sectional front view of the spindle of FIG. 4A mounted to the mandrel of FIG. 1H, showing the spindle in the first configuration and the roll of sheet product positioned thereon.
Figure 4J:
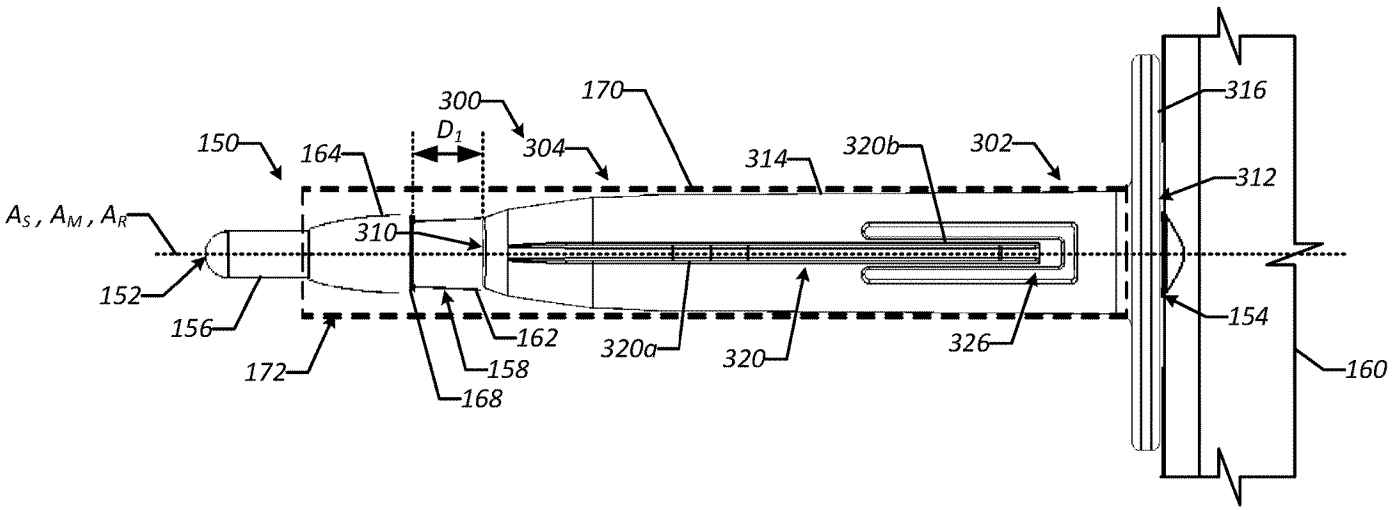
FIG. 4J is a front view of the spindle of FIG. 4A mounted to the mandrel of FIG. 1H, showing the spindle in the first configuration and a remainder of the roll of sheet product positioned thereon following dispensing of the sheet product.
Figure 4K:
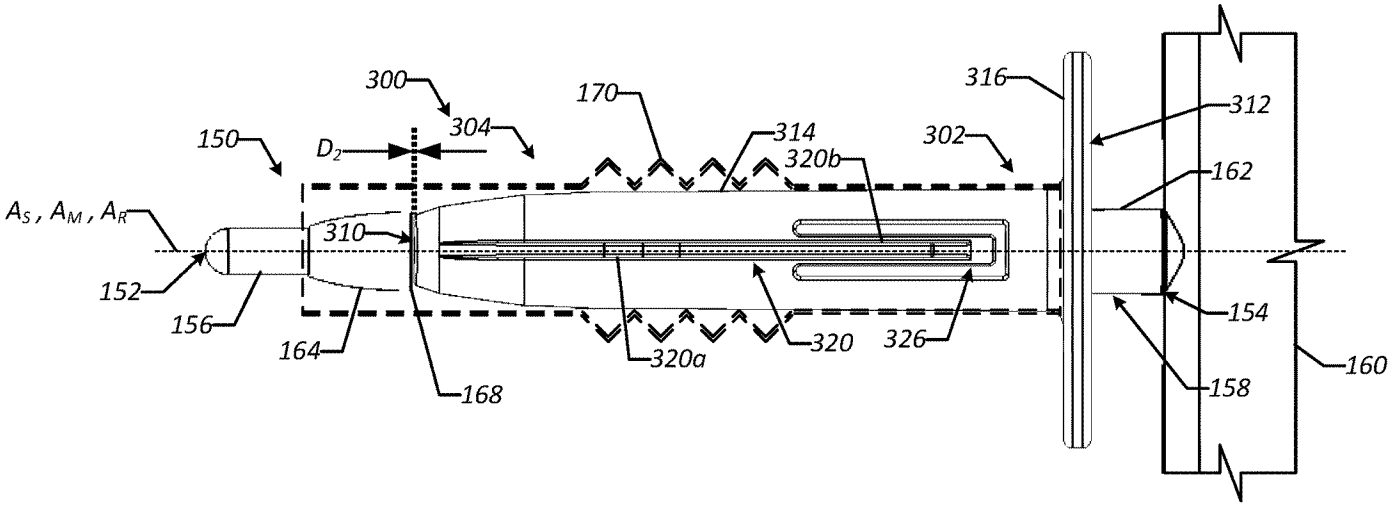
FIG. 4K is a front view of the spindle of FIG. 4A mounted to the mandrel of FIG. 1H, showing the spindle in a second configuration and the remainder of the roll of sheet product in a crushed state.

As shown in FIGS. 4A-4K, the spindle 300 may include a base portion 302 (which also may be referred to as a "base" or a "first portion") and a nose portion 304 (which also may be referred to as a "nose" or a "second portion") that are integrally formed one another. During use of the spindle 300, the base portion 302 may be positioned partially within the central opening of the coreless roll of sheet product and partially outside of the central opening, and the nose portion 304 may be positioned entirely or at least partially within the central opening of the coreless roll. As described below, during use of the spindle 300, the spindle 300 may be movable relative to a mandrel of a dispenser between a first configuration, as shown in FIGS. 4H-4J, and a second configuration, as shown in FIG. 4K. In particular, the spindle 300 may be configured to translate relative to the mandrel between the first configuration, in which the spindle 300 positioned further away from an outer, free end of the mandrel, and the second configuration, in which the spindle 300 is positioned closer to the outer, free end of the mandrel.

The spindle 300 may be formed as an elongated member having a first end 310 (which also may be referred to as a "leading end") and a second end 312 (which also may be referred to as a "trailing end") positioned opposite one another in the direction of a longitudinal axis $A_s$ of the spindle 300. As shown, the spindle 300 may include a body 314 (which also may be referred to as a "spindle body") and a flange 316 (which also may be referred to as a "spindle flange") fixedly attached to the body 314. In certain embodiments, as shown, the body 314 and the flange 316 may be integrally formed with one another. The flange 316 may be positioned at or near the second end 312 of the spindle 300, and the body 314 may extend from the first end 310 of the spindle 300 to the flange 316. In certain embodiments, the body 314 may have a tubular shape extending axially along the longitudinal axis $A_S$ of the spindle 300 and a circular cross-sectional shape taken in the direction perpendicular to the longitudinal axis $A_S$, although other shapes may be used. In certain embodiments, the flange 316 may have a ring shape extending radially outward with respect to the longitudinal axis $A_S$ of the spindle 300 and a circular cross-sectional shape taken in the direction perpendicular to the longitudinal axis $A_S$, although other shapes may be used. The flange 316 may extend circumferentially along the entire outer circumference of the body 314, as shown, or may extend along only a portion of the outer circumference of the body 314. During use of the spindle 300, the body 314 may be positioned entirely or at least partially within the central opening of the coreless roll of sheet product, and the flange 316 may be positioned outside of the central opening of the roll. In this manner, the body 314 may support a respective portion of the roll, and the flange 316 may abut or be positioned near the respective end of the roll and also may engage mating portions of the sheet product dispenser, as described below. In certain embodiments, the first end 310 of the spindle 300 may be tapered to facilitate insertion of the body 314 into the central opening of the roll. As shown, the spindle 300 may define an aperture 318 extending axially through the body 314 and the flange 316 from the first end 310 to the second end 312 thereof. In this manner, the spindle 300 may be mounted on a mandrel of the sheet product dispenser, with the mandrel extending through the aperture 318. In certain embodiments, the aperture 318 may include a first region 318*a* having a first diameter, and a second region 318*b* having a second diameter that is larger than the first diameter. In certain embodiments, the diameter of the aperture 318 may vary along each of the first region 318*a* and the second region 318*b* in the direction of the longitudinal axis $A_S$. For example, the aperture 318 may be tapered along each of the first region 318*a* and the second region 318*b* in the direction of the longitudinal axis $A_S$, such that the diameter increases from the first end 310 toward the second end 312 along each of the regions 318*a*, 318*b*. In other embodiments, the diameter of the aperture 318 may be constant along the first region 318*a* and/or the second region 318*b* in the direction of the longitudinal axis $A_S$.

As shown, the spindle 300 may include one or more fins 320 attached to the body 314 and extending radially outward therefrom. In certain embodiments, the spindle 300 may include a pair of the fins 320 circumferentially spaced apart from one another, for example, by 180 degrees, although any number of the fins 320 and alternative spacings of the fins 320 may be used. Each fin 320 may be formed as an elongated member extending in the direction of the longitudinal axis $A_S$. In certain embodiments, as shown, each fin 320 may have a stepped cross-sectional shape taken in the direction parallel to the direction of the longitudinal axis $A_S$, although other shapes may be used. In particular, each fin 320 may include a first step 320*a* extending along at least a portion of the nose portion 304 and a second step 320*b* extending along at least a portion of the base portion 302, with the radially outer surface of the second step 320*b* being positioned further away from the longitudinal axis $A_S$ than the radially outer surface of the first step 320*a* in the radial direction. Each fin 320 may have a fixed end 322 that is fixedly attached to the body 314 and an opposite free end 324 that is able to move with respect to the body 314. In particular, each fin 320 may be elastically deflected or deformed inward toward the longitudinal axis $A_S$, such that the free end 324 of the fin 320 is positioned at least partially within the aperture 318. In this manner, the fins 320 may frictionally engage the mandrel of the sheet product dispenser. As shown, each fin 320 may be positioned at least partially within a mating first slot 326 defined in the body 314 and in communication with the aperture 318. During use of the spindle 300, the fins 320 may be positioned entirely or at least partially within the central opening of the coreless roll of sheet product. In this manner, respective radially outer surfaces of the fins 320 may frictionally engage the inner layer of sheet product of the roll, such that the spindle 300 and the roll rotate with one another about the mandrel of the dispenser. In certain embodiments, the central opening of the coreless roll may be sized such that, upon insertion of the body 314 therein, portions of the fins 320 are deflected inward toward the longitudinal axis $A_S$ and into the aperture 318. In this manner, respective radially inner surfaces of the fins 320 may frictionally engage the mandrel of the dispenser. Such frictional engagement may provide a degree of resistance opposing rotation of the spindle 300 and the roll relative to the mandrel. In this manner, the interaction between the spindle 300 and the mandrel may control rotation of the roll during dispensing.

As shown, one or more second slots 346 also may be defined in the body 314. In certain embodiments, a pair of the second slots 346 may be circumferentially spaced apart from one another, for example, by 180 degrees, although any number of the second slots 346 and alternative spacings of the second slots 346 may be used. As shown, one of the second slots 346 may be positioned circumferentially between the fins 320 along one side of the body 314, and the other second slot 346 may be positioned circumferentially between the fins 320 along an opposite side of the body 314. Each second slot 346 may extend from the first end 310 toward the second end 312 of the spindle 300 and may terminate at a location spaced apart from the second end 312. As shown, the second slots 346 may be configured to allow respective portions of the body 314 and the fins 320 near the first end 310 to be elastically deflected or deformed inward toward the longitudinal axis $A_S$. In this manner, the body 314 may frictionally engage the mandrel of the sheet product dispenser. During use of the spindle 300, the fins 320 may be positioned entirely or at least partially within the central opening of the coreless roll of sheet product. In this manner, respective radially outer surfaces of the fins 320 may frictionally engage the inner layer of sheet product of the roll, such that the spindle 300 and the roll rotate with one another about the mandrel of the dispenser. In certain embodiments, the central opening of the coreless roll may be sized such that, upon insertion of the body 314 therein, portions of the body 314 and the fins 320 are deflected inward toward the longitudinal axis $A_S$ about the second slots 346. In this manner, respective radially inner surfaces of the body 314 may frictionally engage the mandrel of the dispenser. Such frictional engagement may provide a degree of resistance opposing rotation of the spindle 300 and the roll relative to the mandrel. In this manner, the interaction between the spindle 300 and the mandrel may control rotation of the roll during dispensing.

In certain embodiments, the spindle 300 may be formed of a plastic material, although other materials, such as composites or metals may be used in other embodiments. In certain embodiments, the base portion 302 and the nose portion 304 may be formed of the same material. In other embodiments, the base portion 302 and the nose portion 304 may be formed of different materials.

FIGS. 4H-4K illustrate the spindle 300 mounted to a mandrel 150 of a sheet product dispenser, with a roll 170 of sheet product (shown via dashed lines) positioned on the spindle 300 for dispensing of the sheet product. The roll 170 of sheet product and the mandrel 150 may be configured in the manner described above. As shown, the spindle 300 may support the roll 170 for rotation about the longitudinal axis $A_M$ of the mandrel 150. The spindle 300 may be mounted to the mandrel 150 such that the longitudinal axis $A_S$ of the spindle 300, the longitudinal axis $A_M$ of the mandrel 150, and the longitudinal axis $A_R$ of the roll 170 are coaxial with one another. The mandrel 150 may have a first end 152 and a second end 154 positioned opposite one another, and the mandrel 150 may include a shaft 156 and a sleeve 158 positioned over at least a portion of the shaft 156 and attached to a support 160. As shown, the sleeve 158 may include a body 162, a nose 164 positioned at the free end of the sleeve 158, an aperture 166 extending through the body 162 and the nose 164, and a lip 168 positioned at the interface of the body 162 and the nose 164.

As shown in FIGS. 4H and 4I, the spindle 300 may be mounted to the mandrel 150 with the spindle 300 positioned over the sleeve 158. In other words, the sleeve 158 may extend through the aperture 318 of the spindle 300. As shown, the spindle 300 may be in the first configuration, with the first end 310 of the spindle 300 and the lip 168 of the sleeve 158 spaced apart from one another by a first distance $D_1$ in the direction of the longitudinal axis $A_M$. In certain embodiments, as shown, the flange 316 of the spindle 300 may be positioned near but axially spaced apart from the support 160 and the second end 154 of the mandrel 150 when the spindle 300 is in the first configuration. In other embodiments, the flange 316 may abut the support 160 when the spindle 300 is in the first configuration.

When the roll 170 of sheet product is positioned over the spindle 300 and the mandrel 150 and the spindle 300 is in the first configuration, the body 314 of the spindle 300 may be positioned entirely or at least partially within the central opening 172 of the roll 170, and the flange 316 may be positioned outside of the central opening 172. In certain embodiments, as shown, the flange 316 may abut the respective end of the roll 170. When the roll 170 of sheet product is positioned over the spindle 300 and the mandrel 150 and the spindle 300 is in the first configuration, the first end 310 of the spindle 300 may be positioned within the central opening 172, as shown. When the roll 170 of sheet product is positioned over the spindle 300, frictional engagement between the fins 320 and the central aperture 172 may cause the free-end portions of the fins 320 to be elastically deflected inward toward the longitudinal axis $A_M$ and into the aperture 318. As a result, the fins 320 may frictionally engage the sleeve 158, thereby providing a resistance to rotation of the spindle 300 and the roll 170 relative to the sleeve 158 and the overall mandrel 150. Additionally, when the roll 170 of sheet product is positioned over the spindle 300, frictional engagement between the fins 320 and the central aperture 172 may cause the free-end portions of the body 314 to be elastically deflected inward toward the longitudinal axis $A_M$ about the slots 346. As a result, the body 314 may frictionally engage the sleeve 158, thereby providing a resistance to rotation of the spindle 300 and the roll 170 relative to the sleeve 158 and the overall mandrel 150. In certain embodiments, the free end of the sleeve 158 may be aligned with the opposite end of the roll 170. In other embodiments, the free end of the sleeve 158 may be positioned within or outside of the central opening 172. In certain embodiments, the free end of the shaft 156 may be positioned outside of the central opening 172.

Sheet product may be dispensed from the roll 170 by a user grasping and pulling a tail end of the roll 170, thereby causing the spindle 300 and the roll 170 to rotate relative to the mandrel 150 about the longitudinal axis $A_M$. As described above, rotation of the spindle 300 and the roll 170 may be controlled by the frictional engagement between the spindle 300 and the sleeve 158. When the roll 170 is new (i.e., prior to dispensing of sheet product therefrom) or a substantial amount of the roll 170 remains, the spindle 300 may be inhibited from moving from the first configuration toward the second configuration. In other words, when at least a substantial amount of the roll 170 remains, the spindle 300 may be inhibited from axially translating toward the lip 168 of the sleeve 158. In particular, the spindle 300 may be inhibited from axially translating toward the lip 168 due to one or more or all of: (i) the column strength of the remaining portion of the roll 170 in the direction of the longitudinal axis $A_R$ thereof, (ii) the frictional engagement between the spindle 300 and the roll 170, and (iii) the frictional engagement between the spindle 300 and the sleeve 158. In certain embodiments, the spindle 300 may be deemed to be "inhibited" from moving from the first configuration toward the second configuration when an axial force required to move the spindle 300 from the first configuration to the second configuration is at least 10 pounds-force, at least 20 pounds-force, at least 30 pounds-force, or at least 40 pounds-force. In certain embodiments, the spindle 300 may be inhibited from moving from the first configuration toward the second configuration when at least 10%, at least 5%, or at least 1% of the roll 170 remains on the spindle 300.

In certain instances, the entire roll 170 may be dispensed from the sheet product dispenser, such that no sheet product remains positioned on the spindle 300. In other instances, a limited amount of sheet product of the roll 170 may remain positioned on the spindle 300, as shown in FIG. 3J. This "tube" or "cigar" of remaining sheet product of the roll 170 may difficult for a user to access or easily dispense. When such a limited amount of sheet product remains, the spindle 300 may be able to move from the first configuration to the second configuration, as shown in FIG. 4K. In particular, the spindle 300 may be axially translated toward the lip 168 of the sleeve 158, as shown. In certain embodiments, such movement of the spindle 300 may crush or otherwise deform the remainder of the roll 170, as shown. In this manner, the interaction between the spindle 300, the mandrel 150, and the coreless roll 170 may inhibit users from discarding the roll 170 until the roll 170 is completely or nearly completely depleted. In instances in which a cored roll is used with the spindle 300 and the roll is completely or nearly completely depleted, the paperboard core remaining on the spindle 300 may prevent the spindle 300 from moving from the first configuration to the second configuration due to at least the column strength of the paperboard core in the direction of the longitudinal axis thereof.

In certain embodiments, a multi-roll sheet product dispenser may include a plurality of the spindles 300 for supporting a plurality of the rolls 170 of sheet product relative to the dispenser. For example, a pair of the spindles 300 may be used as a part of the sheet product dispenser 180 described above (instead of the spindles 100), with one of the spindles 300 mounted on the first mandrel 150*a* and supporting the first roll 170*a*, and the other spindle 300 mounted on the second mandrel 150*b* and supporting the second roll 170*b*. It will be appreciated that the spindles 300 may interact with the mandrels 150*a*, 150*b*, the rolls 170*a*, 170*b*, the door 186, and the door lock 187 in a manner similar to that described above to inhibit users from accessing the full second roll 170*b* until the first roll 170*a* is completely or nearly completely depleted, thereby minimizing waste of sheet product. Further, the spindles 300 may interact with the mandrels 150*a*, 150*b*, the rolls 170*a*, 170*b*, the door 186, and the door lock 187 in a manner similar to that described above to inhibit use of cored rolls of sheet product therewith.

Although certain embodiments of the disclosure are described herein and shown in the accompanying drawings, one of ordinary skill in the art will recognize that numerous modifications and alternative embodiments are within the scope of the disclosure. Moreover, although certain embodiments of the disclosure are described herein with respect to specific spindle configurations, it will be appreciated that numerous other spindle configurations are within the scope of the disclosure. Conditional language used herein, such as "can," "could," "might," or "may," unless specifically stated otherwise, or otherwise understood within the context as used, generally is intended to convey that certain embodiments include, while other embodiments do not include, certain features, elements, or functional capabilities. Thus, such conditional language generally is not intended to imply that certain features, elements, or functional capabilities are in any way required for all embodiments.

The invention claimed is:

1. A sheet product dispenser comprising:

a housing defining an interior space configured to receive a first roll of sheet product and a second roll of sheet product;

a first mandrel positioned within the interior space; and a first spindle positioned over at least a portion of the first mandrel and configured to support the first roll of sheet product for rotation about the first mandrel, wherein the first spindle comprises a base portion and a nose portion configured to translate relative to one another along a longitudinal axis of the first mandrel, wherein at least a portion of the first spindle is configured to translate relative to the first mandrel from a first configuration to a second configuration to cause a remainder of the first roll of sheet product to deform;

a second mandrel positioned within the interior space;

a second spindle positioned over at least a portion of the second mandrel and configured to support the second roll of sheet product for rotation about the second mandrel, wherein at least a portion of the second spindle is configured to translate relative to the second mandrel from a first configuration to a second configuration to cause a remainder of the second roll of sheet product to deform;

a dispensing opening defined in the housing and configured to allow sheet product to be dispensed therethrough;

a door configured to move relative to the dispensing opening between a first position for dispensing sheet product from the first roll of sheet product and a second position for dispensing sheet product from the second roll of sheet product; and a door lock positioned within the interior space and configured to engage the first spindle and the second spindle.

2. The sheet product dispenser of claim 1, wherein the base portion and the nose portion are spaced apart from one another by a first distance in the direction of the longitudinal axis when the first spindle is in the first configuration, wherein the base portion and the nose portion are spaced apart from one another by a second distance in the direction of the longitudinal axis when the first spindle is in the second configuration, and wherein the second distance is less than the first distance.

3. The sheet product dispenser of claim 1, wherein the base portion is configured to translate on the first mandrel from a first position to a second position.

4. The sheet product dispenser of claim 1, wherein the base portion comprises:

a flange extending radially outward from the first mandrel.

5. The sheet product dispenser of claim 4, wherein the nose portion comprises:

a body positioned over at least a portion of the first mandrel; and one or more fins extending radially outward from the body and configured to engage a central opening of the first roll of sheet product.

6. The sheet product dispenser of claim 1, wherein the first mandrel comprises:

a shaft extending along a longitudinal axis of the first mandrel; and a sleeve positioned over at least a portion of the shaft;

wherein the first spindle is configured to rotate and to translate relative to the sleeve.

7. The sheet product dispenser of claim 1, wherein the door lock and the first spindle are configured to inhibit the door from moving from the first position to the second position when the first roll of sheet product is full or partially depleted, and wherein the door lock and the first spindle are configured to allow the door to move from the first position to the second position when the first roll of sheet product is completely or nearly completely depleted.

8. The sheet product dispenser of claim 7, wherein the door lock is configured to translate the portion of the first spindle from the first configuration to the second configuration when the door is moved from the first position to the second position.

9. The sheet product dispenser of claim 7, wherein the door lock and the second spindle are configured to inhibit the door from moving from the second position to the first position when the second roll of sheet product is full or partially depleted, and wherein the door lock and the second spindle are configured to allow the door to move from the second position to the first position when the second roll of sheet product is completely or nearly completely depleted.

10. The sheet product dispenser of claim 9, wherein the door lock is configured to translate the portion of the second spindle from the first configuration to the second configuration when the door is moved from the second position to the first position.

11. A spindle assembly for supporting a roll of sheet product with respect to a sheet product dispenser, the spindle assembly comprising:

a base portion configured to be positioned over a mandrel of the sheet product dispenser, wherein the base portion defines a flange extending radially outward from the mandrel and configured to be positioned outside of the central opening of the roll of sheet product; and a nose portion configured to be positioned over the mandrel and to support a portion of the roll of sheet product, the nose portion comprising:

a nose body extending along the longitudinal axis and configured to be positioned at least partially within the central opening;

wherein the base portion is configured to translate toward the nose portion along the longitudinal axis of the mandrel from a first configuration to a second configuration to cause a remainder of the roll of sheet product to deform.

12. The spindle assembly of claim 11, wherein the nose portion further comprises a fin extending radially outward from the nose body and configured to engage the central opening.

13. A sheet product dispenser comprising:

a housing defining an interior space configured to receive a roll of sheet product therein;

a mandrel positioned within the interior space;

a spindle positioned over at least a portion of the mandrel and configured to support the roll of sheet product for rotation about the mandrel; and a base member positioned over at least a portion of the mandrel and defining a flange extending radially outwardly from the mandrel, wherein the flange is configured to rest adjacent a side surface of the roll of sheet product, wherein the base member is configured to translate on the mandrel from a first configuration to a second configuration to cause a remainder of the roll of sheet product to deform, wherein the base member is positioned in a spaced apart manner from the spindle when in the first configuration such as to define a first distance, wherein the base member is positioned a second distance from the spindle when in the second configuration, and wherein the first distance is greater than the second distance.

14. The sheet product dispenser of claim 13, wherein the spindle comprises a fin extending radially outward from a body and configured to engage a central opening of the roll of sheet product.

15. A method for supporting sheet product with respect to a sheet product dispenser, the method comprising:

supporting a roll of sheet product with a spindle for rotation about a mandrel positioned within an interior space of a housing of the sheet product dispenser, wherein the spindle comprises a base portion and a nose portion, wherein the base portion is configured to translate along a longitudinal axis of the mandrel toward the nose portion relative to the mandrel between a first configuration and a second configuration, wherein the nose portion is rotatably attached to the mandrel in a first longitudinal position, wherein the base portion defines a flange extending radially outwardly from the mandrel;

inhibiting the base portion from moving from the first configuration to the second configuration when the roll of sheet product is full or partially depleted;

allowing sheet product to be dispensed from the roll of sheet product; and allowing, while the nose portion is in the first longitudinal position, the base portion to translate from the first configuration to the second configuration when the roll of sheet product is completely or nearly completely depleted.

16. The method of claim 15, further comprising:

inhibiting a door of the dispenser from moving from a first position to a second position when the roll of sheet product is full or partially depleted; and allowing the door to move from the first position to the second position when the roll of sheet product is completely or nearly completely depleted.

17. The method of claim 16, further comprising supporting a second roll of sheet product with a second spindle for rotation about a second mandrel positioned within the interior space, wherein the door covers the second roll of sheet product when the door is in the first position.

* * * * *